US008721059B2

(12) United States Patent
Kodama et al.

(10) Patent No.: US 8,721,059 B2
(45) Date of Patent: May 13, 2014

(54) PRINTING MATERIAL CARTRIDGE AND PRINTING MATERIAL SUPPLY SYSTEM

(75) Inventors: Hidetoshi Kodama, Matsumoto (JP); Izumi Nozawa, Matsumoto (JP); Tadahiro Mizutani, Shiojiri (JP); Hiroyuki Nakamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 314 days.

(21) Appl. No.: 13/223,069

(22) Filed: Aug. 31, 2011

(65) Prior Publication Data

US 2012/0056955 A1 Mar. 8, 2012

(30) Foreign Application Priority Data

Sep. 3, 2010 (JP) ..... 2010-197320

(51) Int. Cl.
*B41J 2/175* (2006.01)
*B41J 2/14* (2006.01)

(52) U.S. Cl.
USPC ..... 347/86; 347/50; 347/85

(58) Field of Classification Search
USPC ..... 347/50, 84, 85, 86
See application file for complete search history.

(56) References Cited

U.S. PATENT DOCUMENTS 6,488,369 B1 12/2002 Steinmetz et al.

(Continued)

FOREIGN PATENT DOCUMENTS

DE 202009013257 U1 2/2010
EP 0547596 A2 6/1996

(Continued)

OTHER PUBLICATIONS

International Search Report issued on Feb. 21, 2012 in PCT Application No. PCT/JP2011/004938.

*Primary Examiner* — Jannelle M Lebron
(74) *Attorney, Agent, or Firm* — Stroock & Stroock & Lavan LLP

(57) ABSTRACT

A printing apparatus has a cartridge attachment section including a terminal block having apparatus-side terminals disposed on its inclined surface, and a printing material supply pipe. Among the apparatus-side terminals, one apparatus-side ground terminal located on their center in Y direction is protruded to a greater height than the other plural apparatus-side terminals. A printing material cartridge has a circuit board, a printing material supply port, and a board mount portion that is inclined at an acute angle relative to a plane extended from an opening face of the printing material supply port. The circuit board is arranged such that one cartridge-side terminal on the circuit board comes into contact with the apparatus-side ground terminal prior to the other cartridge-side terminals in the process of attachment of the printing material cartridge to the cartridge attachment section. This arrangement enables the printing material cartridge to be attached in an adequate correct orientation or alignment to the printing apparatus. This arrangement also reduces the possibility of failure caused by application of a high voltage to the circuitry of the printing material cartridge.

24 Claims, 37 Drawing Sheets

(56) References Cited

U.S. PATENT DOCUMENTS

| | | | |
|---|---|---|---|
| 6,502,917 | B1 | 1/2003 | Shinada et al. |
| 6,536,871 | B1 | 3/2003 | Haddick et al. |
| 6,955,422 | B2 | 10/2005 | Miyazawa et al. |
| 6,979,079 | B2 | 12/2005 | Hashii et al. |
| 7,213,914 | B2 | 5/2007 | Anma et al. |
| 7,237,881 | B2 | 7/2007 | Hayasaki et al. |
| 7,278,721 | B2 | 10/2007 | Shimizu et al. |
| 7,562,958 | B2 | 7/2009 | Asauchi |
| 2004/0155945 | A1 | 8/2004 | Kim |
| 2006/0262158 | A1 | 11/2006 | Okamura |
| 2008/0036832 | A1 | 2/2008 | Wanibe |
| 2009/0009680 | A1 | 1/2009 | Zensai |
| 2009/0096850 | A1 | 4/2009 | Sulser |
| 2009/0096851 | A1 | 4/2009 | Sulser |
| 2010/0289847 | A1 | 11/2010 | Ishizawa et al. |

FOREIGN PATENT DOCUMENTS

| | | | |
|---|---|---|---|
| EP | 0997297 | A1 | 5/2000 |
| EP | 1439067 | | 7/2004 |
| EP | 1892104 | A1 | 2/2008 |
| JP | 2003-011390 | A | 1/2003 |
| JP | 2003-145798 | A | 5/2003 |
| JP | 2003-520711 | A | 7/2003 |
| JP | 2005-022345 | A | 1/2005 |
| JP | 2005-144723 | A | 6/2005 |
| JP | 2007-230249 | A | 9/2007 |
| JP | 2009-090668 | A | 4/2009 |
| JP | 2009-107334 | A | 5/2009 |

A-A CROSS SECTION

B-B CROSS SECTION

PRINTING MATERIAL CARTRIDGE AND PRINTING MATERIAL SUPPLY SYSTEM

CROSS-REFERENCE TO RELATED APPLICATIONS

The present application claims the priority based on Japanese Patent Application No. 2010-197320 filed on Sep. 3, 2010, the disclosure of which is hereby incorporated by reference in its entirety.

BACKGROUND

1. Technical Field

The present invention relates to a printing material cartridge and a printing material supply system including the printing material cartridge and a printing apparatus.

2. Related Art

Some recent printing material cartridges have a circuit (circuit element), such as a memory device for storing information about a printing material (for example, remaining amount of ink). See JP-A-2003-011390, JP-A-2007-230249, and JP-A-2005-144723, for example. Upon attachment of the printing material cartridge to a printing apparatus, a plurality of terminals on the printing material cartridge adapted to contact with a plurality of apparatus-side terminals of the printing apparatus. This electrically connects the circuitry of the printing apparatus with the circuitry of the printing material cartridge. It is needed to attach the printing material cartridge in an adequately correct orientation or alignment to the printing apparatus. Especially with recent size reduction of the individual terminals, there is an increased possibility of failed or insufficient connection between the plurality of terminals of the printing material cartridge and those of the printing apparatus, due to inadequate orientation or alignment of the printing material cartridge.

In the course of attachment of the printing material cartridge, there is a possibility that an undesired high voltage is applied to the circuitry on the printing material cartridge. Application of the undesired high voltage to the circuitry on the printing material cartridge may cause a failure in the circuitry on the printing material cartridge.

There is desired a technique for enabling the printing material cartridge to be attached in an adequately correct orientation or alignment and for reducing the possibility of circuitry failure by application of an undesired high voltage to the circuitry of the printing material cartridge.

The problems discussed above are not characteristic of the printing material cartridge, but may be commonly found in various liquid containers or cartridges and various liquid ejection devices, other than the printing material cartridge.

SUMMARY

An object of the invention is to provide a technique that enables a printing material cartridge to be attached in an adequately correct orientation or alignment. It is also desired to provide a technique that reduces the possibility of failure by application of an unexpectedly high voltage to the circuitry of the printing material cartridge.

According to an aspect of the invention, there is provided a printing material cartridge printing material cartridge adapted to be detachably attached to a printing apparatus. The printing apparatus comprises a cartridge attachment section to which a plurality of the printing material cartridges are adapted to be detachably attached. The cartridge attachment section includes, for each of the plurality of printing material cartridges: a terminal block having an inclined surface; apparatus-side terminals including one apparatus-side ground terminal, the apparatus-side terminals arranged on the terminal block, arrayed in a Y direction, and are protruded in a +Z direction from the inclined surface of the terminal block, the one apparatus-side terminals and protruded to a greater height than heights of other plural apparatus-side terminals in the +Z direction from the inclined surface of the terminal block; and a printing material supply pipe. The printing material supply pipe has a central axis C, a base portion and a tip portion, where the base portion is fixed to the cartridge attachment section. Assume here that an axis parallel to the central axis C of the printing material supply pipe is referred to as a Z axis, an axis orthogonal to the Z axis is referred to as an X axis, an axis orthogonal to both the Z axis and the X axis is referred to as a Y axis, a direction towards the base portion from the tip portion of the printing material supply pipe is referred to as −Z direction, a direction towards the tip portion from the base portion of the printing material supply pipe is referred to as the +Z direction, a direction of array of the plurality of printing material cartridges attached to the cartridge attachment section is referred to as the Y direction. The printing material cartridge comprises a circuit board including a plurality of cartridge-side terminals formed on a surface thereof. The plurality of cartridge-side terminals respectively have contact portions that adapted to contact with corresponding ones of the apparatus-side terminals. The printing material cartridge further comprises a printing material supply port including an opening face parallel to the X direction and the Y direction on a −Z-direction end of the printing material cartridge. The printing material supply port is adapted to be connected with the printing material supply pipe to supply the printing material stored in the container body through the printing material supply pipe to the printing apparatus. The printing material cartridge further comprises a board mount portion on which the circuit board is fixed such that a surface of the circuit board is facing a plane extended from the opening face of the printing material supply port, and that the surface of the circuit board is inclined at an acute angle relative to the plane extended from the opening face of the printing material supply port. Among the plurality of cartridge-side terminals provided on the surface of the circuit board, one cartridge-side terminal has one contact portion adapted to contact with the one apparatus-side ground terminal, and other plural cartridge-side terminals have other contact portions that respectively adapted to contact with the other plural apparatus-side terminals. The one cartridge-side terminal is located at a position intersecting with a CA plane, which is defined by the central axis C and an axis A that goes through the central axis C and is parallel to the X axis. The circuit board is positioned such that the one cartridge-side terminal adapted to contact with the one apparatus-side ground terminal before the other plural cartridge-side terminals adapted to contact with the corresponding other plural apparatus-side terminals in process of attachment of the printing material cartridge to the cartridge attachment section. With this printing material cartridge, since the one cartridge-side terminal that first comes into contact with the corresponding apparatus-side ground terminal, among the plurality of cartridge-side terminals on the circuit board, is located on the CA plane, the force applied from the apparatus-side ground terminal to the printing material cartridge is present on the CA plane. Since the central axis C of the printing material supply pipe is located on the CA plane, the force applied from the printing material supply pipe to the printing material cartridge is also present on the CA plane. Both the forces applied from the apparatus-side ground terminal and the printing material supply pipe to the printing material cartridge in the process of attachment of the printing material cartridge to the cartridge attachment section are thus present on the CA plane, so that little force is applied to the printing material cartridge to tilt the printing material cartridge in the Y direction (width direction). This enables the printing material cartridge to be attached to the printing apparatus in the adequate, correct orientation or alignment. It should be also noted that the one cartridge-side terminal among the plurality of cartridge-side terminals comes into contact with the apparatus-side ground terminal, prior to the other cartridge-side terminals on the circuit board. Accordingly, even when an undesired high voltage is to be applied to the circuitry of the printing material cartridge, the grounding function of the ground terminal immediately lowers the voltage level. This arrangement effectively reduces the possibility of failure in the circuitry of the printing material cartridge by application of an undesired high voltage from outside of the printing material cartridge.

The circuit board may be positioned such that side faces of the circuit board are guided between a pair of board guide members that are provided on respective sides of the apparatus-side terminals on the cartridge attachment section, in the process of attachment of the printing material cartridge to the cartridge attachment section. Since the respective side faces of the circuit board are guided by the pair of board guide members, this arrangement enables the printing material cartridge to be attached to the printing apparatus, while maintaining the printing material cartridge in the more adequate, correct orientation or alignment.

The circuit board may be positioned such that the one cartridge-side terminal comes into contact with the apparatus-side ground terminal prior to or substantially simultaneously with contact of the side faces of the circuit board with the pair of board guide members, in the process of attachment of the printing material cartridge to the cartridge attachment section. Since the respective side faces of the circuit board are guided by the pair of board guide members, this arrangement restricts the motion or shift of the printing material cartridge in the Y direction and maintains the printing material cartridge in the adequate correct orientation or alignment.

The one cartridge-side terminal may have a longer dimension in an attachment direction of the printing material cartridge than those of the other plural cartridge-side terminals. This structure ensures the contact of the one cartridge-side terminal with the corresponding apparatus-side ground terminal.

The printing material cartridge may include: a first face having the printing material supply port; a second face opposed to the first face; a third face intersecting with the first face and the second face; and an overhang section provided at a position where the first face meets the third face. The overhang section may include a stepped portion continuous with the first face. The board mount portion may be located at a position advancing in the +Z direction from the stepped portion of the overhang section. Since the board mount portion is located at the position advancing in the +Z direction from the stepped portion, this arrangement effectively reduces the possibility that the cartridge-side terminals on the circuit board are damaged by any external obstacle (for example, a clip or another stationery article).

The printing material cartridge may further comprise: a first face having the printing material supply port; a second face opposed to the first face; and a third face intersecting with the first face and the second face. The third face may have a first cartridge-side engagement element that engages with a first apparatus-side engagement element of the cartridge attachment section in the process of attachment of the printing material cartridge to the cartridge attachment section. The printing material cartridge may further comprise a fourth face intersecting with the first face and the second face and opposed to the third face. The fourth face may have a second cartridge-side engagement element that engages with a second apparatus-side engagement element of the cartridge attachment section in the process of attachment of the printing material cartridge to the cartridge attachment section. The printing material cartridge may further comprise: a fifth face intersecting with the first face, the second face and the third face; and a sixth face intersecting with the first face, the second face and the third face and opposed to the fifth face. The printing material supply port may have an opening protruded from the first face. The opening face of the printing material supply port may be defined by edge of the opening. With this structure, the printing material cartridge of approximate rectangular shape is adequately attached to the cartridge attachment section by the first and second cartridge-side engagement elements.

In the above cartridge, the one contact portion adapted to contact with the one apparatus-side ground terminal may be located on center of width in the Y direction of the printing material cartridge. Since the force applied from the apparatus-side ground terminal to the one cartridge-side terminal on the circuit board acts on the center of width in the Y direction of the printing material cartridge, little force is applied to the printing material cartridge to tilt the printing material cartridge in the Y direction. This enables the printing material cartridge to be attached to the printing apparatus in the adequate, correct orientation or alignment.

The circuit board may be arranged such that the surface of the circuit board is inclined at an angle of 25 to 40 degrees relative to the opening face of the printing material supply port. if the surface of the circuit board is inclined at the angle of not less than 25 degrees relative to the opening face of the printing material supply port, it ensures a sufficient amount of wiping of the cartridge-side terminal on the circuit board by the corresponding apparatus-side terminal in the process of attachment of the printing material cartridge. Also if the surface of the circuit board is inclined at the angle of not greater than 40 degrees relative to the opening face of the printing material supply port, it enables a sufficient force in the +Z direction for moving the printing material cartridge in the +Z direction to be applied from the apparatus-side ground terminal to the circuit board.

Among the plurality of contact portions of the plurality of cartridge-side terminals, the one contact portion for grounding, a pair of first contact portions of the other contact portions for high voltage application and a pair of second contact portions of the other contact portions for first low voltage application may be aligned in the Y direction. The pair of first contact portions may be located at outermost positions. The pair of second contact portions may be located between the pair of first contact portions. The one contact portion may be located between the pair of second contact portions. This arrangement has the advantages described below.

Advantage A-1:

The contact portion for low voltage application is located between the contact portion for high voltage application and the contact portion for grounding. Even when dust or ink adheres over a high voltage terminal and a low voltage terminal to apply a high voltage to the low voltage terminal, the contact portion for grounding comes into contact with the apparatus-side ground terminal, prior to the other contact portions of the other plural cartridge-side terminals. This arrangement reduces the possibility of application of an undesired high voltage to the low voltage terminal and thereby protects the circuitry connected with the low voltage terminal from being damaged. This circuitry is not restricted to the circuit formed on the circuit board of the printing material cartridge but includes the circuit formed on a location other than the circuit board, for example, the circuit formed in the printing apparatus.

Advantage A-2

In the structure that a low voltage terminal and a ground terminal are connected with a memory device, the above arrangement protects the memory device from being damaged, regardless of application or non-application of an undesired high voltage to these terminals. In other words, this arrangement reduces the possibility of damage of the memory device by electrostatic discharge, as well as the possibility of damage of the memory device by application of an undesired high voltage to the memory device as stated in the Advantage A-1.

Adhesion of dust or ink may cause a short circuit between the high voltage terminal and the low voltage terminal and lead to apply an undesired high voltage to the low voltage terminal. Apparently there may seem to be no need to give consideration to the positional relation of the contact portions, as long as the positional relation of the terminals on the circuit board is adequately determined. In the actual state, however, small clearances are present between the contact portions on the circuit board and the terminals on the printing apparatus and their peripheries and tend to suck the ink by capillarity. When the contact portions on the circuit board adapted to contact with the terminals on the printing apparatus, the friction-induced static electricity tends to suck the dust. It is thus important to give consideration to the positional relation of the contact portions on the circuit board. As long as sufficient consideration is given to the positional relation of the contact portions on the circuit board, there is a certain degree of freedom in designing the shapes of the terminals including the contact portions. This increases the degree of freedom in designing the shapes of the terminals.

The plurality of contact portions of the plurality of cartridge-side terminals may be arrayed in two rows in the Y direction. The one contact portion, the pair of first contact portions and the pair of second contact portions may be included in a first row on a −Z-direction side of the two rows. A pair of third contact portions of the other contact portions for overvoltage detection and at least one contact portion of remaining of the other contact portions for second low voltage application may be included in a second row on a +Z-direction side of the two rows. In the second row, the pair of third contact portions may be located at outermost positions, and the at least one contact portion may be located between the pair of third contact portions. The third contact portion may be located in the Y direction between the first contact portion and the second contact portion adjacent to the first contact portion. The "first row on the −Z-direction side" means a row at the position advancing in the −Z direction out of the two rows. The "second row on the +Z-direction side" means a row at the position advancing in the +Z direction out of the two rows. Since the circuit board has inclined orientation, these two rows also have different positions in the X direction but are here defined by only the positional relation with regard to the Z direction. This arrangement has the advantages described below.

Advantage B-1

According to the positional relation in the Y direction, the contact portions for overvoltage detection are located between the contact portions for high voltage application, and the contact portions for low voltage application are located between the contact portions for overvoltage detection. Even when dust or ink adheres over a high voltage terminal, to which high voltage is applied, and a low voltage terminal to apply a high voltage to the low voltage terminal, a terminal for overvoltage detection interposed between the high voltage terminal and the low voltage terminal detects the state of overvoltage application and stops the application of high voltage. This arrangement reduces the possibility that an undesired high voltage is applied to the low voltage terminal, thus protecting the circuitry connected with the low voltage terminal from being damaged or destroyed. In the case where the low voltage terminal is connected with a memory device, this arrangement protects the memory device from being damaged.

Advantage B-2

Dust or ink may adhere to the circuit board in various directions and over various areas. In the above arrangement, when dust or ink adheres across the high voltage terminal and the low voltage terminal, there is a high probability that the adhesion area of dust or ink includes the terminal for overvoltage detection. The Advantage B-1 discussed above may thus be expected with significantly high probability.

Advantage B-3

In the case where dust adheres to a substantially straight area in the Y direction that does not include the terminal for overvoltage detection, the Advantages B-1 and B-2 discussed above may not be expected. For example, a long thin metal strip like a staple may adhere across the high voltage terminal and the low voltage terminal (i.e., the terminal including the contact portion for first low voltage application) but not across the terminal for overvoltage detection. There is, however, a high probability that the adhesion area of such long, thin dust includes the ground terminal. As discussed above in the Advantages A-1 and A-2, as long as the adhesion area of dust covers the ground terminal, the arrangement of causing the ground terminal to come into contact with the apparatus-side ground terminal prior to the other contact portions of the other plural cartridge-side terminals effectively lowers the possibility that an undesired high voltage is applied to the low voltage terminal.

Summary of Advantages B-1 Through B3

As discussed above, even when dust or ink adheres to the circuit board in any state, the arrangement may prevent the circuitry from being damaged, or prevent the memory device from being damaged when the low voltage terminal is connected with the memory device, by application of an undesired high voltage, with significantly high probability.

According to another aspect of the invention, there is provided a printing material supply system. The printing material supply system comprises a plurality of the printing material cartridges, and a printing apparatus having a cartridge attachment section. The printing apparatus comprises a cartridge attachment section to which the plurality of the printing material cartridges are detachably attached. The cartridge attachment section includes, for each of the plurality of printing material cartridges: a terminal block having an inclined surface; apparatus-side terminals including one apparatus-side ground terminal, the apparatus-side terminals arranged on the terminal block, arrayed in a Y direction, and protruded in a +Z direction from the inclined surface of the terminal block, the one apparatus-side ground terminal located on center in the Y direction among the apparatus-side terminals is protruded to a greater height than heights of other plural apparatus-side terminals in the +Z direction from the inclined surface of the terminal block; and a printing material supply pipe. The printing material supply pipe has a central axis C, a base portion and a tip portion, where the base portion is fixed to the cartridge attachment section. Assume here that an axis parallel to the central axis C of the printing material supply pipe is referred to as a Z axis, an axis orthogonal to the Z axis is referred to as an X axis, an axis orthogonal to both the Z axis and the X axis is referred to as a Y axis, a direction towards the base portion from the tip portion of the printing material supply pipe is referred to as −Z direction, a direction towards the tip portion from the base portion of the printing material supply pipe is referred to as the +Z direction, a direction of array of the plurality of printing material cartridges attached to the cartridge attachment section is referred to as the Y direction. This system has advantages similar to the above described advantages of the printing material cartridge.

The printing material cartridge may further include: a first end face and a second end face opposed to each other in the X direction; a first cartridge-side engagement element provided on the first end face, the first cartridge-side engagement element engaging with a first apparatus-side engagement element of the cartridge attachment section; and a second cartridge-side engagement element provided on the second end face, the second cartridge-side engagement element engaging with a second apparatus-side engagement element of the cartridge attachment section. The apparatus-side ground terminal may be has a predetermined pressing force and the circuit board may be fixed on the board mount portion at a predetermined surface angle, such that the first end face is moved back in the +Z direction only by the apparatus-side ground terminal among the plurality of apparatus-side terminals presses the circuit board in the +Z direction, when a user releases hand from the printing material cartridge in a state of half engagement in the process of attachment of the printing material cartridge, wherein the state of half engagement is a state wherein the second cartridge-side engagement element is in complete engagement with the second apparatus-side engagement element but the first cartridge-side engagement element is just before complete engagement with the first apparatus-side engagement element to restrict motion of the printing material cartridge in a vertical direction. Even when the user has some inadequate operation, this arrangement effectively prevents the printing material cartridge from being kept in the state of half engagement.

According to still another aspect of the invention, there is provided a printing material supply system. The printing material supply system comprises: a plurality of printing material cartridges, and a printing apparatus having a cartridge attachment section to which the plurality of a printing material cartridges are attached. The cartridge attachment section includes, for each of the plurality of printing material cartridges: a terminal block having an inclined surface; apparatus-side terminals including one apparatus-side ground terminal, the apparatus-side terminals arranged on the terminal block, arrayed in a Y direction, and protruded in a +Z direction from the inclined surface of the terminal block, the one apparatus-side ground terminal located on center in the Y direction among the apparatus-side terminals and protruded to a greater height than heights of other plural apparatus-side terminals in the +Z direction from the inclined surface of the terminal block; and a printing material supply pipe. The printing material supply pipe has a central axis C, a base portion and a tip portion, where the base portion is fixed to the cartridge attachment section. Assume here that an axis parallel to the central axis C of the printing material supply pipe is referred to as a Z axis, an axis orthogonal to the Z axis is referred to as an X axis, an axis orthogonal to both the Z axis and the X axis is referred to as a Y axis, a direction towards the base portion from the tip portion of the printing material supply pipe is referred to as −Z direction, a direction towards the tip portion from the base portion of the printing material supply pipe is referred to as the +Z direction, a direction of array of the plurality of printing material cartridges attached to the cartridge attachment section is referred to as the Y direction. Each of the printing material cartridges comprises a circuit board including a plurality of cartridge-side terminals formed on a surface thereof. The plurality of cartridge-side terminals respectively have contact portions adapted to contact with corresponding ones of the apparatus-side terminals. The printing material cartridge further comprises a printing material supply port including an opening face parallel to the X direction and the Y direction on a −Z-direction end of the printing material cartridge. The printing material supply port is connected with the printing material supply pipe. The printing material cartridge further comprises a board mount portion on which the circuit board is fixed such that a surface of the circuit board is facing a plane extended from the opening face of the printing material supply port, and that the surface of the circuit board is inclined at an acute angle relative to the plane extended from the opening face of the printing material supply port. Among the plurality of cartridge-side terminals provided on the surface of the circuit board, one cartridge-side terminal has one contact portion that comes into contact with the one apparatus-side ground terminal, and other plural cartridge-side terminals have other contact portions that respectively come into contact with the other plural apparatus-side terminals. The one cartridge-side terminal is located at a position intersecting with a CA plane, which is defined by the central axis C and an axis A that goes through the central axis C and is parallel to the X axis. The circuit board is positioned such that the one cartridge-side terminal comes into contact with the one apparatus-side ground terminal before the other plural cartridge-side terminals come into contact with the corresponding other plural apparatus-side terminals in process of attachment of the printing material cartridge to the cartridge attachment section. The cartridge attachment section may further have a pair of board guide members provided on respective sides of the apparatus-side terminals, and a pair of longitudinal guide members. The circuit board may have a pair of longitudinal guide wall members provided corresponding to the pair of longitudinal guide members of the cartridge attachment section. The pair of longitudinal guide wall members may be located at positions advancing in the Z direction from the one cartridge-side terminal on respective side faces of the circuit board. The circuit board may be arranged such that the respective side faces of the circuit board are guided between the pair of board guide members in the process of attachment of the printing material cartridge to the cartridge attachment section, and such that the one cartridge-side terminal comes into contact with the apparatus-side ground terminal prior to or substantially simultaneously with contact of the respective side faces of the circuit board with the pair of board guide members in the process of attachment of the printing material cartridge to the cartridge attachment section. The printing material cartridge may be attached to the cartridge attachment section by a sequence of steps of (a) the printing material cartridge is being inserted to move in the −Z direction while peripheries of −Z-direction ends of the pair of longitudinal guide wall members are in contact with +Z-direction ends of the pair of longitudinal guide members; (b) the one cartridge-side terminal comes in contact with the apparatus-side ground terminal after the pair of longitudinal guide wall members start moving in the −Z direction while being in contact with the pair of longitudinal guide members, and before the respective side faces of the circuit board come into contact with the pair of board guide members; and (c) the printing material cartridge is moving in the −Z direction to be inserted, while the respective side faces of the circuit board are in contact with the pair of board guide members. As discussed above with regard to the first aspect of the invention, in the printing material supply system according to the third aspect of the invention, both the forces applied from the apparatus-side ground terminal and the printing material supply pipe to the printing material cartridge in the process of attachment of the printing material cartridge to the cartridge attachment section are present on the CA plane, so that little force is applied to the printing material cartridge to tilt the printing material cartridge in the Y direction (width direction). This enables the printing material cartridge to be attached to the printing apparatus in the adequate, correct orientation or alignment. Since the one cartridge-side terminal among the plurality of cartridge-side terminals comes into contact with the apparatus-side ground terminal, prior to the other cartridge-side terminals on the circuit board, even when an external high voltage is applied to the circuitry of the printing material cartridge, the grounding function of the ground terminal immediately lowers the voltage level. This arrangement effectively reduces the possibility of failure in the circuitry of the printing material cartridge by application of a high voltage from outside of the printing material cartridge. As discussed before, if the respective side faces of the circuit board are guided by the pair of board guide members, it enables the printing material cartridge to be attached to the printing apparatus, while maintaining the printing material cartridge in the more adequate, correct orientation or alignment. As discussed before, if the respective side faces of the circuit board are guided by the pair of board guide members, it restricts the motion or shift of the printing material cartridge in the Y direction and maintains the printing material cartridge in the adequate correct orientation or alignment. In the printing material supply system according to the third aspect of the invention, the attachment of the printing material cartridge is implemented via the step (a) where the printing material cartridge move in the −Z direction to be inserted, while the peripheries of the −Z-direction ends of the pair of longitudinal guide wall members are in contact with the +Z-direction ends of the pair of longitudinal guide members. The insertion of the printing material cartridge accordingly follows the path where the cartridge-side terminals on the circuit board adequately come into contact with the corresponding apparatus-side terminals. The steps (b) and (c) further enable the printing material cartridge to be kept in the adequate correct orientation or alignment, while restricting the motion or shift of the printing material cartridge in the Y direction.

The cartridge attachment section may further have a pair of lateral guide members. The board mount portion may have a pair of lateral guide wall members provided corresponding to the pair of lateral guide members, where the pair of lateral guide wall members are located at positions advancing in the +Z direction from the one cartridge-side terminal on the respective side faces of the circuit board. The printing material cartridge may be configured such that outer surfaces of the pair of lateral guide wall members are guided by inner surfaces of the pair of lateral guide members prior to the step (a) in the process of attachment of the printing material cartridge to the cartridge attachment section. Since the inner surfaces of the pair of lateral guide members guide the outer surfaces of the pair of lateral guide wall members, this arrangement effectively prevents the printing material cartridge from being significantly moved or shifted in the Y direction and enables the printing material cartridge to be attached to the cartridge attachment section with keeping the adequate correct orientation or alignment in the subsequent attachment process.

The board mount portion may have cutouts located between the pair of longitudinal guide wall members and the pair of lateral guide wall members to make the respective side faces of the circuit board exposed, and the pair of board guide members of the cartridge attachment section may come into contact with exposed side faces of the circuit board exposed by the cutouts. Since the pair of board guide members guide the circuit board, while being in contact with the exposed side faces of the circuit board by the cutouts, this arrangement enables especially part of the printing material cartridge proximate to the circuit board to be kept in the adequate correct orientation or alignment.

The printing material cartridge may include: a first face having the printing material supply port; a second face opposed to the first face; a third face intersecting with the first face and the second face; and an overhang section provided at a position where the first face meets the third face. The overhang section may include a stepped portion continuous with the first face. The board mount portion may be located at a position advancing in the +Z direction from the stepped portion of the overhang section. Since the board mount portion is located at the position advancing in the +Z direction from the stepped portion, this arrangement effectively reduces the possibility that the cartridge-side terminals on the circuit board are damaged by any external obstacle (for example, a clip or another stationery article).

The printing material cartridge may have a fitting element at a position of intersection between the stepped portion and the first face. The cartridge attachment section may have an apparatus-side fitting element corresponding to the fitting element of the printing material cartridge. In the process of attachment of the printing material cartridge to the cartridge attachment section, the printing material cartridge may be guided at least by start of fitting of the fitting element with the apparatus-side fitting element in the step (c). Fitting of the fitting element of the printing material cartridge with the apparatus-side fitting element enables the printing material cartridge to be attached at the right attachment position in the adequate correct orientation or alignment.

The printing material cartridge may further include: a first face having the printing material supply port; a second face opposed to the first face; and a third face intersecting with the first face and the second face, wherein the third face has a first cartridge-side engagement element that engages with a first apparatus-side engagement element of the cartridge attachment section in the process of attachment of the printing material cartridge to the cartridge attachment section. The printing material cartridge may further include: a fourth face intersecting with the first face and the second face and opposed to the third face, wherein the fourth face has a second cartridge-side engagement element that engages with a second apparatus-side engagement element of the cartridge attachment section in the process of attachment of the printing material cartridge to the cartridge attachment section; a fifth face intersecting with the first face, the second face and the third face; and a sixth face intersecting with the first face, the second face and the third face and opposed to the fifth face. The printing material supply port may have an opening protruded from the first face. The opening face of the printing material supply port may be defined by edge of the opening. With this arrangement, the printing material cartridge of approximate rectangular shape is adequately attached to the cartridge attachment section by the first and second cartridge-side engagement elements.

In the above printing material supply system, the one contact portion that comes in contact with the one apparatus-side ground terminal may be located on center of width in the Y direction of the printing material cartridge. Since the force applied from the apparatus-side ground terminal to the one cartridge-side terminal on the circuit board acts on the center of width in the Y direction of the printing material cartridge, little force is applied to the printing material cartridge to tilt the printing material cartridge in the Y direction. This enables the printing material cartridge to be attached to the printing apparatus in the adequate, correct orientation or alignment.

The circuit board may be arranged such that the surface of the circuit board is inclined at an angle of 25 to 40 degrees relative to the opening face of the printing material supply port. If the surface of the circuit board is inclined at the angle of not less than 25 degrees relative to the opening face of the printing material supply port, it ensures a sufficient amount of wiping of the cartridge-side terminal on the circuit board by the corresponding apparatus-side terminal in the process of attachment of the printing material cartridge. Also if the surface of the circuit board is inclined at the angle of not greater than 40 degrees relative to the opening face of the printing material supply port, it enables a sufficient force in the +Z direction for moving the printing material cartridge in the +Z direction to be applied from the apparatus-side ground terminal to the circuit board.

In the above printing material supply system, the one contact portion for grounding, a pair of first contact portions of the other contact portions for high voltage application and a pair of second contact portions of the other contact portions for first low voltage application may be aligned in the Y direction. The pair of first contact portions may be located at outermost positions. The pair of second contact portions may be located between the pair of first contact portions. The one contact portion may be located between the pair of second contact portions. This arrangement has the advantages described below.

Advantage A-1:

The contact portion for low voltage application is located between the contact portion for high voltage application and the contact portion for grounding. Even when dust or ink adheres over a high voltage terminal and a low voltage terminal to apply a high voltage to the low voltage terminal, the contact portion for grounding comes into contact with the apparatus-side ground terminal, prior to the other contact portions of the other plural cartridge-side terminals. This arrangement reduces the possibility of application of an undesired high voltage to the low voltage terminal and thereby protects the circuitry connected with the low voltage terminal from being damaged. This circuitry is not restricted to the circuit formed on the circuit board of the printing material cartridge but includes the circuit formed on a location other than the circuit board, for example, the circuit formed in the printing apparatus.

Advantage A-2

In the structure that a low voltage terminal and a ground terminal are connected with a memory device, the above arrangement protects the memory device from being damaged, regardless of application or non-application of an undesired high voltage to these terminals. In other words, this arrangement reduces the possibility of damage of the memory device by electrostatic discharge, as well as the possibility of damage of the memory device by application of an undesired high voltage to the memory device as stated in the Advantage A-1.

Adhesion of dust or ink may cause a short circuit between the high voltage terminal and the low voltage terminal and lead to apply an undesired high voltage to the low voltage terminal. Apparently there may seem to be no need to give consideration to the positional relation of the contact portions, as long as the positional relation of the terminals is adequately determined. In the actual state, however, small clearances are present between the contact portions and the terminals on the printing apparatus and their peripheries and tend to suck the ink by capillarity. When the contact portions come into contact with the terminals on the printing apparatus, the friction-induced static electricity tends to suck the dust. It is thus important to give consideration to the positional relation of the contact portions. As long as sufficient consideration is given to the positional relation of the contact portions, there is a certain degree of freedom in designing the shapes of the terminals including the contact portions. This increases the degree of freedom in designing the shapes of the terminals.

In the printing material system, the plurality of contact portions of the plurality of cartridge-side terminals may be arrayed in two rows in the Y direction. The one contact portion, the pair of first contact portions and the pair of second contact portions may be included in a first row on a −Z-direction side of the two rows. A pair of third contact portions of the other contact portions for overvoltage detection and at least one contact portion of remaining of the other contact portions for second low voltage application may be included in a second row on a +Z-direction side of the two rows. In the second row, the pair of third contact portions may be located at outermost positions, and the at least one contact portion may be located between the pair of third contact portions. The third contact portion may be located in the Y direction between the first contact portion and the second contact portion adjacent to the first contact portion. The "first row on the −Z-direction side" means a row at the position advancing in the −Z direction out of the two rows. The "second row on the +Z-direction side" means a row at the position advancing in the +Z direction out of the two rows. Since the circuit board has inclined orientation, these two rows also have different positions in the X direction but are here defined by only the positional relation with regard to the Z direction. This arrangement has the advantages described below.

Advantage B-1

According to the positional relation in the Y direction, the contact portions for overvoltage detection are located between the contact portions for high voltage application, and the contact portions for low voltage application are located between the contact portions for overvoltage detection. Even when dust or ink adheres over a high voltage terminal, to which high voltage is applied, and a low voltage terminal to apply a high voltage to the low voltage terminal, a terminal for overvoltage detection interposed between the high voltage terminal and the low voltage terminal detects the state of overvoltage application and stops the application of high voltage. This arrangement reduces the possibility that an undesired high voltage is applied to the low voltage terminal, thus protecting the circuitry connected with the low voltage terminal from being damaged or destroyed. In the case where the low voltage terminal is connected with a memory device, this arrangement protects the memory device from being damaged.

Advantage B-2

Dust or ink may adhere to the circuit board in various directions and over various areas. In the above arrangement, when dust or ink adheres across the high voltage terminal and the low voltage terminal, there is a high probability that the adhesion area of dust or ink includes the terminal for overvoltage detection. The Advantage B-1 discussed above may thus be expected with significantly high probability.

Advantage B-3

In the case where dust adheres to a substantially straight area in the Y direction that does not include the terminal for overvoltage detection, the Advantages B-1 and B-2 discussed above may not be expected. For example, a long thin metal strip like a staple may adhere across the high voltage terminal and the low voltage terminal (i.e., the terminal including the contact portion for first low voltage application) but not across the terminal for overvoltage detection. There is, however, a high probability that the adhesion area of such long, thin dust includes the ground terminal. As discussed above in the Advantages A-1 and A-2, as long as the adhesion area of dust covers the ground terminal, the arrangement of causing the ground terminal to come into contact with the apparatus-side ground terminal prior to the other contact portions of the other plural cartridge-side terminals effectively lowers the possibility that an undesired high voltage is applied to the low voltage terminal.

Summary of Advantages B-1 Through B3

As discussed above, even when dust or ink adheres to the circuit board in any state, the arrangement may prevent the circuitry from being damaged, or prevent the memory device from being damaged when the low voltage terminal is connected with the memory device, by application of an undesired high voltage, with significantly high probability.

In the printing material supply system, the printing material cartridge may further include: a first cartridge-side engagement element provided on a first end face to engage with a first apparatus-side engagement element of the cartridge attachment section; and a second cartridge-side engagement element provided on a second end face opposed to the first end face to engage with a second apparatus-side engagement element of the cartridge attachment section. The apparatus-side ground terminal may be has a predetermined pressing force and the circuit board may be fixed on the board mount portion at a predetermined surface angle, such that the first end face is moved back in the +Z direction only by the apparatus-side ground terminal among the plurality of apparatus-side terminals presses the circuit board in the +Z direction, when a user releases hand from the printing material cartridge in a state of half engagement in the process of attachment of the printing material cartridge, wherein the state of half engagement is a state wherein the second cartridge-side engagement element is in complete engagement with the second apparatus-side engagement element but the first cartridge-side engagement element is just before complete engagement with the first apparatus-side engagement element to restrict motion of the printing material cartridge in a vertical direction. Even when the user has some inadequate operation, this arrangement effectively prevents the printing material cartridge from being kept in the state of half engagement.

The invention may be implemented as various embodiments, for example, as a liquid cartridge, a liquid container, a printing material cartridge, a printing material container, a cartridge adapter, a circuit board, a printing apparatus, a liquid ejection device, a printing material supply system including a printing apparatus and a printing material cartridge and a liquid supply system including a liquid ejection device and a liquid cartridge.

BRIEF DESCRIPTION OF THE DRAWINGS

FIGS. 20A-1, 20A-2, 20B-1, and 20B-2 show guiding operations of the cartridge in the course of attachment;

FIGS. 21A-1, 21A-2, 21B-1, and 21B-2 show guiding operations of the cartridge in the course of attachment;

DESCRIPTION OF EXEMPLARY EMBODIMENTS

A. First Embodiment

Figure 1:
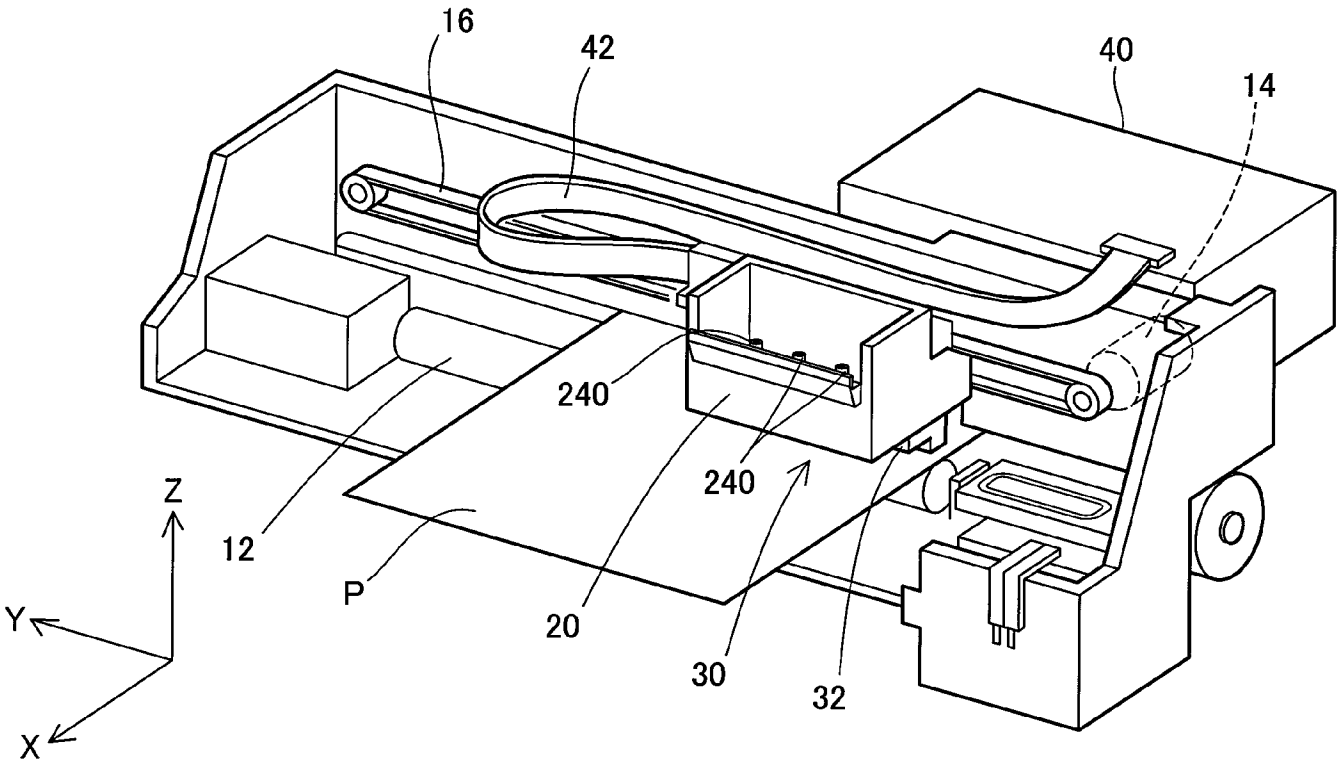
FIG. 1 is a perspective view of a printing apparatus according to a first embodiment of the invention.

FIG. 1 is a perspective view showing the structure of a printing apparatus according to a first embodiment of the invention. FIG. 1 includes indication of XYZ axes that are orthogonal to one another. The XYZ axes in FIG. 1 correspond to the XYZ axes in the other drawings. Some of the subsequent drawings also include similar indication of the XYZ axes. In this embodiment, when the printing apparatus is in a position in use, the Z-axis direction is the vertical direction, and a face in the X-axis direction of the printing apparatus forms the front face. This printing apparatus is a small-sized inkjet printer for personal use and has a sub-scan feed mechanism, a main scan feed mechanism, and a head drive mechanism. The sub-scan feed mechanism includes a paper feed roller 12, which is driven by a paper feed motor (not shown), to feed a sheet of printing paper P in a sub-scanning direction. The main scan feed mechanism includes a carriage motor 14 to move back and forth a carriage 30, which is connected with a drive belt 1, in a main scanning direction. The main scanning direction of the printing apparatus is the Y-axis direction, and the sub-scanning direction is the X-axis direction. The head drive mechanism drives a print head 32 provided on the carriage 30 to perform ink ejection and dot formation. The printing apparatus further includes a controller 40 for controlling the operations of the respective mechanisms explained above. The controller 30 is connected with the carriage 30 by means of a flexible cable 42.

The carriage 30 includes a holder 20 and the print head 32. The holder 20 is designed to accommodate a plurality of cartridges and is located above the print head 32. The cartridges attached to the holder 20 are aligned in the Y direction. The holder 20 may be also called "cartridge attachment section". In the illustrated example of FIG. 1, four cartridges, for example, four different color cartridges of black, yellow, magenta and cyan, may be independently attachable to the holder 20. The attachment direction of the cartridges is the −Z direction (a vertically downward direction in this embodiment). The holder 20 may be designed to accommodate a plurality of any other different cartridges. The holder 20 has no cover. Ink supply pipes 240 are provided on the print head 32 to supply inks from the respective cartridges to the print head 32. Like this printing apparatus, the type of the printing apparatus having the cartridges replaceable by the user attached to the cartridge attachment section (a holder) on the carriage of the print head is called an "on-carriage type" printing apparatus.

In this embodiment and a second embodiment discussed later, the Z axis is set in the vertical direction. But this is not restrictive. Alternatively the Z axis (i.e., central axis C of the printing material supply pipe 240) may be set in the horizontal direction orthogonal to the vertical direction.

Figure 2:
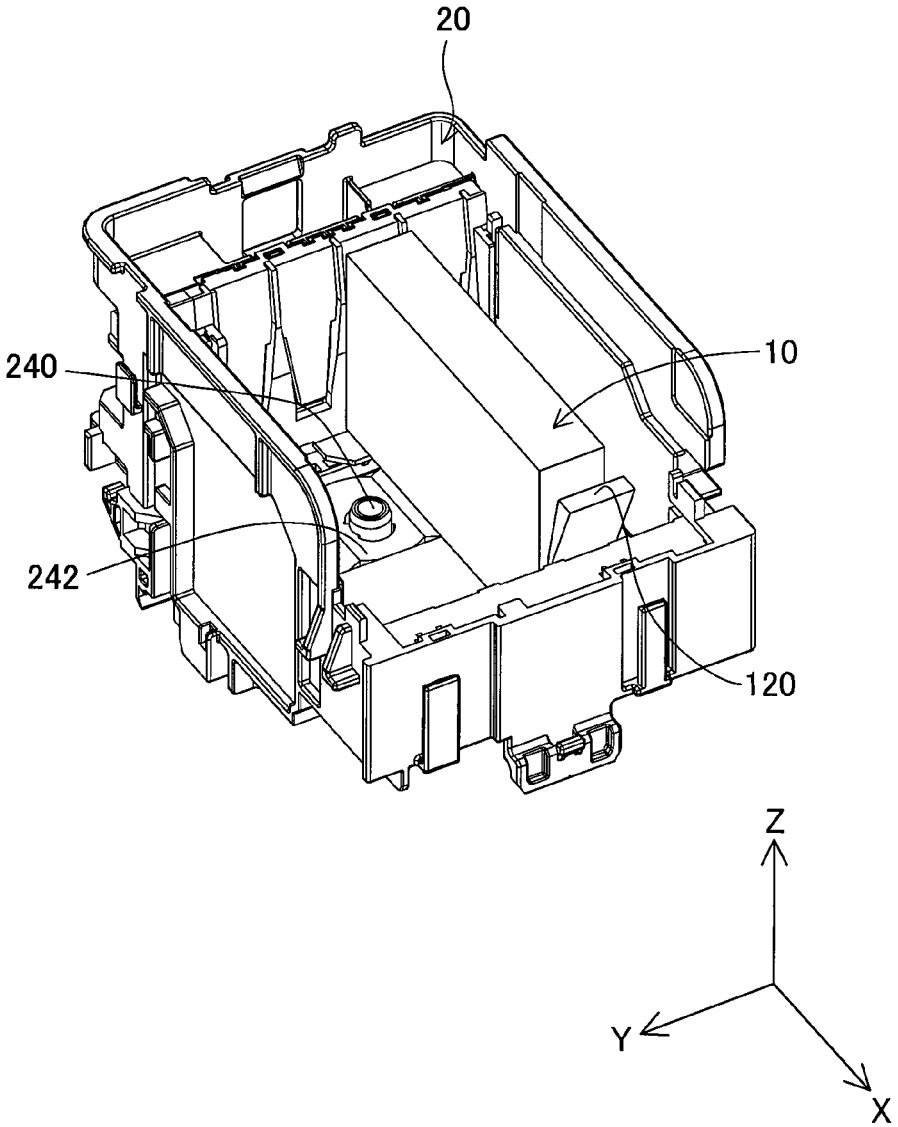
FIG. 2 is a perspective view of a holder according to the first embodiment.

FIG. 2 is a perspective view showing the appearance of the holder 20 with a cartridge 10 attached thereto. For the simplicity of explanation, only one cartridge 10 is attached to the holder 20 in FIG. 2.

The holder 20 has four slots, each being designed to enable attachment of one cartridge 10. Each slot of the holder 20 has an ink supply pipe 240. The structure of the holder 20 will be described in more details below with reference to FIGS. 8A-8D and 9. As shown in FIG. 9, a central axis C of the ink supply pipe 240 is parallel to the Z axis. The ink supply pipe 240 has a base portion 240*b* and a tip portion 240*h*. The base portion 240*b* is fixed to the holder 20. The base portion 240*b* of the ink supply pipe 240 is in the −Z direction, and the tip portion 240*h* is in the +Z direction. Referring back to FIG. 2, the ink runs from the cartridge 10 through the ink supply pipe 240 to be supplied to the print head 32. An elastic seal member 242 is placed around the ink supply pipe 240 to seal an ink supply port of the cartridge 10 and thereby prevent leakage of ink. The cartridge 10 has a lever 120 (a lever member) of an elastically-deformable elastic material. The user operates the lever 120 to detach the cartridge 10 from the holder 20. The operations of attaching and detaching the cartridge 10 to and from the holder 20 will be discussed in detail below.

Figure 3:
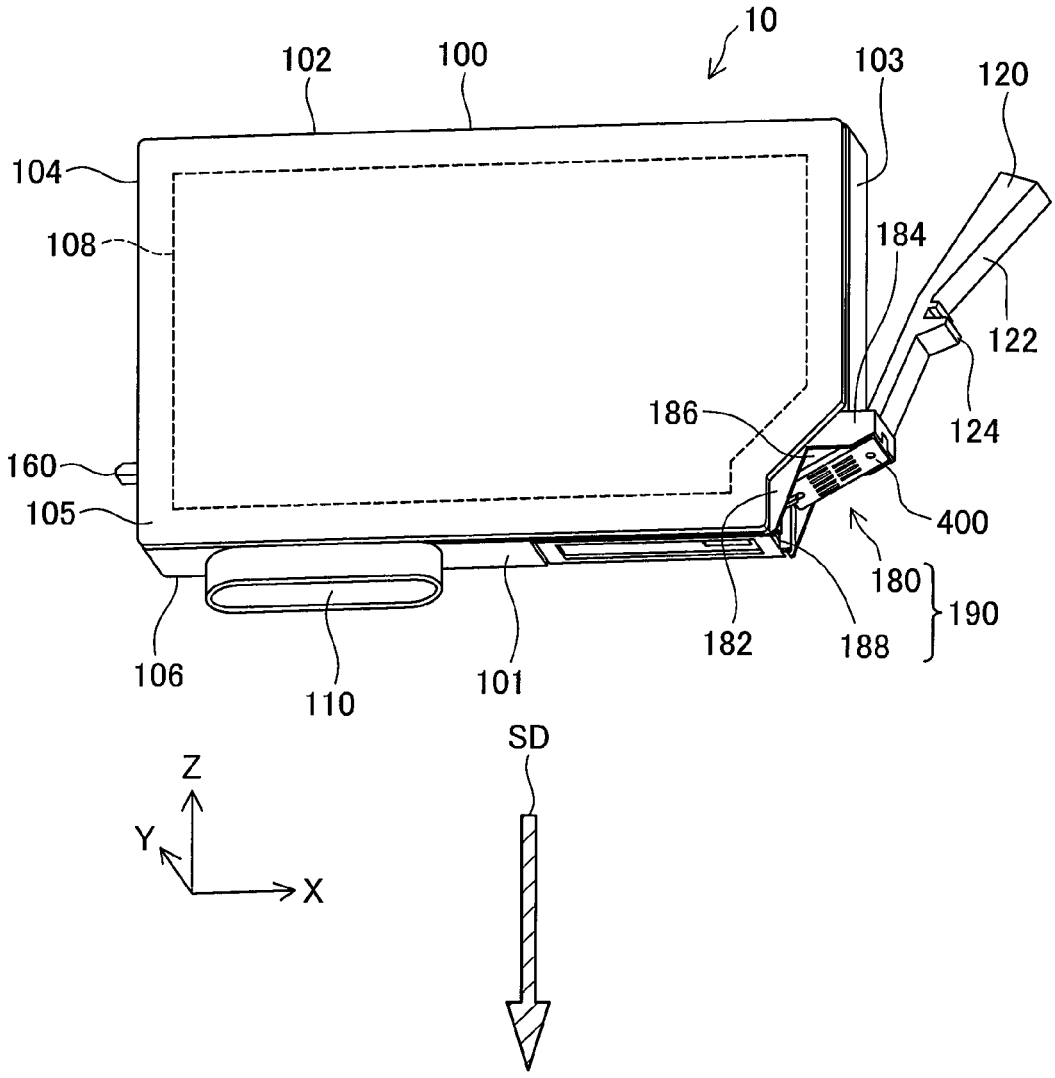
FIG. 3 is a perspective view showing the structure of a cartridge according to the first embodiment.
Figure 11A:
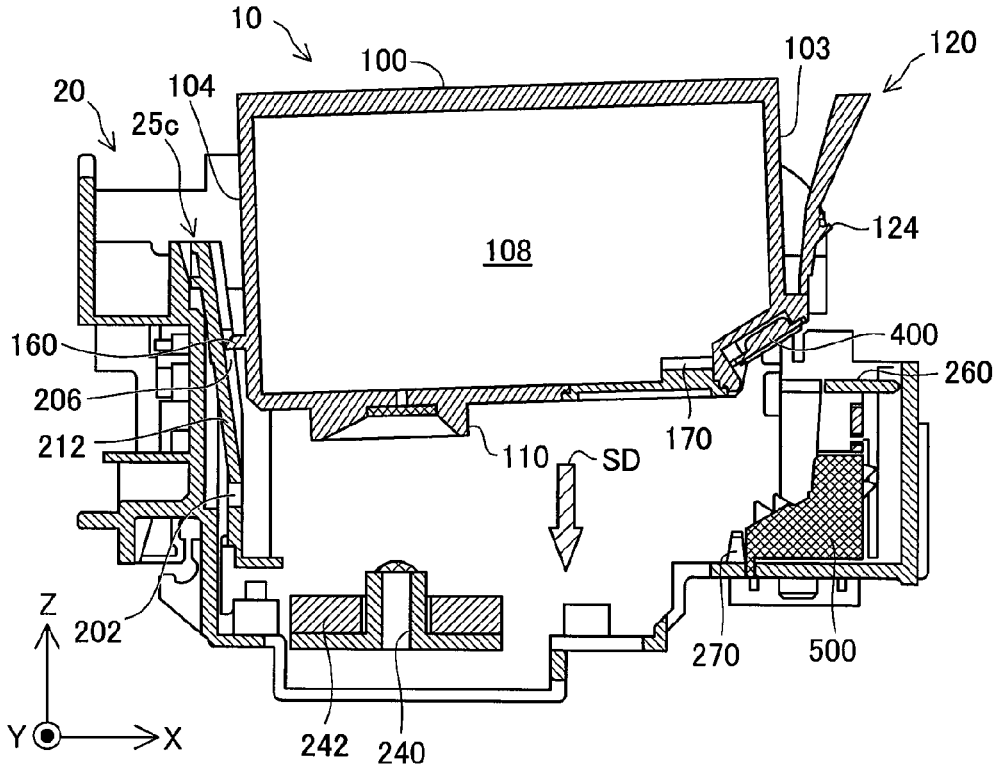
FIGS. 11A and 11B show attachment of the cartridge to the holder.
Figure 12A:
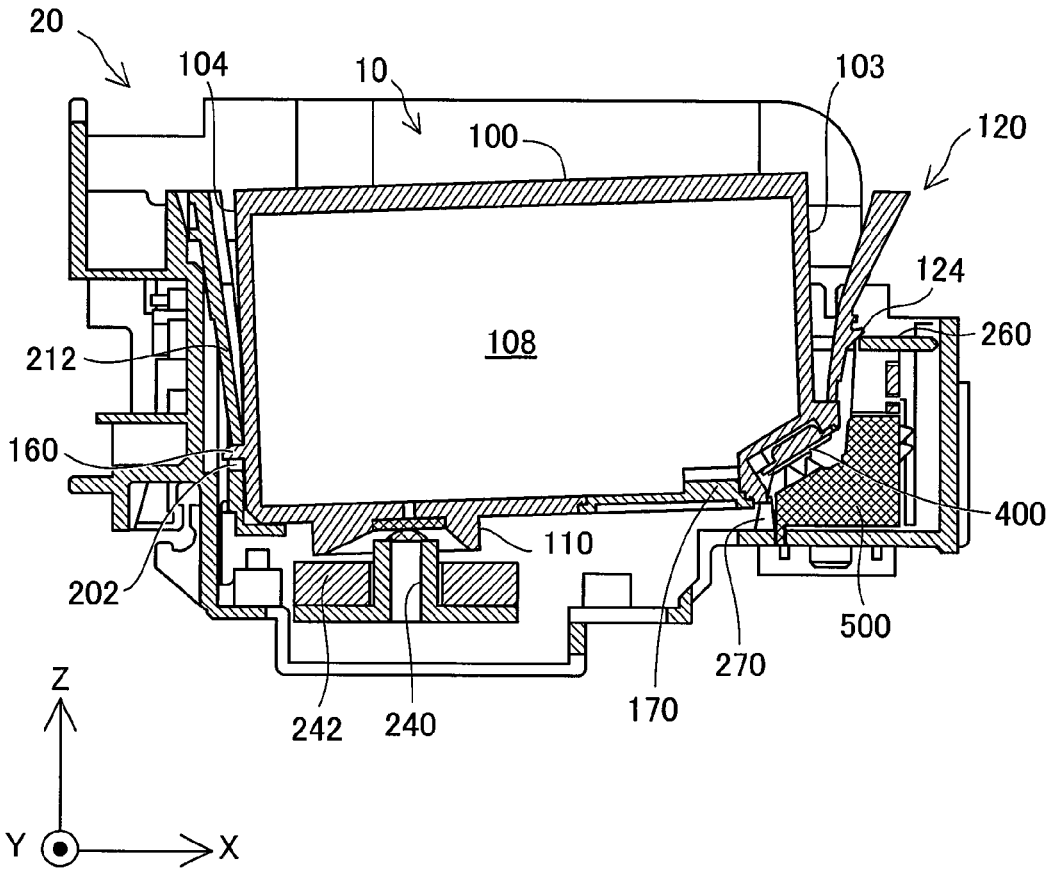
FIGS. 12A and 12B show attachment of the cartridge to the holder.
Figure 12B:
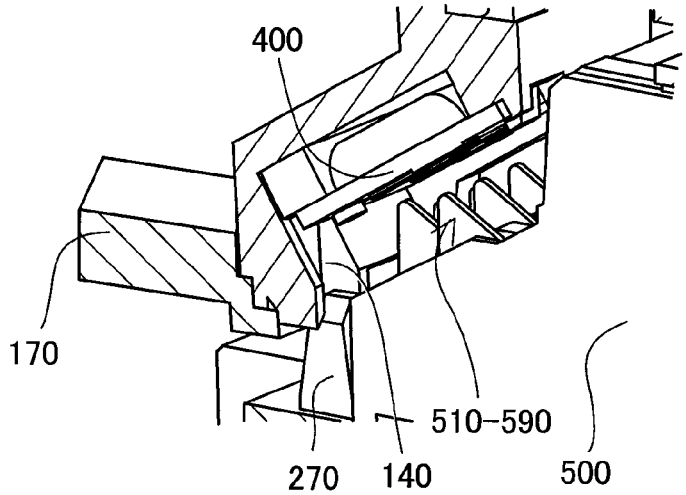

FIG. 3 is a perspective view of the cartridge 10 according to the embodiment. The attachment direction or insertion direction SD of the cartridge 10 to the holder 20 is the −Z direction (a vertically downward direction in this embodiment). In the actual state when the cartridge 10 is inserted into the holder 20, the orientation of the cartridge 10 may not always be parallel to the Z axis. As shown in FIGS. 11A, 12A, and 12B discussed later, in the course of attachment of the cartridge 10 to the holder 20, the orientation of the cartridge 10 may be tilted from the Z axis. In the state immediately before completion of the attachment and in the attached state, however, the printing material supply pipe or ink supply pipe 240 having the central axis C parallel to the Z axis is placed in an ink supply port 110, so that the orientation of the cartridge 10 is controlled by the ink supply pipe 240. In summary, the attachment direction of the cartridge 10 to the holder 20 is the −Z direction. The cartridge 10 has an ink container body 100 for containing ink (also called "ink container" or "housing") and a circuit board 400 (also called "board"). An ink chamber 108 for storing ink is formed inside the ink container body 100. The ink container body 100 is formed in an approximate-cuboid shape as a whole, and has six faces, i.e., a bottom face 101 (a first face), a top face 102 (a second face), a front face 103 (a third face), a rear face 104 (a fourth face), a left side face 105 (a fifth face) and a right side face 106 (a sixth face). The names of the respective faces (e.g., "bottom face" and "top face") indicate the locations of the respective faces when the cartridge 10 is in an upright orientation as in the attached state in the holder 20 and when viewed from the front side of the printing apparatus. The front face 103 faces the user when the cartridge 10 is attached to the holder 20. The positional relation of the side faces 103 to 106 may be changed according to the structure of the holder. For example, one of the fourth through the sixth faces 104, 105 and 106 may form the front face. The invention is also applicable to the printer having cartridges inserted in the horizontal direction instead of the vertical direction. In this case, the first face 101 and the second face 102 may become the side faces. The respective faces 101 to 106 are made of planar members, and may thus be called "plane members" or "wall members". The ink container body 100 is made of a resin material and is constructed as an assembly of a plurality of members. Part of the six faces 101 to 106 (for example, either the left side face 105 or the right side face 106) may be made of a resin film.

The bottom face 101 has the ink supply port 110 that is connected with the ink supply pipe 240 of the printing apparatus in the state where the cartridge 10 is attached to the holder 20. In the state before use, the opening of the ink supply port 110 may be sealed with a cap or a film. The top face 102 is opposed to the bottom face 101. The front face 103 intersects with the bottom face 101 and the top face 102. The lever 120 is provided on the front face 103. The lever 120 has an engagement release element 122 and an engagement projection 124 (a first cartridge-side engagement element). The lever 120 is used for attachment and detachment of the cartridge 10 to and from the holder 20. The user presses the lever 120 to mechanically engage and disengage the engagement projection 124 with and from an engagement element of the holder 20 (a first apparatus-side engagement element). The engagement projection 124 accordingly serves to hold the cartridge 10 in the attached state by engaging with the corresponding apparatus-side engagement element. The lever 120 may be omitted if unnecessary. Even in the structure without the lever 120, the cartridge is preferably equipped with the engagement projection 124 (a first cartridge-side engagement element). An engagement projection 160 (a second cartridge-side engagement element) is provided on the rear face 104. This engagement projection 160 also serves to hold the cartridge 10 in the attached state by engaging with an engagement element of the holder 20 (a second apparatus-side engagement element). The left side face 105 intersects with the bottom face 101, the top face 102 and the front face 103. The right side face 106 is opposed to the left side face 105 and intersects with the bottom face 101, the top face 102 and the front face 103. In this upright orientation, the cartridge 10 has a largest dimension in length (in the X direction), a second largest dimension in height (in the Z direction) and smallest dimension in width (in the Y direction). Among the six faces explained above, the left side face 105 and the right side face 106 are largest in area, the bottom face 101 and the top face 102 are second largest in area, and the front face 103 and the rear face 104 are smallest in area. The relation of these faces in terms of size is, however, not restrictive but may be modified arbitrarily. For example, the ink container body may be formed in a substantial cube shape as a whole.

A board mount portion 180 is formed at the position where the bottom face 101 intersects with the front face 103 (i.e., a front lower end corner of the ink container body 100). The board 400 is fixed on this board mount portion 180. In this embodiment, the board mount portion 180 is formed to have an inclined plane inclined from the bottom face 101. More specifically, an overhang section 190, which includes the board mount portion 180 and a stepped portion 188, is located at an end of the bottom face 101 proximate to the front face 103. The stepped portion 188 rises upward from the bottom face 101. The board mount portion 180 is formed above the stepped portion 188. The overhang section 190 accordingly has the stepped portion 188 rising upward from the bottom face 101 and the board mount portion 180 arranged above the stepped portion 188. It may be thought that the board mount portion 180 is arranged at a lower end of the front face 103. The circuit board 400 is fixed on the board mount portion 180, such that the surface of the board 400 faces down. The inclined plane of the board mount portion 180 is tilted from a virtual opening face (a plane parallel to YX plane) which is defined by the end opening of the ink supply port 110.

A pair of longitudinal guide wall members 182 (first wall members) and a pair of lateral guide wall members 184 (second wall members) are provided on the left and right side faces of the board mount portion 180 (i.e., side faces in ±Y directions). The pair of longitudinal guide wall members 182 cover parts of the two side faces of the circuit board 400 at the position below a ground terminal (discussed later) of the circuit board 400. Lower edge parts of the pair of longitudinal guide wall members 182 are located in the −Z direction (vertically downward direction in this embodiment) from the board surface of the circuit board 400. The pair of lateral guide wall members 184 cover parts of the two side faces of the circuit board 400 at the position in the +Z direction (upward direction in this embodiment) from the ground terminal of the circuit board 400. A cutout 186 is formed between each of the pair of longitudinal guide wall members 182 and each of the pair of lateral guide wall members 184. Both the side faces of the circuit board 400 are exposed in the cutouts 186. The longitudinal guide wall member 182 and the lateral guide wall member 184 may be structured as parts of one plate-member. In this application, one plate member is provided on each of the two side faces of the circuit board 400. The pair of longitudinal guide wall members 182, the pair of lateral guide wall members 184 and the cutouts 186 are guided by corresponding guide members of the holder 20 in the course of attachment of the cartridge 10 in the second embodiment discussed below, so that the cartridge 10 is attached in the right orientation or alignment. The first embodiment does not utilize such guiding function, and part or all of these elements 182, 184 and 186 may be omitted if unnecessary.

The stepped portion 188 arranged below the board mount portion 180 serves to protect terminals 410 to 490 (see FIG. 6A) provided on the board surface of the circuit board 400 from being accidentally damaged. In a hypothetical structure without the stepped portion 188, the board mount portion 180 and the circuit board 400 are arranged proximate to the bottom face 101. When the cartridge 10 in the upright orientation is put on the desktop, some obstacle (for example, a clip or another stationery article) may hit against the bottom face 101 and the terminals on the proximate circuit board 400, thereby damaging the terminals. In the structure with the stepped portion 188, on the other hand, there is a low probability that any foreign article on the desktop hits against the circuit board 400 located above the stepped portion 188. This arrangement thus reduces the possibility of accidentally damaging the terminals 410 to 490 formed on the board surface of the circuit board 400.

FIGS. 4A-4D are respectively a left side view, a front view, a rear view and a bottom view of the cartridge 10. FIG. 5A shows the A-A cross section of FIG. 4B. FIGS. 5B and 5C are explanatory diagrams showing a method of detecting the remaining amount of ink. FIGS. 5B and 5C show the B-B cross sections of FIG. 5A.

Figure 4A:
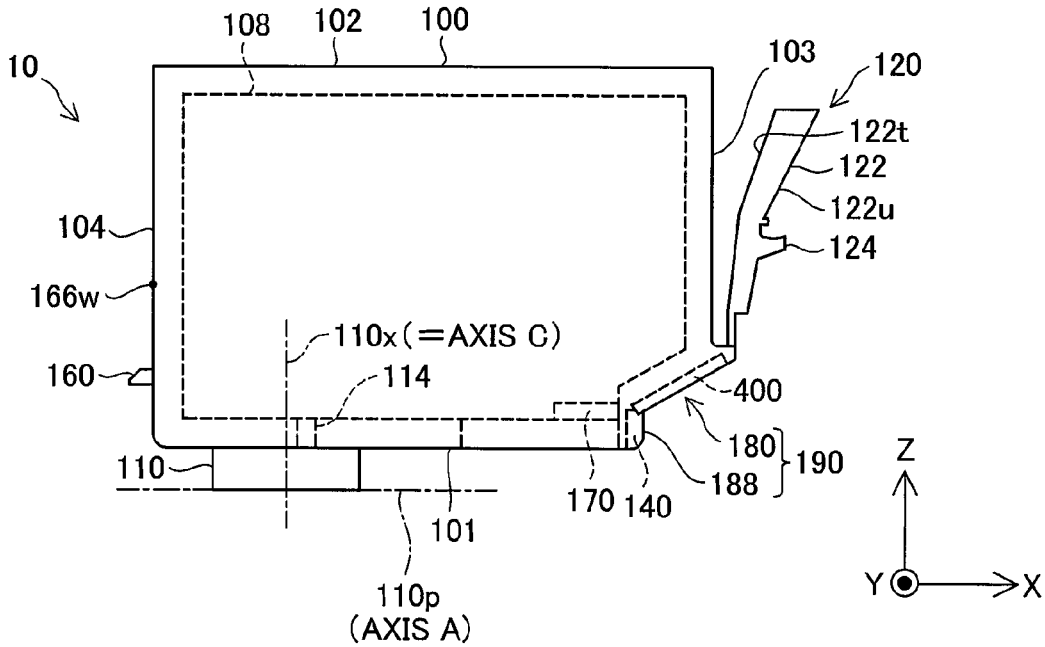
FIGS. 4A-4D show the structure of the cartridge according to the first embodiment.
Figure 4D:
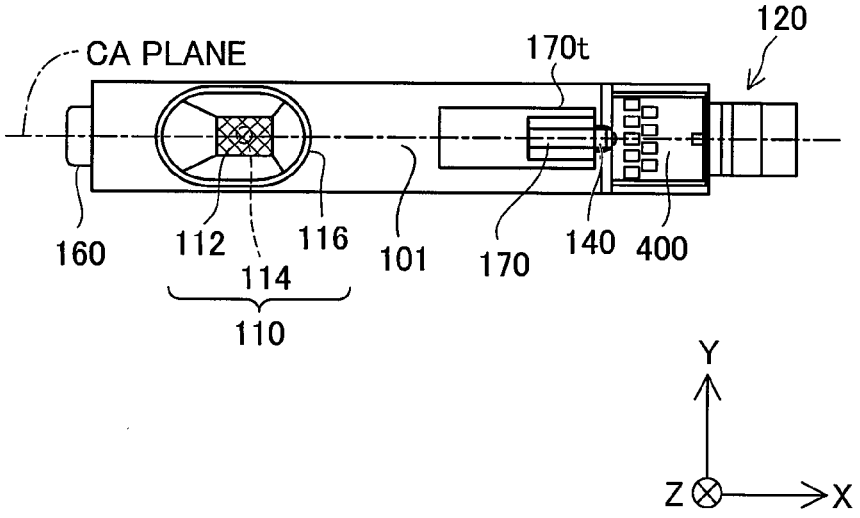
Figure 5A:
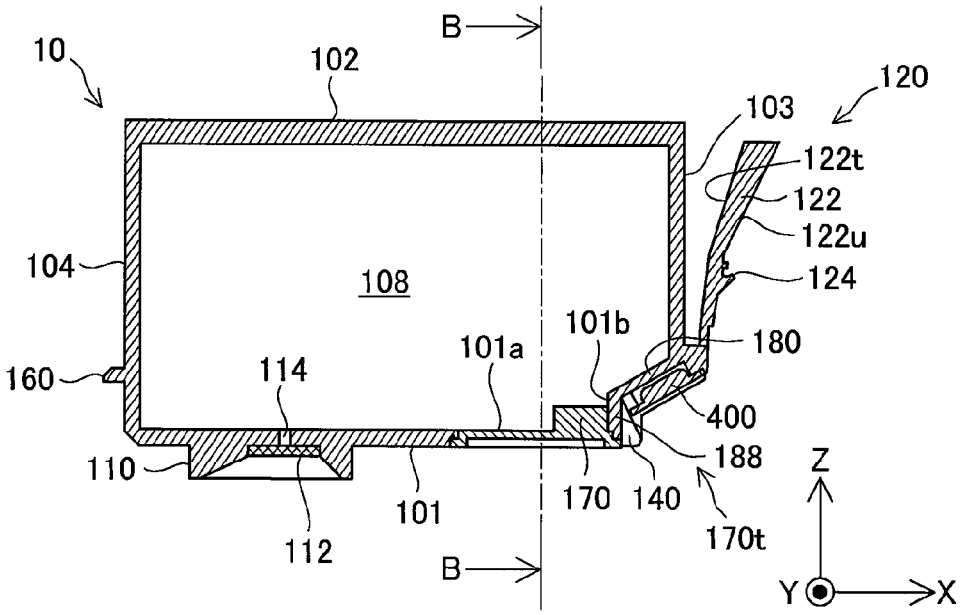
FIGS. 5A-5D show the structure of the cartridge according to the first embodiment.
Figure 5B:
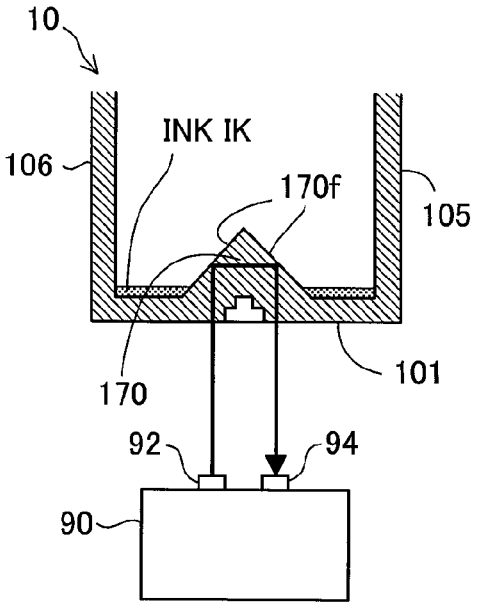
Figure 5C:
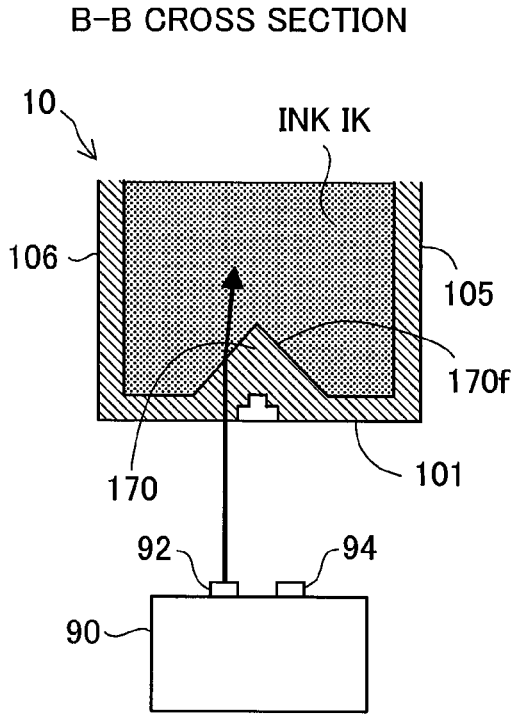

As shown in FIG. 4A, the bottom face 101 has the ink supply port 110 for flowing out the ink from the ink chamber 108. The ink supply port 110 is formed in the bottom face 101 at the position closer to the rear face 104 than the front face 103. As shown in FIGS. 4A and 4D, the ink supply port 110 has a sponge-like foam 112, an ink flow path 114, and an opening 116 (a cylindrical opening) which is protruded from the bottom face 101. The foam 112 is located at the outlet of the ink flow path 114 to prevent unintentional leakage of ink through the ink flow path 114.

The axis C of the ink supply pipe 240 (FIG. 9) intersects perpendicularly with the opening 116 of the ink supply port 110. The axis C runs through the center of the opening 116 of the ink supply port 110 in the Y direction. In this embodiment, the axis C is identical with an axis 110*x* in the Z direction (a vertical direction in this embodiment) which runs through the center of gravity of the opening 116 of the ink supply port 110. In this embodiment, the axis 110*x* runs through the center of the width in the Y direction of the cartridge 10. The opening 116, when viewed in the +Z direction, is generally designed to have a line-symmetric contour (for example, precise circle, ellipse, oval, square, rectangle or rounded rectangle) with respect to both the X-direction axis and the Y-direction axis. In this embodiment, the opening 116 has an elliptical contour or outline. In this case, the "center of the opening in the Y direction" means the center of the symmetrical axis in the Y direction of the contour shape of the opening 116. The "center of the opening" means the center of gravity of the contour shape of the opening 116. In another embodiment, the contour shape of the opening 116 may not be line symmetric. In this case, a virtual line-symmetric contour shape (for example, rectangle) which circumscribes the contour of the opening may be assumed, and the "center of the opening in the Y direction" and the "center of the opening" may be determined from the virtual line-symmetric contour shape.

The face defined by the end opening of the opening 116 of the ink supply port 110 (referred to as "opening face") and a plane 110*p* extended from the opening face are parallel to both the X axis (X direction) and the Y axis (Y direction), i.e., parallel to the XY plane. The opening face of the ink supply port 110 and the extended plane 110*p* are orthogonal to the central axis C of the ink supply pipe 240. The opening face of the ink supply port 110 and the extended plane 110*p* are also orthogonal to the axis 110*x* in the Z direction going through the center of the ink supply port 110.

Figure 5D:
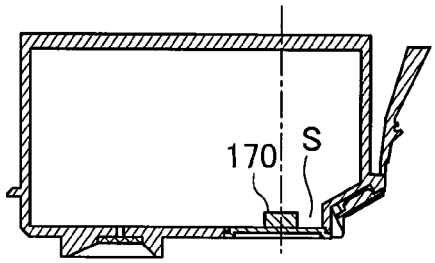

As shown in FIGS. 4A, 4D and 5A, a prism unit 170*t* is also provided on the bottom face 101. The prism unit 170*t* is made of a translucent resin (for example, polypropylene). As shown in FIGS. 5A to 5C, the prism unit 170*t* includes a prism 170 used for detecting the remaining amount of ink. The prism 170 has geometry of an isosceles right triangular prism and is arranged to locate its reflecting planes 170*f* inside the ink chamber 108. As shown in FIG. 5A, the prism 170 is located proximate to the front face 103 on the inner surface of the bottom face 101. The prism 170 is arranged to be in contact with both an inner surface 101*a* parallel to the X direction and an inner face 101*b* parallel to the Z direction. This arrangement prevents the ink flow from the bottom face 101 toward the ink supply port 110 from being blocked by a space S formed between the prism 170 and the inner surface of the cartridge 10 (see FIG. 5D as a comparative example). This arrangement thus reduces the amount of ink retention in the ink chamber 108 and ensures efficient ink consumption.

As shown in FIGS. 5B and 5C, the printing apparatus has an optical detector 90. Light emitted from a light-emitting element 92 of the optical detector 90 enters the prism 170. The light reflection by the prism 170 depends on the refractive index of the fluid, to which the reflecting planes 170*f* are exposed. As shown in FIG. 5B, when the remaining amount of ink is reduced to a level that causes the reflecting planes 170*f* to be exposed to the air, the light emitted from the light-emitting element 92 is reflected on the reflecting planes 170*f* of the prism 170, and then enters a light-receiving element 94. As shown in FIG. 5C, when the remaining amount of ink in the ink chamber 108 is at a level that causes the reflecting planes 170*f* to be exposed to ink IK, on the other hand, the light emitted from the light-emitting element 92 transmits through the reflecting plane 170*f* to be absorbed in the ink IK. The fall of the ink level is detectable by observing the light entering the light-receiving element 94.

Figure 4B:
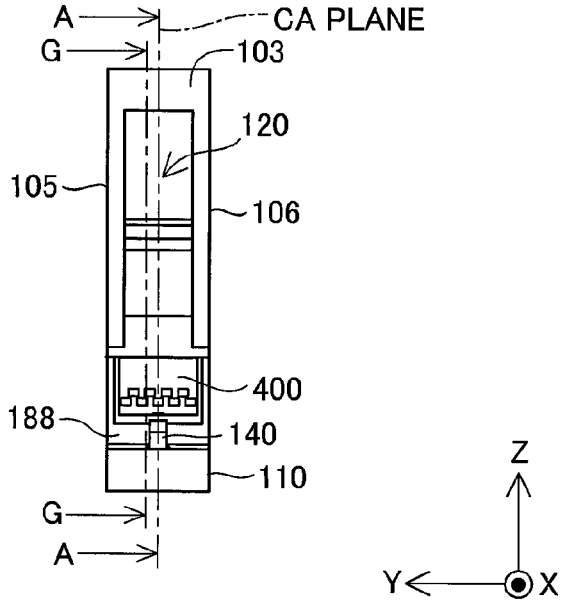

As shown in FIGS. 4A, 4B and 5A, the stepped portion 188 has a cutout groove 140. As shown in FIG. 4B, the cutout groove 140 is formed on the approximate center of the width in the Y direction of the stepped portion 188. The cutout groove 140 is also called "fitting recess" or "positioning recess".

As discussed previously, the circuit board 400 is located on the inclined board mount portion 180. As can be seen in FIG. 5A, when projected in the Z direction (vertical direction in this embodiment, the circuit board 400 partly overlaps the cutout groove 140. In the attached state of the cartridge 10 to the holder 20, the circuit board 400 is thus located vertically above the cutout groove 140. In the attached state to the holder 20, the circuit board 400 is electrically connected with the controller 40 of the printing apparatus (FIG. 1) to transmit various pieces of information (or signals) to and from the printing apparatus.

As shown in FIGS. 4A and 5A, the lever 120 is provided on the front face of the cartridge. More specifically, one end in the −Z direction (a lower end in this embodiment) of the lever 120 is attached to one end in the +Z direction (an upper end in this embodiment) of the board mount portion 180. The lever 120 is extended from its end in the −Z direction (its lower end in this embodiment) toward the +Z direction (a upward direction in this embodiment). The lever 120 has elasticity, and is elastically deformed in the X-axis direction by an external force. The lever 120 includes the engagement projection 124 and the engagement release element 122. The engagement projection 124 engages with a corresponding engagement element of the holder 20 (discussed later) to restrict the motion of the cartridge 10 in the height direction. The engagement release element 122, to which an external force is applied by the user, is used to disengage the engagement projection 124 from the holder 20. The engagement release element 122 has a first side face 122*t* opposed to the front face 103 and a second side face 122*u* opposite to the first side face 122*t*. The second side face 122*u* is inclined to approach a pivot 166*w* (discussed below) from the free end to the base portion of the lever 120 in the state where the first side face 122*t* abuts against the front face 103. Such inclination of the second side face 122*u* may be hereinafter referred to as "downward inclination".

Figure 4C:
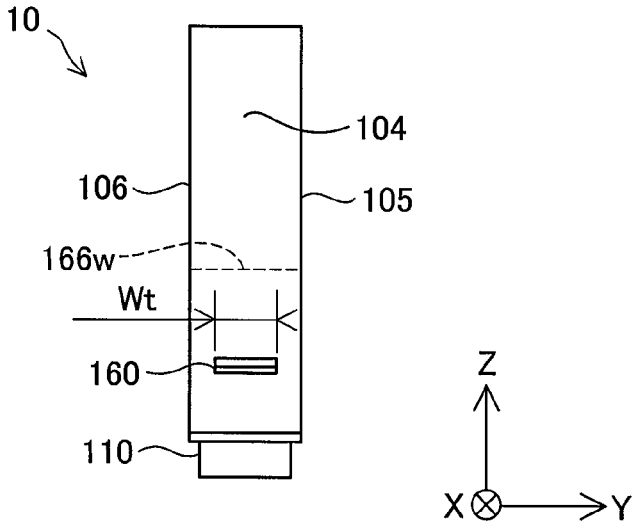

As shown in FIGS. 4A, 4C and 5A, an engagement projection 160 is formed on the rear face 104 at a position lower than half the height of the rear face 104 in the Z direction (vertical direction in this embodiment). The engagement projection 160 is used to restrict the motion of the cartridge 10 after the cartridge 10 is attached to the holder 20. The engagement projection 160 has a width Wt.

The rear face 104 has the pivot 166*w*, which comes into contact with the holder 20 and serves as the point of rotation when the cartridge 10 is detached from the holder 20 by pivotal rotation. The pivot 166*w* is positioned in the minus direction (downward direction in this embodiment) from the position (engagement point) where the engagement projection 124 engages with the holder 20 with regard to the Z direction (vertical direction in this embodiment). The pivot 166*w* is thus located in the −Z direction from the position (engagement point) where the engagement projection 124 engages with the holder 20. In other words, the pivot 166*w* is positioned in the minus direction (downward direction in this embodiment) from the engagement release element 122 with regard to the Z direction (vertical direction in this embodiment). The pivot 166*w* is thus located in the −Z direction from the engagement release element 122. An air open hole (not shown) is formed in the rear face 104 to introduce the air with consumption of ink in the ink chamber 108.

Figure 6A:
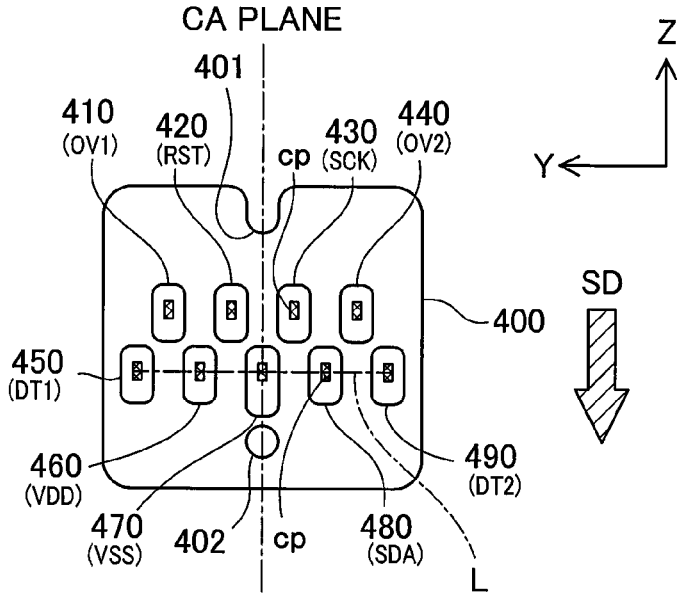
FIGS. 6A and 6B show a circuit board.
Figure 6B:
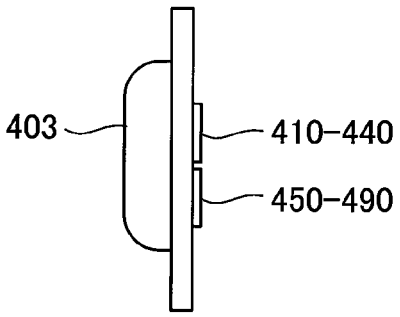

FIGS. 6A and 6B are explanatory diagrams of the circuit board 400. FIG. 6A shows the surface structure of the circuit board 400. FIG. 6B shows the side face of the circuit board 400. The surface of the circuit board 400 is exposed to outside, when being attached to the cartridge 10. The arrow SD shown in FIG. 6A indicates the attachment or insertion direction of the cartridge 10 to the holder 20. The attachment direction SD is the −Z direction.

As shown in FIG. 6A, a boss groove 401 is formed on the upper end of the circuit board 400, and a boss hole 402 is formed in the lower end portion of the circuit board 400. The circuit board 400 has a terminal group consisting of nine terminals 410 to 490 arranged on the board surface, and a memory device 403. The memory device 403 disposed on the rear face stores various pieces of information on the ink of the cartridge 10 (for example, information on the remaining amount of ink and the ink color). The terminals 410 to 490 are formed in substantially rectangular shape and are arranged in two rows substantially perpendicular to the Z axis (i.e., the attachment direction SD). Out of the two rows, a first row on the −Z-direction side (back side of the attachment direction SD), i.e., on the lower side of FIG. 6A, is called a lower row, and a second row on the +Z-direction side (front side of the attachment direction SD), i.e., on the upper side of FIG. 6A, is called an upper row. The "first row on the −Z-direction side" means a row at the position advancing in the −Z direction out of the two rows. The "second row on the +Z-direction side" means a row at the position advancing in the +Z direction out of the two rows. Since the circuit board 400 on the cartridge 10 has inclined orientation, these two rows also have different positions in the X direction but are here defined by only the positional relation with regard to the Z direction.

Each of the terminals 410 to 490 has a contact portion "cp" on its center, which comes into contact with a corresponding terminal among apparatus-side terminals provided in the holder 20. The contact portions "cp" of the terminals 410 to 440 in the upper row and the contact portions "cp" of the terminals 450 to 490 in the lower row are alternately disposed to form a zigzag arrangement. The terminals 410 to 440 in the upper row and the terminals 450 to 490 in the lower row are also alternately disposed to form a zigzag arrangement, in such a manner as to prevent the terminal centers from aligning in the attachment direction SD. The circuit board 400 is attached to the cartridge 10, such that the row of terminals closer to the cutout groove 140 of the cartridge 10 includes a greater number of the contact portions "cp". In other words, the circuit board 400 is attached to the cartridge 10, such that the second row is located in the −Z direction from the first row (in this embodiment, such that the lower row is located at the lower position than the upper row in the height direction of the cartridge 10).

The terminals 410 to 440 in the upper row and the terminals 450 to 490 in the lower row may respectively have the following functions (applications):

Upper Row:

(1) overvoltage detection terminal 410

(2) reset terminal 420 (low voltage terminal)

(3) clock terminal 430 (low voltage terminal)

(4) overvoltage detection terminal 440

Lower Row;

(5) attachment detection terminal 450 (high voltage terminal)

(6) power supply terminal 460 (low voltage terminal)

(7) ground terminal 470

(8) data terminal 480 (low voltage terminal)

(9) attachment detection terminal 490 (high voltage terminal)

The pair of overvoltage detection terminals 410 and 440 are used to detect an abnormally high voltage value (called "overvoltage"). The pair of attachment detection terminals 450 and 490 are used to detect the normal attachment or failed attachment of the cartridge. The overvoltage detection terminals 410 and 440 may be used for attachment detection, in addition to the overvoltage detection. In this embodiment, a higher voltage (rated voltage of 42 V or rated voltage of 36 V) than the power supply voltage (rated voltage of 3.3 V) for the memory device 403 is applied to the attachment detection terminals 450 and 490. The attachment detection terminals 450 and 490 are accordingly called "high voltage terminals" or "high voltage-applying terminals". The other five terminals 420, 430, 450, 470 and 480 are the terminals for the memory device 403. Among these five terminals, the lower voltage (rated voltage of 3.3 V) than the voltage applied to the high voltage terminals 450 and 490 is applied to the four terminals 420, 430, 460 and 480 other than the ground terminal 470. These four terminals 420, 430, 460 and 480 are accordingly called "low voltage terminals" or "low voltage-applying terminals". The terminals 410 to 490 provided on the board surface of the circuit board 400 are also called "cartridge-side terminals". In this embodiment, the respective cartridge-side terminals are arranged at substantially identical heights from the board surface of the circuit board 400, although a slight difference in height is allowable.

The ground terminal 470 is located at such a position that the ground terminal 470 intersects with a CA plane when the circuit board 400 is fixed to the cartridge 10 (See FIGS. 4B and 4D). The CA plane is defined by the central axis C of the ink supply pipe 240 of the holder 20 (FIGS. 4A, 9 and 15A) and an axis A which goes through the central axis C and which is parallel to the X axis. The ground terminal 470 is located on the center of the width in the Y direction of the cartridge 10. The contact portion "cp" of the ground terminal 470, which comes into contact with a corresponding apparatus-side ground terminal, is arranged on the center of the width in the Y direction of the cartridge 10. As discussed previously with reference to FIGS. 4A-4D, the axis in the Z direction going through the center of the ink supply port 110 (the axis orthogonal to the plane 110*p* extended from the opening face of the ink supply port 110) is also located on the center of the width in the Y direction of the cartridge 10. When the cartridge 10 is viewed from its front face 103-side, the contact portion "cp" of the ground terminal 470 on the circuit board 400 overlaps the axis 110*x* in the Z direction going through the center of the ink supply port 110. In the illustrated example of FIG. 6A, the ground terminal 470 has an elongated shape that is longer in the Z direction than the other terminals on the circuit board 400. This is because the ground terminal 470 comes into contact with a corresponding apparatus-side terminal before the other terminals on the circuit board 400 do as discussed later. The longer dimension of the ground terminal 470 than the other terminals enables the ground terminal 470 to reliably come into contact with the corresponding apparatus-side terminal. In another embodiment, all the terminals on the circuit board 400 may have an identical length. The ground terminal 470 is arranged to go through the center of a straight line L that connects the contact portion "cp" of the first attachment detection terminal 450 (high voltage terminal) with the contact portion "cp" of the second attachment detection terminal 490 (high voltage terminal). The arrangement of the terminals and their contact portions on the circuit board 400 will be described in more details, after the explanation on the relation of connection between the controller 40 of the printing apparatus and the circuit board 400.

Figure 7:
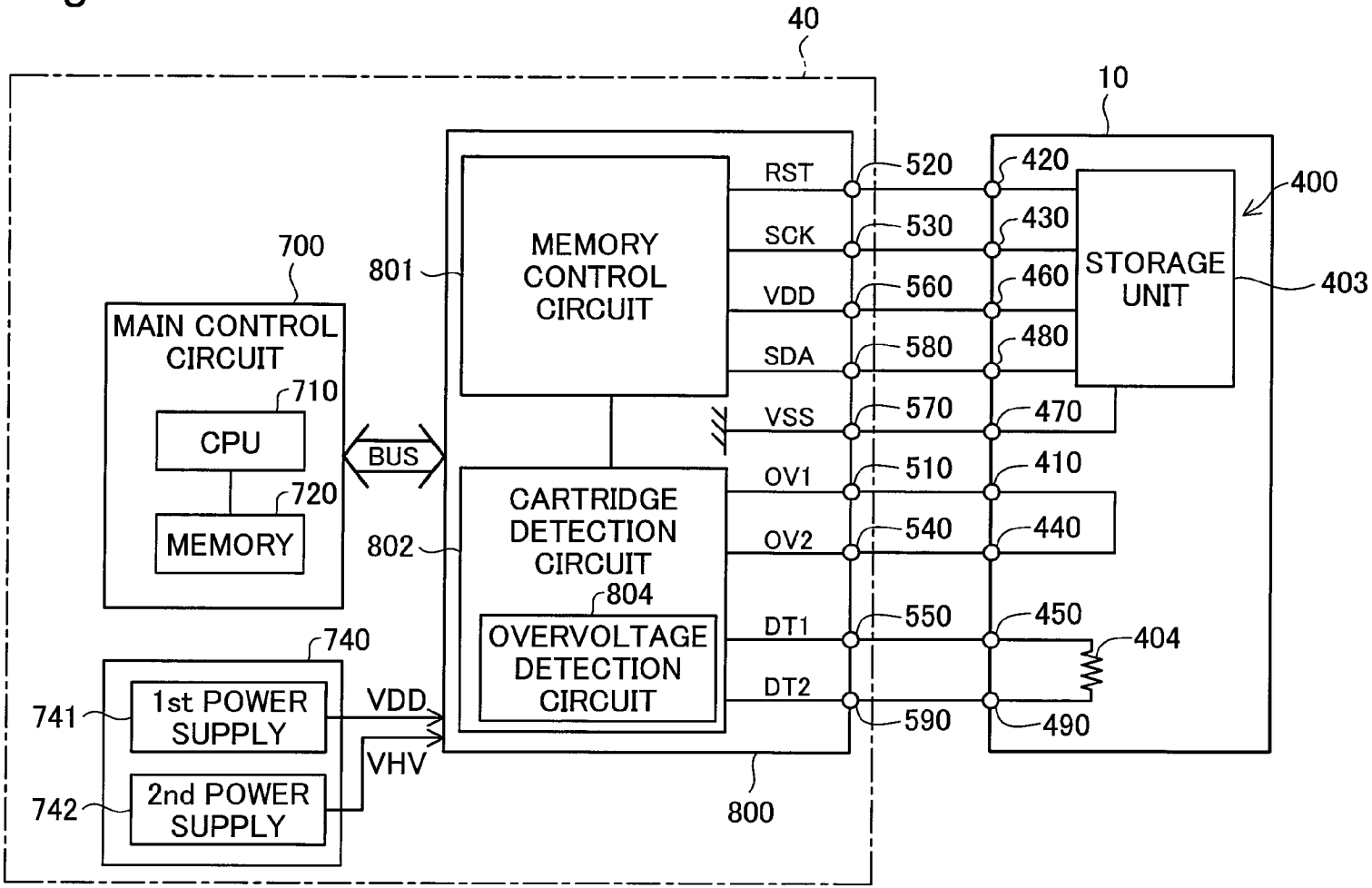
FIG. 7 is a block diagram showing the electrical structure of the circuit board of the cartridge and the printing apparatus.

FIG. 7 is a block diagram showing the electric structure of the circuit board 400 and the controller 40 of the printing apparatus. The controller 40 of the printing apparatus includes a power supply circuit 740, a main control circuit 700 and a sub control circuit 800. The power supply circuit 740 includes a first power supply 741 generating a first power supply voltage VDD and a second power supply 742 generating a second power supply voltage VHV. The first power supply voltage VDD is a standard power supply voltage (rated voltage of 3.3 V) used for logic circuits. The second power supply voltage VHV is a high voltage (for example, rated voltage of 42 V) used for driving a print head to eject ink. These voltages VDD and VHV are supplied to the sub control circuit 800 and further to other circuits if necessary. The main control circuit 700 includes a CPU 710 and a memory 720. The sub control circuit 800 includes a memory control circuit 801 and a cartridge detection circuit 802. The cartridge detection circuit 802 includes an overvoltage detection circuit 804 (a short detection circuit). The circuit including the main control circuit 700 and the sub control circuit as a whole may be called "control circuit".

Among the nine terminals 410 to 490 provided on the circuit board 400 of the cartridge (FIG. 6A), the reset terminal 420, the clock terminal 430, the power supply terminal 460, the ground terminal 470 and the data terminal 480 are electrically connected with the memory device 403. The memory device 403 is a non-volatile memory without an address terminal, which is configured to determine a memory cell to be accessed based on the number of pulses of a clock signal SCK input from the clock terminal and command data input from the data terminal, and to receive data at the data terminal or send data from the data terminal in synchronism with the clock signal SCK. The clock terminal 430 is used to supply the clock signal SCK from the sub control circuit 800 to the memory device 403. The printing apparatus supplies a power supply voltage (for example, rated voltage of 3.3 V) and a ground voltage (0 V) to the power supply terminal 460 and to the ground terminal 470, respectively. The data terminal 480 is used to transmit a data signal SDA between the sub control circuit 800 and the memory device 403. The reset terminal 420 is used to supply a reset signal RST from the sub control circuit 800 to the memory device 403.

In addition to the memory device 403 and the nine terminals 410 to 490, the circuit board 400 further has a resistance element 404 used for detecting attachment of each individual cartridge. The cartridge detection circuit 802 measures the current value or the voltage value of a circuit including the resistance element 404 to detect the normal attachment or failed attachment of each cartridge. The high voltage VHV of the second power supply 742 (for example, rated voltage of 42 V) is applied to the resistance element 404. The overvoltage detection circuit 804 detects whether an overvoltage (abnormally high voltage) is applied to the overvoltage detection terminals 410 and 440. The overvoltage detection circuit 804 also serves to notify the power supply circuit 740 of detection of an overvoltage, thereby causing the second power supply 742 to stop the supply of the high voltage VHV. The two overvoltage detection terminals 410 and 440 are connected with each other by wiring on the circuit board 400. Part of the wiring for this connection may be replaced by a resistance. The state of connection of two terminals by wiring is called "short connection" or "conductor connection". The short connection by wiring is different from unintentional short circuit.

The respective line paths in FIG. 7, which connect apparatus-side terminals 510 to 590 with the corresponding terminals 410 to 490 on the circuit board 400, are expressed by line names SCK, VDD, SDA, RST, OV1, OV2, DT1 and DT2. Among these line names, those of the line paths for the memory device are the same names as the signal names. The cartridge detection circuit 802 and the resistance element 404 of the cartridge forms a high voltage circuit operating at the higher voltage (rated voltage of 42 V in this embodiment) than the operating voltage of the memory device 403. The resistance element 404 is a high voltage device, to which the high voltage VHV is applied from the cartridge detection circuit 802. The high voltage device provided on the circuit board 400 is not limited to the resistance element 404 but may be any of other various devices, elements and circuits. For example, a sensor used for detecting the remaining amount of ink, a capacitance, a coil, and a circuit structured as a combination thereof may be applicable as the high-voltage device.

As shown in FIG. 6A, the lower row (i.e., the first row on the −Z-direction side) of the contact portions on the circuit board 400 includes the contact portion "cp" of the ground terminal 470, the first contact portions "cp" of the pair of high voltage terminals 450 and 490, and the second contact portions "cp" of the pair of first low voltage terminals 460 and 480. The upper row (i.e., the second row on the +Z-direction side) includes the third contact portions "cp" of the pair of overvoltage detection terminals 410 and 440 and the fourth contact portions "cp" of the second low voltage terminals 420 and 430. In the upper row (second row), the third contact portions "cp" of the pair of overvoltage detection terminals 410 and 440 are located at the outer most positions. The fourth contact portions "cp" of the second low voltage terminals 420 and 430 are located between the third contact portions "cp" of the pair of overvoltage detection terminals 410 and 440. The third contact portion "cp" of the overvoltage detection terminal 410 (or 440) is arranged to be located in the Y direction between the first contact portion "cp" of the high voltage terminal 450 (or 490) and the second contact portion "cp" of the adjacent first low voltage terminal 460 (or 480).

Figure 8A:
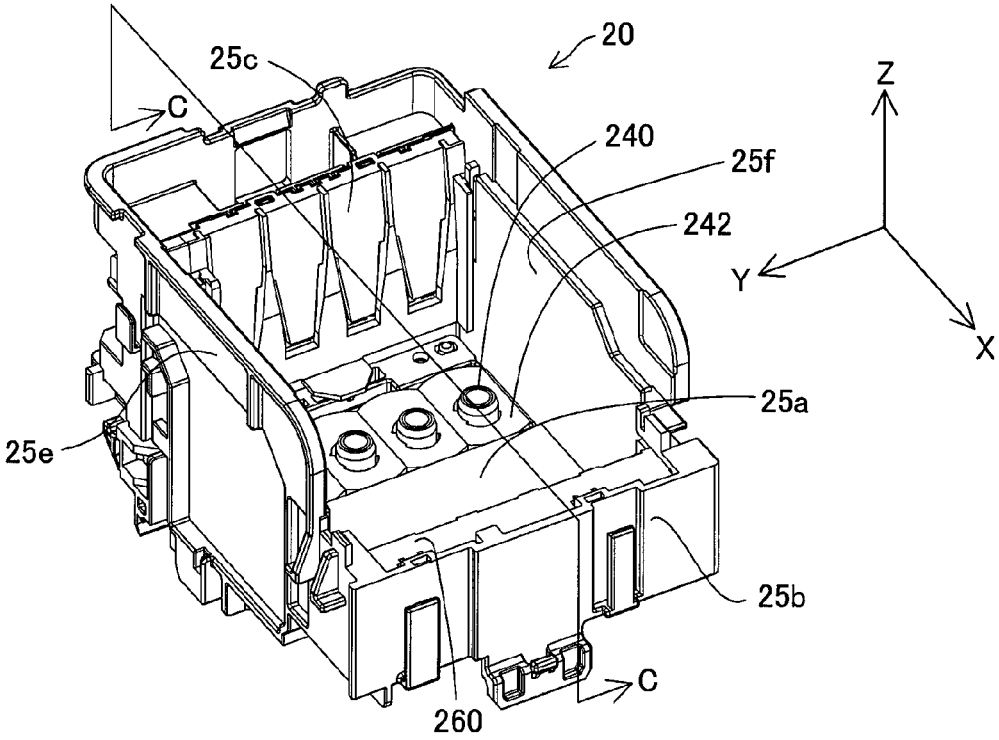
FIG. 8A-8D show the holder.
Figure 8B:
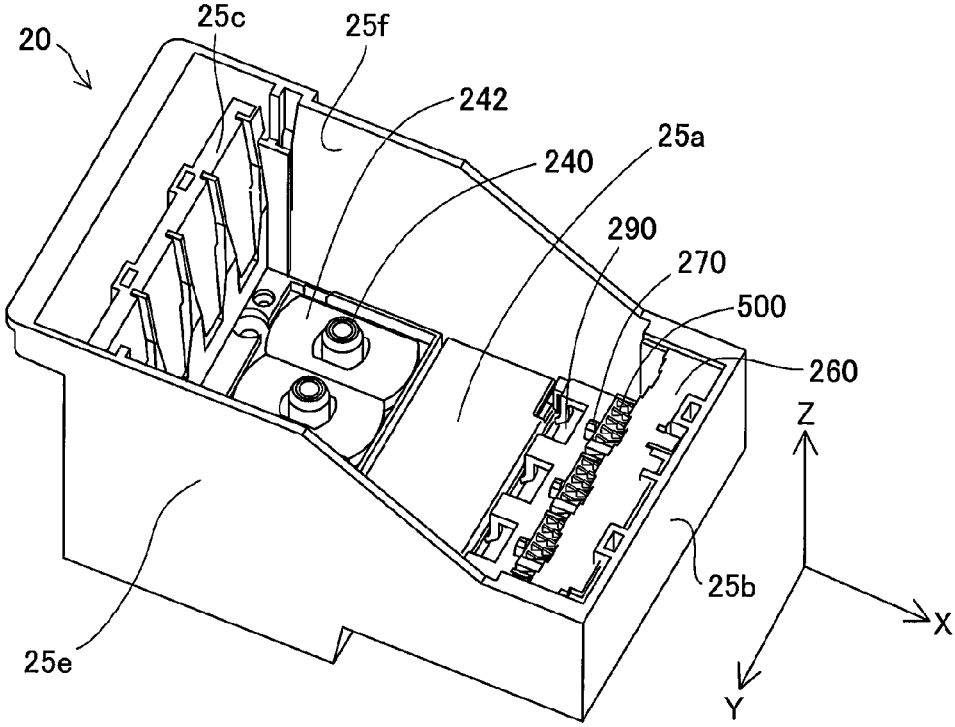
Figure 8C:
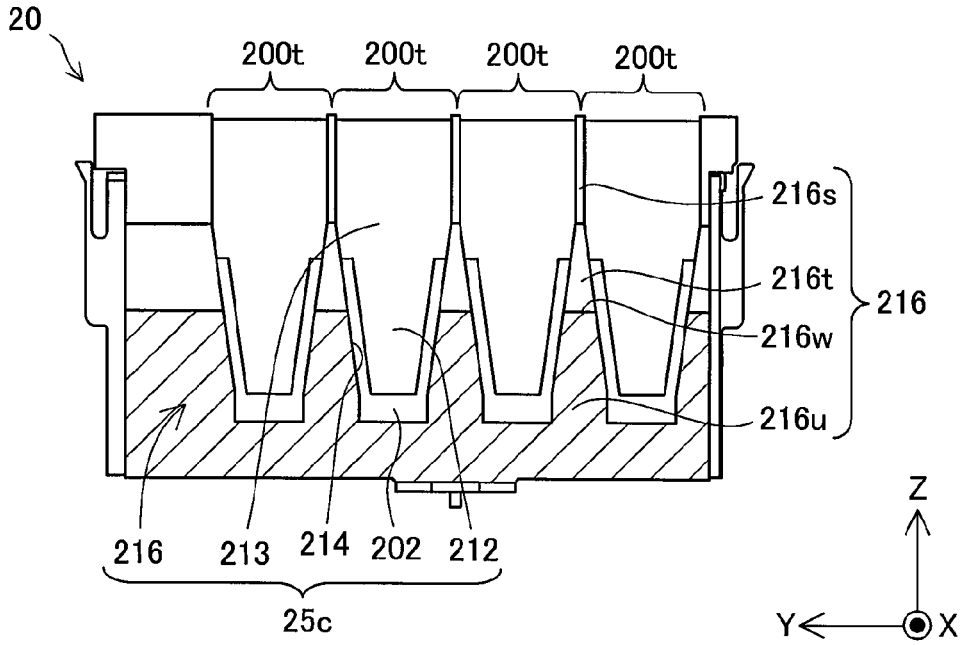
Figure 8D:
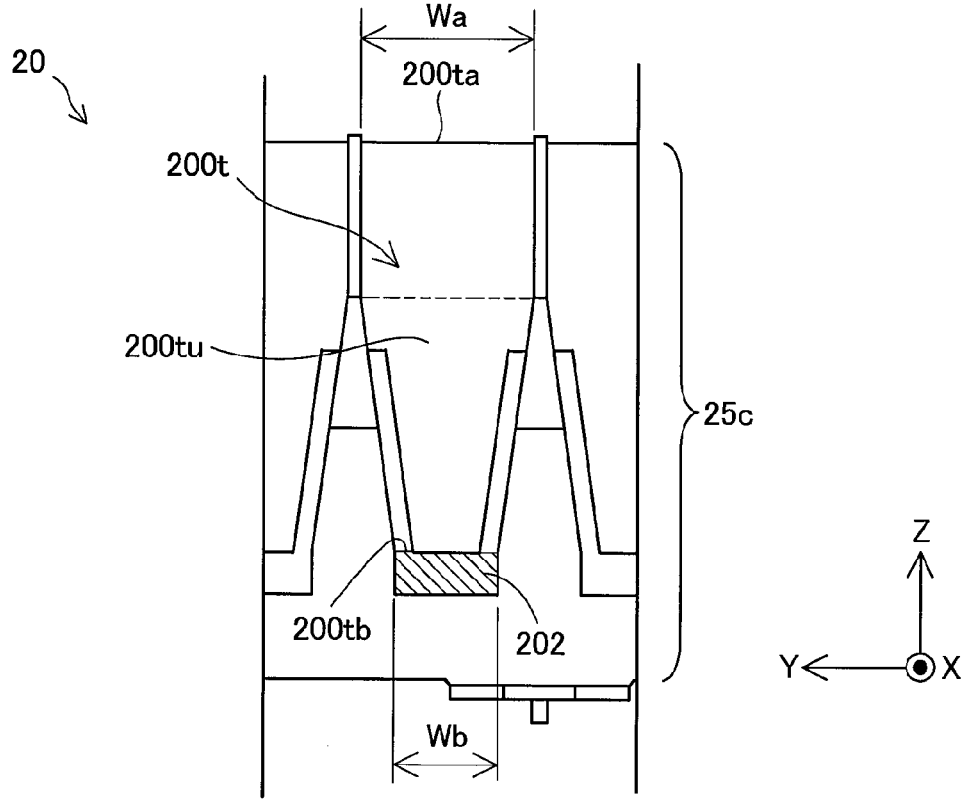
Figure 9:
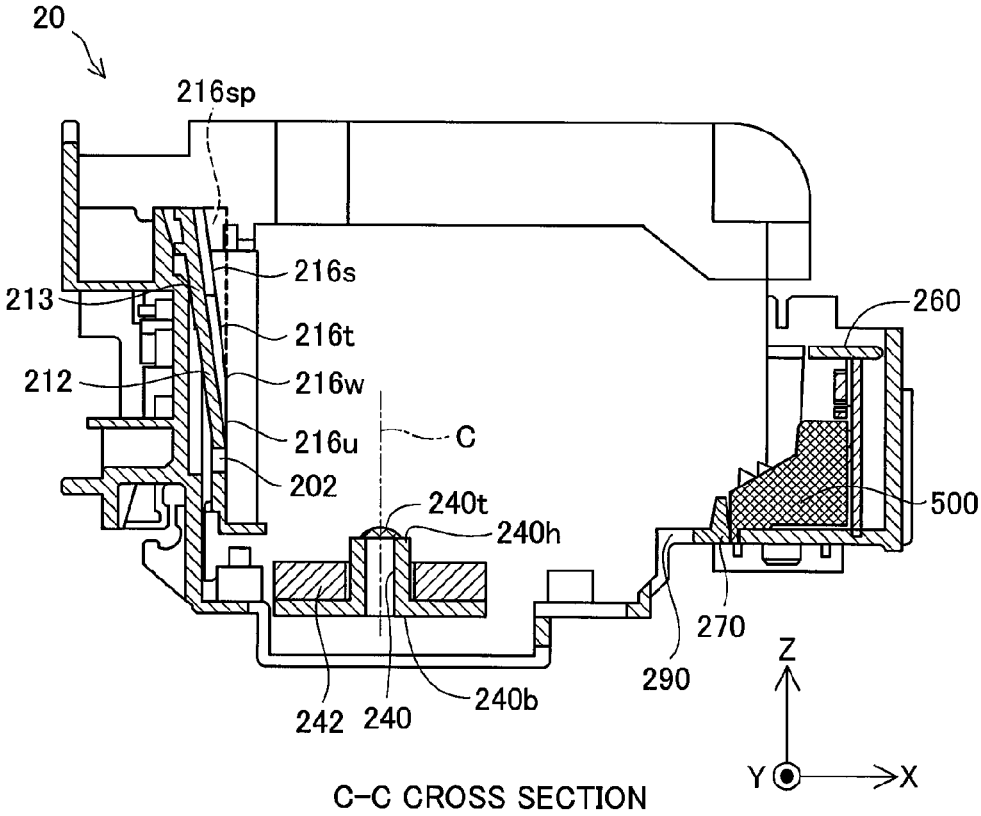
FIG. 9 is a C-C sectional view of FIG. 8A.

FIGS. 8A through 8D and FIG. 9 show the detailed structures of the holder 20. FIGS. 8A and 8B are perspective views showing the appearance of the holder 20. For the simplicity of explanation, the outer circumferential wall forming the holder 20 is partly omitted in FIG. 8B. FIG. 8C shows an opposed face wall portion 25*c* when viewed from the positive direction of the X axis. FIG. 8D is a partial close-up of FIG. 8C. FIG. 9 shows a C-C cross section of FIG. 8A.

As shown in FIG. 8A, the holder 20 is formed in a concave shape having an open end to enable attachment and detachment of the cartridges 10. The holder 20 includes an apparatus-side bottom face wall portion (also called "bottom face portion") 25*a*, an engagement element-side face wall portion (also called "front face portion") 25*b*, an opposed face wall portion (also called "rear face portion") 25*c*, a first apparatus-side side face wall portion (also called "left side face portion") 25*e* and a second apparatus-side side face wall portion (also called "right side face portion") 25*f*. These face wall portions 25*a* to 25*f* define a cartridge housing for accommodating the cartridges 10. Each of the respective face wall portions 25*a* to 25*f* is made of a synthetic resin, such as polycarbonate.

The apparatus-side bottom face wall portion 25*a* forms the bottom face when the printing apparatus is in a state of use. The opposed face wall portion 25*c*, the engagement element-side face wall portion 25*b*, the first apparatus-side side face wall portion 25*e* and the second apparatus-side side face wall portion 25*f* are upright from the apparatus-side bottom face wall portion 25*a*. The opposed face wall portion 25*c* and the engagement element-side face wall portion 25*b* are opposed to each other. The first apparatus-side side face wall portion 25*e* and the second apparatus-side side face wall portion 25*f* are opposed to each other.

The ink supply pipes 240 and the seal members 242 are attached to the apparatus-side bottom face wall portion 25*a*. One end of each ink supply pipe 240 is connected with the print head 32 (FIG. 1), which is attached to the rear face of the apparatus-side bottom face wall portion 25*a* (i.e., the face in the negative direction of the Z axis). In the state where the cartridge 10 is attached to the holder 20, the other end of the ink supply pipe 240 is connected with the ink supply port 110 of the cartridge 10 (FIG. 4A). The seal member 242 is made of an elastic material, such as synthetic rubber. The seal member 242 is placed around the ink supply pipe 240 to seal the ink supply port 110, thereby preventing leakage of ink when the cartridge 10 is attached to the holder 20. As shown in FIG. 9, the other end of the ink supply pipe 240 has a porous metal filter 240*t*, which partly comes into contact with the foam 112 in the ink supply port 110 (FIG. 5A). The filter 240 may be made of stainless steel mesh or non-woven stainless steel. The filter 240*t* may be omitted if unnecessary.

As shown in FIG. 8B, four through holes 290 (only three are illustrated) and four fitting ribs 270 (only three are illustrated) are provided on the apparatus-side bottom face wall portion 25*a*, corresponding to the number (four) of the cartridges 10 to be attached. Four terminal blocks 500 (only three are illustrated) are further disposed on the apparatus-side bottom face wall portion 25*a*, corresponding to the number of the cartridges 10 to be attached. The terminal block 500 is a base having a plurality of apparatus-side terminals, and may be also called "contact mechanism".

The through hole 290 is used by the optical detector 90 (FIGS. 5B and 5C), located below the holder 20, for detecting the remaining amount of ink in the cartridge 10. More specifically, the through hole 290 is formed to ensure transmission of the light emitted from the optical detector 90, as well as transmission of the light reflected from the cartridge 10.

The fitting rib 270 is tapered toward its end (in the +Z direction, i.e., upward direction in this embodiment). The fitting rib 270 is inserted and fit in the cutout groove 140 of the cartridge 10 (FIG. 5A), in order to align the cartridge 10. The fitting rib 270 is also called "positioning rib" or "control pin". The fitting rib 270 may be formed integrally with the holder 20 like this embodiment or may be provided as a separate member and attached to the apparatus-side bottom face wall portion 25*a*.

The holder 20 further has an apparatus-side engagement element 260 arranged adjacent to the engagement element-side face wall portion 25*b*. The apparatus-side engagement element 260 is located at a predetermined height from the apparatus-side bottom face wall portion 25*a*. The apparatus-side engagement element 260 engages with the engagement projection 124 of the cartridge 10 (FIG. 4B) to restrict the motion of the attached cartridge in the height direction.

As shown in FIG. 8C, the opposed face wall portion 25*c* has an upright wall element 216, guide grooves 200*t* and engagement holes 202 formed in the upright wall element 216. In the use orientation, the upright wall element 216 is extended in the +Z direction (upward direction in this embodiment) from the apparatus-side bottom face wall portion 25*a*. The upright wall element 216 includes an opposed face 216*u*, an extended face 216*t* and an upper face 216*s* in this sequence from the bottom. In the use orientation, the opposed face 216*u* is extended in the +Z direction (vertically upward direction in this embodiment) from the apparatus-side bottom face wall portion 25*a*. In other words, in the attached state of the cartridge 10 to the holder 20, the opposed face 216*u* forms a plane substantially parallel to the outer surface of the rear face 104 of the cartridge 10 (FIG. 4A). For the better understanding, the opposed face 216*u* is single-hatched.

The extended face 216*t* is extended toward outside of the holder 20 from the upper end of the opposed face 216*u*. In other words, in the attached state, the extended face 216*t* is extended in the direction away from the outer surface of the rear face 104 of the cartridge 10 (FIG. 4A). In this embodiment, the extended face 216*t* forms an inclined surface relative to the Z direction. The opposed face wall portion 25*c* further has a pivot 216*w* corresponding to the pivot 166*w* of the cartridge 10. The pivot 216*w* is defined by the boundary between the opposed face 216*u* and the extended face 216*t*. In other words, the pivot 216*w* is located at an end in the +Z direction (upper end in this embodiment) of the opposed face 216*u*.

In the use orientation of the holder 20, the upper face 216*s* is extended upward from the upper end of the extended face 216*t*. Like the extended face 216*t*, the upper face 216*s* is inclined relative to the Z direction.

As shown in FIG. 9, such arrangement of the opposed face 216*u*, the extended face 216*t* and the upper face 216*s* defines a space 216*sp*, which receives part of the cartridge 10 in the course of detachment of the cartridge 10 by pivotal rotation.

Referring back to FIGS. 8C and 8D, the engagement projection 160 of the cartridge 10 (FIG. 4A) is inserted into the substantially rectangular engagement hole 202. Such insertion restricts the motions of the cartridge 10 in the Y direction (width direction) and in the Z direction (height direction) within a preset range in the attached state. A width Wb in the Y direction of the engagement hole 202 is substantially equal to the width Wt in the Y direction of the engagement projection 160 of the cartridge 10. The cartridge 10 is attached to and detached from the holder 20 by pivotal rotation as discussed later. The clearance in the Z direction (height direction) between the engagement hole 202 of the holder 20 and the engagement projection 160 of the cartridge (FIG. 4C) is thus designed to be greater than the clearance in the Y direction (width direction) in the attached state.

In the process of attachment of the cartridge 10 to the holder 20, the guide groove 200*t* guides the engagement projection 160 to the engagement hole 202, while restricting the motion of the cartridge 10 in the Y direction (width direction). As shown in FIG. 8D, the guide groove 200*t* is extended from one end in the +Z direction (upper end in this embodiment) of the opposed face wall portion 25*c* to the engagement hole 202. For the better understanding, the engagement hole 202 is single-hatched.

A width Wa of an end portion 200*ta* in the +Z direction (upper end) of the guide groove 200*t* is greater than the width Wb in the Y direction of an end portion 200*tb* in the −Z direction (lower end). The width Wa of the end portion 200*ta* in the +Z direction (upper end) is greater than the width Wt in the Y direction of the engagement projection 160 of the cartridge 10 (FIG. 4C). The width in the Y direction of the guide groove 200*t* monotonously decreases from the end portion 200*ta* in the +Z direction (upper end) toward the end portion 200*tb* in the −Z direction (lower end) (i.e., toward the engagement hole 202). More specifically, the guide groove 200*t* includes a tapered lower guide groove 200*tu* having the width gradually decreasing toward the engagement hole 202. The broken line shows the boundary between the lower guide groove 200*tu* and the remaining part of the guide groove 200*t*.

As shown in FIG. 8C, the opposed face wall portion 25*c* further has deformable portions 212 that are elastically deformable in the depth direction (X-axis direction) of the guide grooves 200*t*. More specifically, the deformable portion 212 is formed by making cutouts 214 on both ends of a wall element 213 forming the bottom face of the guide groove 200*t*. This deformable portion 212 is extended from the lower end of the wall element 213, which is in contact with the engagement hole 202, to the higher position. More specifically, the deformable portion 212 is extended to the higher position than the intersection of the wall element 213 and the rotation trajectory of the engagement projection 160 (FIG. 5A) in the course of attachment of the cartridge 10. The details will be discussed later.

Figure 10:
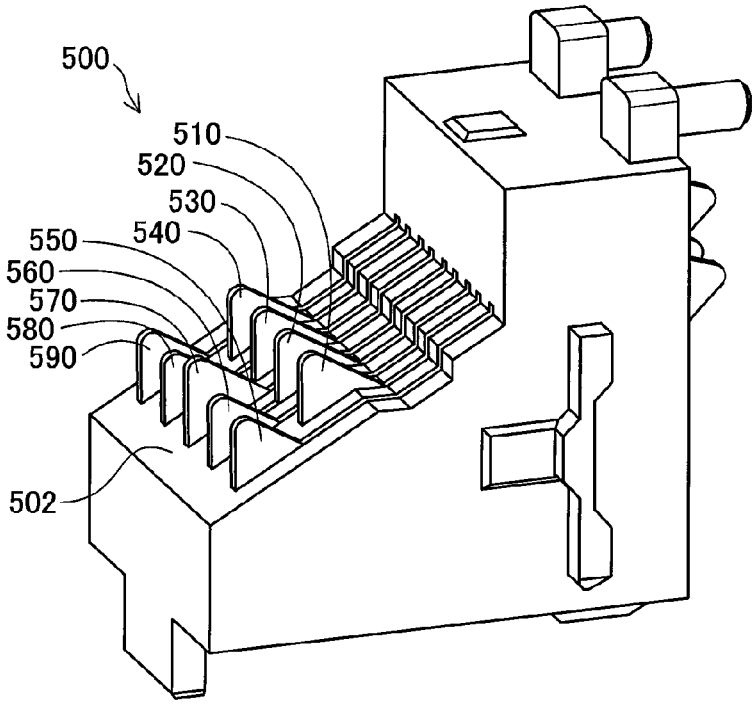
FIG. 10 is a perspective view of a terminal block.

FIG. 10 is a perspective view showing the terminal block 500 provided in the holder 20. A plurality of electric contact members 510 to 590 are provided on an inclined surface 502 of the terminal block 500. The inclined surface 502 is substantially parallel to the circuit board 400 (i.e., substantially parallel to the inclined surface of the board mount portion 180 shown in FIG. 3) in the normal attached state of the cartridge 10. The plurality of electric contact members 510 to 590 are equivalent to the apparatus-side terminals corresponding to the terminals 410 to 490 on the circuit board 400 (FIG. 6A). Each of the apparatus-side terminals 510 to 590 is made of a spring-loaded material (elastic material) and has elastic force, which presses back in an obliquely upward direction (i.e., direction between the −X direction and the +Z direction) against the pressing force of the corresponding one of the terminals 410 to 490. The elastic force of the apparatus-side terminals 510 to 590 actually acts in the oblique direction (i.e., direction between the −X direction and the +Z direction). The elastic force has a vector component in the +Z direction and can thus be regarded as the elastic force in the +Z direction. The pressing force in the oblique direction (i.e., direction between the −X direction and the +Z direction) actually acts on each of the terminals 410 to 490 pressed against the corresponding one of the apparatus-side terminals 510 to 590. This pressing force has a vector component in the +Z direction, so that it is regarded that the terminals 410 to 490 are pressed in the +Z direction. The apparatus-side ground terminal 570 located on the center of the lower row is protruded to a greater height in the +Z direction from the inclined surface 502 than the other apparatus-side terminals 510 to 560, 580 and 590. In the process of attachment of the cartridge 10 to the holder 20, this terminal 570 comes into contact with the corresponding board-side terminal before the other apparatus-side terminals do. In other words, among the terminals 410 to 490 on the circuit board 400 (FIG. 6A), the ground terminal 470 comes into contact with the corresponding apparatus-side terminal before the other board-side terminals do. As discussed previously with reference to FIG. 6A, the ground terminal 470 is longer in the −Z direction (i.e., attachment direction SD) than the other terminals. This arrangement enables the ground terminal 470 to reliably come into contact with the corresponding apparatus-side terminal, even when the ground terminal 470 comes into contact with the corresponding apparatus-side terminal prior to the other terminals on the circuit board 400.

Figure 11B:
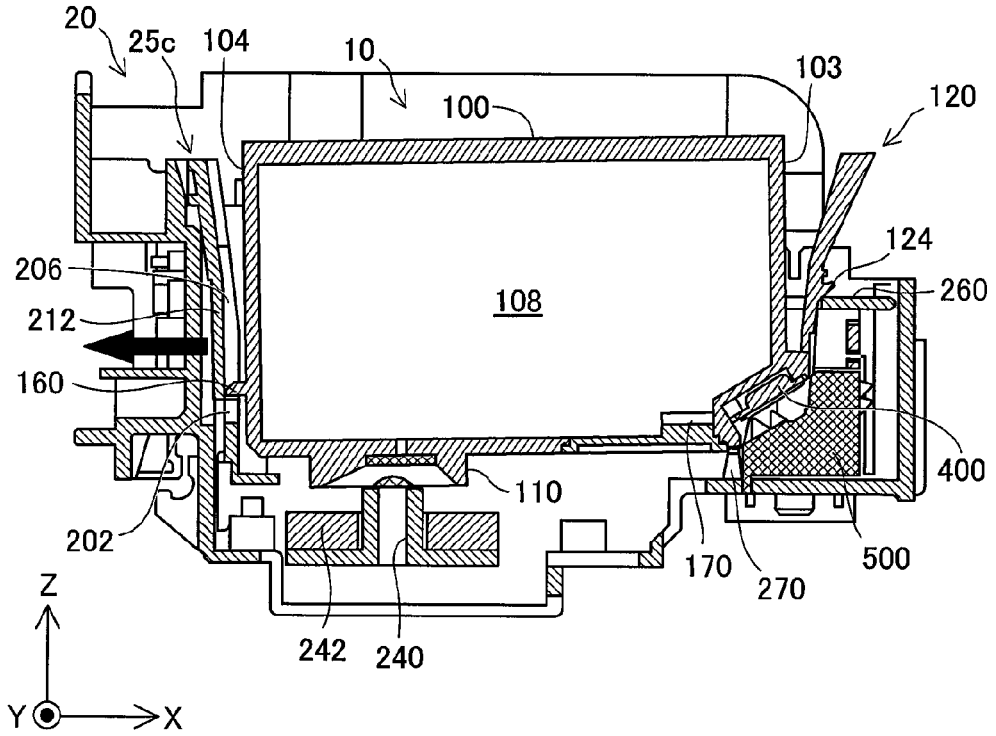

FIGS. 11A and 11B show attachment of the cartridge 10 to the holder 20. FIGS. 11A and 11B each shows a G-G cross section of the cartridge 10 shown in FIG. 4B and a cross section of the holder 20 corresponding to the G-G cross section. As shown in FIG. 11A, the standard attachment procedure tilts the cartridge 10 to bring the engagement projection 160 on its rear face 104 into contact with the opposed face wall portion 25*c* and attach the cartridge 10 to the holder 20. More specifically, the cartridge 10 is moved in the −Z direction (vertically downward direction in this embodiment) shown by the arrow SD, while inserting its engagement projection 160 into the guide groove 200*t* (FIG. 8D). Since the width Wa of the upper end of the guide groove 200*t* is greater than the width Wt of the engagement projection 160 of the cartridge 10, the engagement projection 160 is readily inserted into the guide groove 200*t*.

As shown in FIG. 11B, the engagement projection 160 of the cartridge 10 moves to the position coming into contact with the deformable portion 212 and applies an external force, whereby the deformable portion 212 elastically deforms outward (negative direction of the X axis or −X direction). The elastic deformation of the deformable portion 212 enables the cartridge 10 to be smoothly attached to the holder 20. The elastic deformation of the deformable portion 212 is, however, not essential. The attachment and the detachment of the cartridge may be implemented without the elastic deformation of the deformable portion 212.

FIGS. 12A and 12B further show attachment of the cartridge 10 to the holder 20. Like FIGS. 11A and 11B, FIG. 12A shows the G-G cross section of the cartridge 10 shown in FIG. 4B and the cross section of the holder 20 corresponding to the G-G cross section. FIG. 12B is a perspective view showing the periphery of the fitting rib 270 shown in FIG. 12A.

As shown in FIG. 12A, when the cartridge 10 is further moved in the −Z direction (vertically downward direction in this embodiment), the engagement projection 160 is guided along the guide groove 200*t* and is readily inserted into the engagement hole 202. In this state, the engagement projection 124 of the cartridge 10 does not engage with the apparatus-side engagement element 260 of the holder 20.

When the engagement projection 160 enters the engagement hole 202, as shown in FIG. 12B, the fitting rib 270 of the holder 20 is inserted and fit in the cutout groove 140 (fitting recess) of the cartridge 10. In this state, the front face 103 of the cartridge 10 is pressed in the −Z direction (vertically downward direction in this embodiment), so that the engagement projection 124 engages with the apparatus-side engagement element 260. During this press-in operation, the motion of the front face 103 of the cartridge 10 having the circuit board 400 attached thereto is restricted by the fit of the fitting rib 270 in the cutout groove 140. This arrangement ensures accurate positioning and alignment of the cartridge 10 relative to the holder 20. The accurate positioning and alignment reduces the possibility that a contact failure occurs between the respective elements 410 to 490 on the circuit board 400 of the cartridge 10 (FIG. 6A) and the corresponding apparatus-side terminals 510 to 590 on the terminal block 500 after the attachment.

As discussed previously with reference to FIG. 8D, the guide groove 200*t* is extended from the end in the +Z direction (upper end in this embodiment) of the opposed face wall portion 25*c* toward the engagement hole 202. The engagement projection 160 is thus readily guided along the guide groove 200*t* to the engagement hole 202. Especially the lower guide groove 200*tu* of the guide groove 200*t* contributes to smoothly guiding the engagement projection 160 into the engagement hole 202.

Figure 13A:
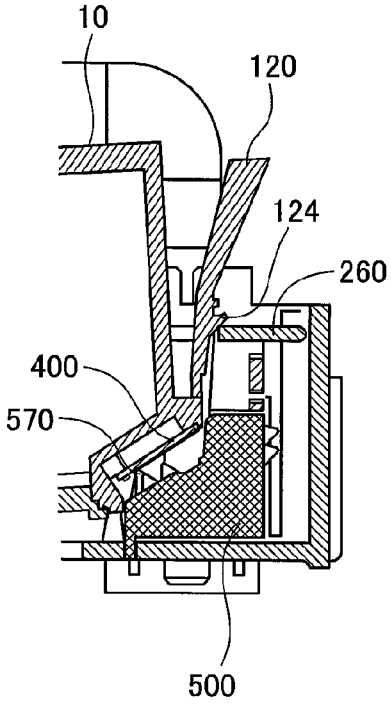
FIGS. 13A-13C show the state where apparatus-side terminals come into contact with board terminals in the course of attachment of the cartridge.
Figure 13B:
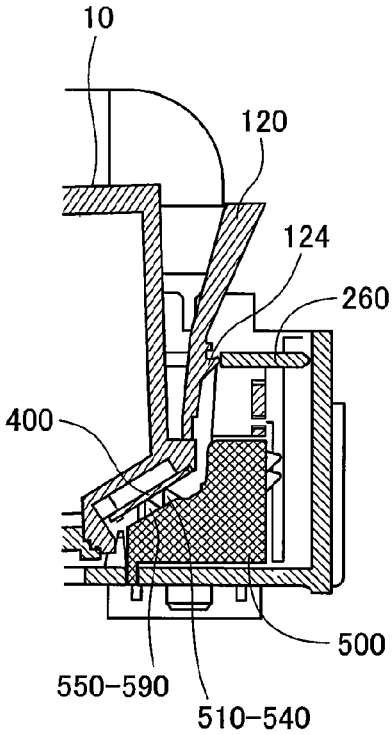
Figure 13C:
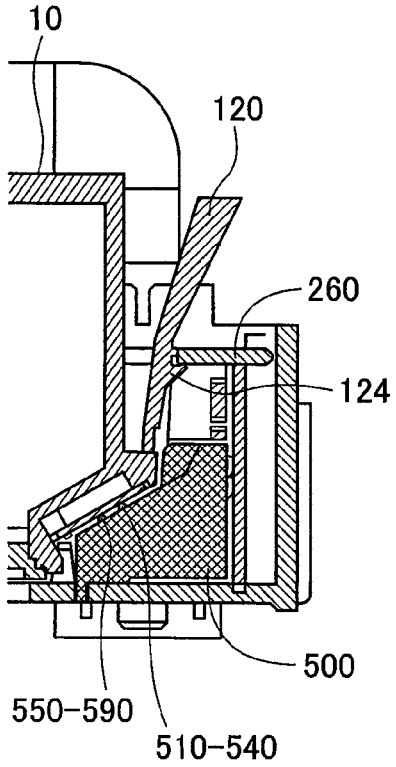

FIGS. 13A-13C show the process that the apparatus-side terminals 510 to 590 on the terminal block 500 come into contact with the corresponding terminals on the board 400 in the course of attachment of the cartridge 10. In the state prior to FIGS. 13A to 13C, the engagement projection 160 formed on the rear face (left end in the drawing) of the cartridge 10 has been inserted in the engagement hole 202 of the holder 20. The rear face of the cartridge 10 is, however, omitted from the illustration. FIG. 13A shows the state where only one of the apparatus-side terminals 510 to 590, i.e., the apparatus-side ground terminal 570, comes into contact with the corresponding ground terminal 470 on the board 400 (FIG. 6A). As discussed previously, this apparatus-side terminal 570 is protruded to the greater height in the +Z direction from the inclined surface 502 of the terminal block 500 (FIG. 10) than the other terminals 510 to 560, 580 and 590. In the state where only this apparatus-side terminal 570 comes into contact with the corresponding terminal on the board 400, the other apparatus-side terminals do not come into contact with the respective corresponding terminals on the board 400. As the user keeps pressing the cartridge 10, the other apparatus-side terminals 510 to 560, 580 and 590 come into contact with the respective corresponding terminals on the board 400 as shown in FIG. 13B. As the user further presses the cartridge 10, the cartridge 10 is fully attached to the holder 20 as shown in FIG. 13C. In this state, the engagement projection 124 of the lever 120 engages with a face in the −Z direction (lower face in this embodiment) of the apparatus-side engagement element 260, so as to prevent the motion of the cartridge 10 in the +Z direction (upward direction in this embodiment).

As explained above, among the plurality of terminals 410 to 490 on the circuit board 400, the ground terminal 470 first comes into contact with the corresponding apparatus-side terminal in the course of attachment of the cartridge 10. In the course of attachment of the cartridge 10, there is some possibility that some foreign substance, such as dust or ink, adheres to the terminal(s). Adhesion of the foreign substance to the terminal(s) may cause application of an unexpectedly high voltage from the high voltage terminal among the apparatus-side terminals 510 to 590 (for example, the apparatus-side attachment detection terminal 550) to the low voltage terminal among the terminals 410 to 490 on the circuit board 400 (for example, the terminal 420, 430, 460, 470 or 480). In the structure of this embodiment, however, the ground terminal 470 among the plurality of terminals 410 to 490 on the circuit board 400 first comes into contact with the corresponding apparatus-side terminal. Even in the case of external application of an unexpectedly high voltage to the circuit board 400, the grounding function of the ground terminal 470 immediately lowers the voltage level. This arrangement thus effectively reduces the possibility that an unexpectedly high voltage is applied to the circuit element on the circuit board 400 (e.g., the memory device 403).

FIGS. 14A-14E show various states where some foreign substance, such as dust or ink, adheres to the circuit board 400. As discussed previously with reference to FIG. 6A, the plurality of contact portions "cp" are arrayed in the two rows parallel to the Y direction on the circuit board 400. The lower row (first row on the −Z-direction side) includes the contact portion "cp" of the ground terminal 470, the first contact portions "cp" of the pair of high voltage terminals 450 and 490 and the second contact portions "cp" of the pair of first low voltage terminals 460 and 480. The upper row (i.e., the second row on the +Z-direction side) includes the third contact portions "cp" of the pair of overvoltage detection terminals 410 and 440 and the fourth contact portions "cp" of the second low voltage terminals 420 and 430. In the upper row (second row), the third contact portions "cp" of the pair of overvoltage detection terminals 410 and 440 are located at the outer most positions. The fourth contact portions "cp" of the second low voltage terminals 420 and 430 are located between the third contact portions "cp" of the pair of overvoltage detection terminals 410 and 440. The third contact portion "cp" of the overvoltage detection terminal 410 (or 440) is arranged to be located in the Y direction between the first contact portion "cp" of the high voltage terminal 450 (or 490) and the second contact portion "cp" of the adjacent first low voltage terminal 460 (or 480). This arrangement of the contact portions "cp" has the following advantageous effects when some foreign substance, such as dust or ink, adheres to the circuit board 400 in the various states shown in FIGS. 14A to 14E.

Figure 14A:
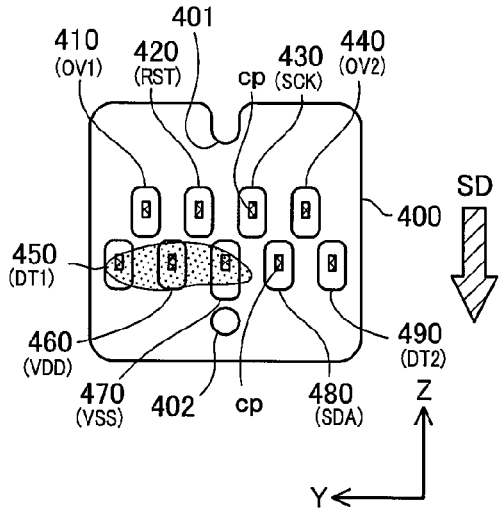
FIGS. 14A-14E show various states of adhesion of foreign substances to the circuit board.

FIG. 14A shows the state where foreign substance adheres over the high voltage terminal 450, the low voltage terminal 460 and the ground terminal 470 in the lower row. According to the positional relation in the Y direction, the contact portion "cp" of the low voltage terminal 460 is located between the contact portion "cp" of the high voltage terminal 450 and the contact portion "cp" of the ground terminal 470. Even when dust or ink adheres across the high voltage terminal 450 and the low voltage terminal 460 to apply a high voltage to the low voltage terminal 460 as in the state of FIG. 14A, the contact portion "cp" of the ground terminal 470 comes into contact with the corresponding apparatus-side ground terminal prior to the other board-side terminals 450 and 470. This arrangement reduces the possibility that an unexpected high voltage is applied to the low voltage terminal 460, thus protecting the circuitry connected with the low voltage terminal 460 from being damaged or destroyed.

Figure 14B:
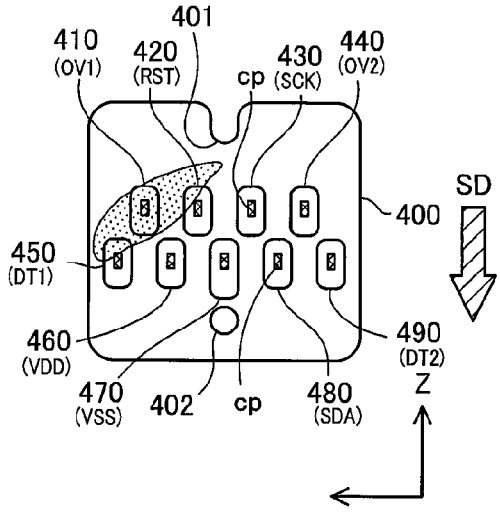

FIG. 14B shows the state where foreign substance adheres over the high voltage terminal 450, the overvoltage detection terminal 410 and the low voltage terminal 420. According to the positional relation in the Y direction, the contact portions "cp" of the pair of overvoltage detection terminals 410 and 440 are located between the contact portions "cp" of the pair of high voltage terminals 450 and 490. The contact portions "cp" of the low voltage terminals 420, 430, 460 and 480 are located between the contact portions "cp" of the pair of overvoltage detection terminals 410 and 440. Even when dust or ink adheres across the high voltage terminal 450 and the low voltage terminal 420 to apply a high voltage to the low voltage terminal 420 as in the state of FIG. 14B, the overvoltage detection terminal 410 interposed between the high voltage terminal 450 and the low voltage terminal 420 detects the state of overvoltage application and stops the application of high voltage. This arrangement reduces the possibility that an unexpected high voltage is applied to the low voltage terminal 420, thus protecting the circuitry connected with the low voltage terminal 420 from being damaged or destroyed. In the case where the low voltage terminal 420 is connected with a memory device, this arrangement protects the memory device from being damaged.

Figure 14C:
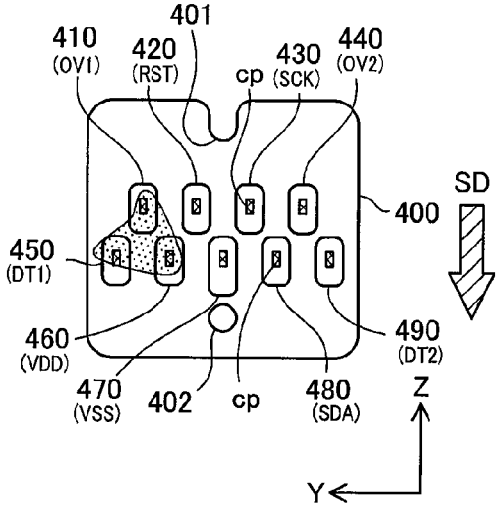

FIG. 14C shows the state where foreign substance adheres over the high voltage terminal 450, the overvoltage detection terminal 410 and the low voltage terminal 460. In this state, because of the same reason explained above with regard to the state of FIG. 14B, the terminal arrangement reduces the possibility that an unexpected high voltage is applied to the low voltage terminal 460, thus protecting the circuitry connected with the low voltage terminal 460 from being damaged or destroyed.

Figure 14D:
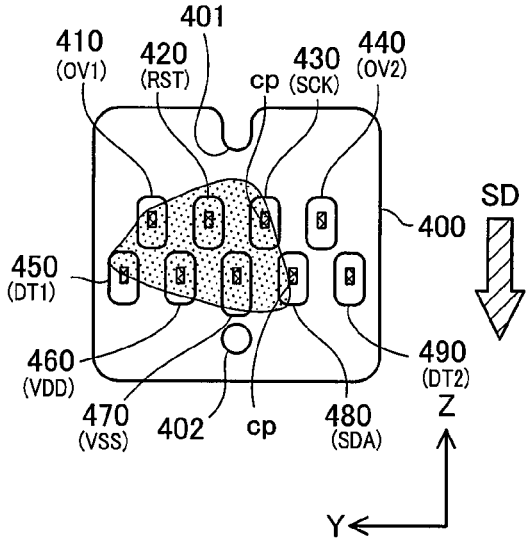

FIG. 14D shows the state where foreign substance adheres over a wide area including the high voltage terminal 450, the overvoltage detection terminal 410, the low voltage terminals 420, 430, 460 and 480 and the ground terminal 470. In this state, because of the same reason explained above with regard to the state of FIG. 14B, the terminal arrangement reduces the possibility that an unexpected high voltage is applied to any of the low voltage terminals 420, 430, 460 and 480, thus protecting the circuitry connected with any of the low voltage terminals 420, 430, 460 and 480 from being damaged or destroyed.

Dust or ink may adhere to the circuit board 400 in various directions and over various areas. As discussed above in the states of FIGS. 14B to 14D, when dust or ink adheres across the high voltage terminal and the low voltage terminal, there is a high probability that the adhesion area of dust or ink includes the overvoltage detection terminal 410 (or 440). The effects discussed above with reference to FIG. 14B to FIG. 14D are thus expected with significantly high probability.

Figure 14E:
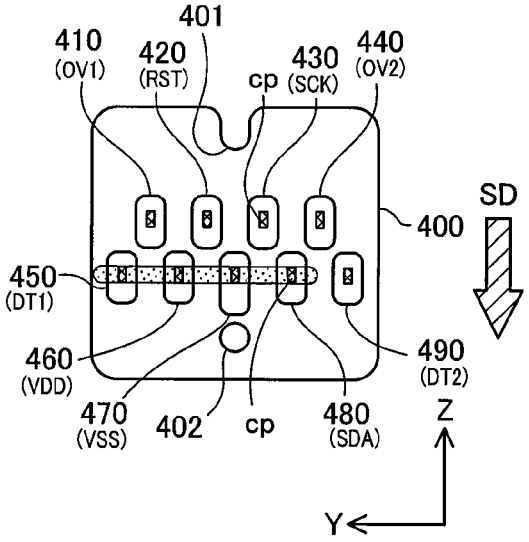

FIG. 14E shows the state where long, thin foreign substance adheres over the high voltage terminal 450, the low voltage terminals 460 and 480 and the ground terminal 470 in the lower row. In the case where dust adheres to a substantially straight area in the Y direction that does not include the overvoltage detection terminal 410 (or 440), the effects discussed above with reference to FIG. 14B to FIG. 14D are not expected. For example, a long thin metal strip like a staple may adhere across the high voltage terminal 450 and the low voltage terminals 460 and 480 but not across the overvoltage detection terminal 410 (or 440). There is, however, a high probability that the adhesion area of such long, thin dust includes the ground terminal 470. As long as the adhesion area of dust covers the ground terminal 470, the arrangement of causing the ground terminal 470 to come into contact with the corresponding apparatus-side ground terminal 570 prior to the other board-side terminals effectively lowers the possibility that an unexpectedly high voltage is applied to the low voltage terminals 460 and 480.

As discussed above, even when dust or ink adheres to the circuit board 400 in any of these states, the terminal arrangement prevents the circuitry from being damaged (or prevents the memory device from being damaged when the low voltage terminal is connected with the memory device) by application of an unexpectedly high voltage, with significantly high probability.

Adhesion of dust or ink may cause a short circuit between the high voltage terminal and the low voltage terminal and lead to apply an unexpectedly high voltage to the low voltage terminal. Apparently there seems to be no need to give consideration to the positional relation of the "contact portions", as long as the positional relation of the "terminals" on the circuit board is adequately determined. In the actual state, however, small clearances are present between the contact portions on the circuit board and the terminals on the printing apparatus and their peripheries and tend to suck the ink by capillarity. When the contact portions on the circuit board come into contact with the terminals on the printing apparatus, the friction-induced static electricity tends to suck the dust. As such, it is important to give consideration to the positional relation of the contact portions on the circuit board. As long as sufficient consideration is given to the positional relation of the contact portions on the circuit board, there is a certain degree of freedom in designing the shapes of the terminals including the contact portions. This increases the degree of freedom in designing the shapes of the terminals on the circuit board. For example, as discussed later with reference to FIGS. 30A-30C, only the shapes of the terminals may be changed, while the positional relation of the contact portions is kept in the same state as FIG. 6A.

The shapes and the arrangement of the terminals 410 to 490 and their contact portions "cp" on the circuit board 400 shown in FIGS. 6A and 14A-14E may be modified or altered in various ways. In another embodiment, part of the plurality of terminals 410 to 490 (for example, the low voltage terminals 420, 430, 460 and 470) may be omitted. More specifically, one of the multiple low voltage terminals may be omitted from each of the upper row and the lower row, so that only one low voltage terminal may remain in each of the upper row and the lower row. In another embodiment, the plurality of terminals and their contact portions may be aligned or may be arrayed in three or more rows on the circuit board 400. The terminals and their contact portions may be not arranged in rows but may be placed according to another pattern or arrangement.

The present embodiment has various features which are devised to ensure attachment of the cartridge in the correct orientation or alignment. The ground terminal 470 is located at such a position that intersects with the CA plane in the state of the circuit board 400 fixed to the cartridge 10 (FIGS. 4B and 4D). This CA plane is defined by the central axis C and the axis A which goes through the central axis C of the ink supply pipe 240 of the holder or cartridge attachment section 20 (FIG. 4A) and which is parallel to the X axis. The ground terminal 470, whose contact portion first comes into contact the corresponding apparatus-side terminal, is located on the center of the width in the Y direction of the cartridge 10 (i.e., in the Y direction of FIG. 4B). The force applied from the apparatus-side ground terminal 570 to the ground terminal 470 and the cartridge 10 accordingly acts on the center of the width of the cartridge 10. In other words, substantially no force is applied from the apparatus-side ground terminal 570 to tilt the cartridge 10 leftward or rightward. This arrangement thus ensures attachment of the cartridge 10 in the correct orientation. In this embodiment, when the cartridge 10 is viewed from its front side (FIG. 4B), the contact portion of the ground terminal 470 on the circuit board 400 overlaps the axis 110*x* in the Z direction going through the center of the ink supply port 110 (FIG. 4A). The force in the +Z direction (upward direction in this embodiment) is applied from the ink supply pipe 240 and the elastic member 242 of the holder 20 (FIG. 7) to the ink supply port 110. Since the contact portion of the ground terminal 470 on the circuit board 400 overlaps the axis 110*x* in the Z direction going through the center of the ink supply port 110, the ink supply port 110 as well as the ground terminal 470 receives the force applied from the apparatus-side ground terminal 570 on the center of the width in the Y direction of the cartridge 10 in the course of attachment of the cartridge 10. Accordingly, substantially no force acts to tilt the cartridge 10 in the ±Y directions (leftward and rightward directions in this embodiment) about the X axis or about the Z axis in the middle of attachment of the cartridge 10. The cartridge 10 may thus be attached to the holder 20 in the correct orientation or alignment.

Figure 15A:
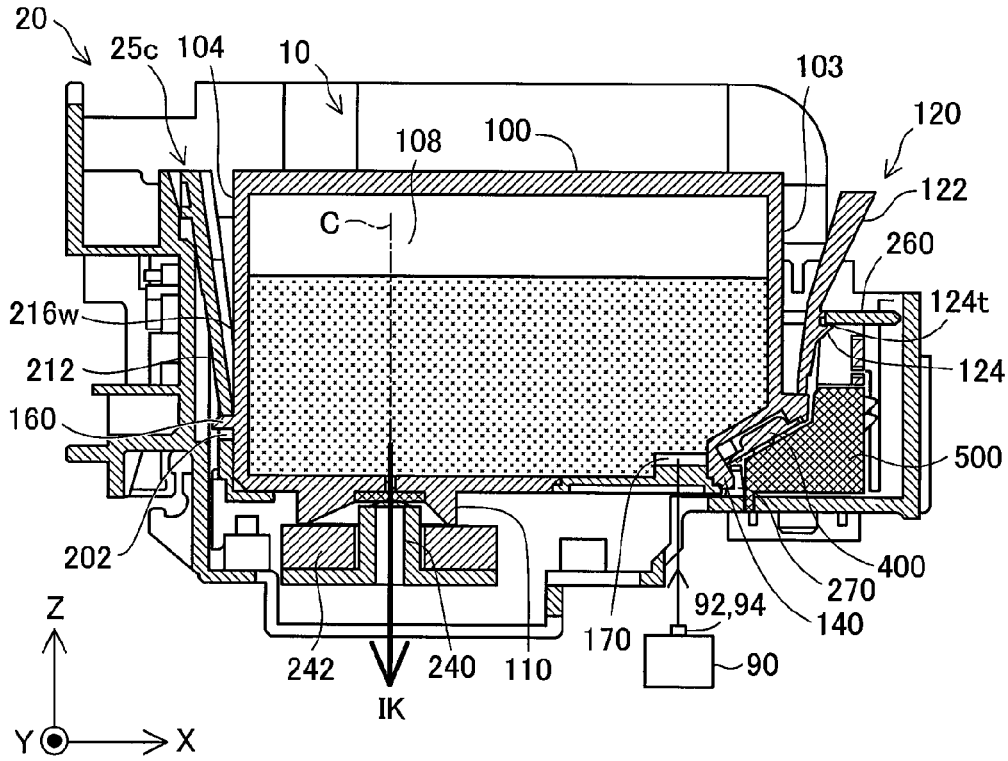
FIGS. 15A and 15B show the cartridge in the attached state.
Figure 15B:
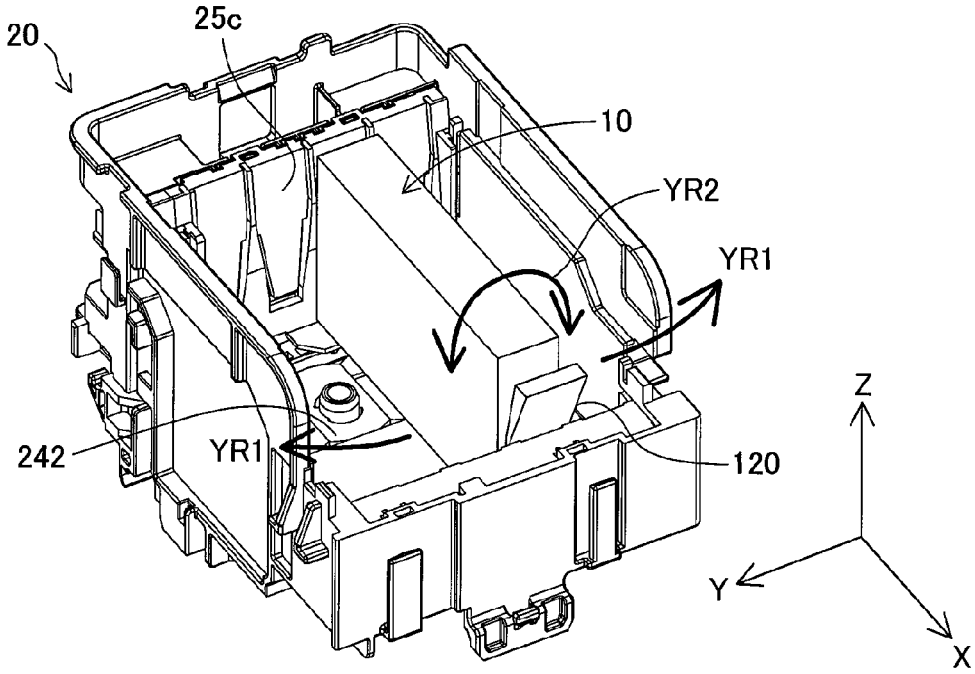

FIGS. 15A and 15B are explanatory diagrams of the cartridge in the attached state. Like FIGS. 11A and 11B, FIG. 15A shows the G-G cross section of the cartridge 10 shown in FIG. 4B and the cross section of the holder 20 corresponding to the G-G cross section. FIG. 15B is a perspective view of the cartridge 10 in the attached state. The dotted area of FIG. 15A represents ink stored in the ink chamber 108. As shown in FIG. 15A, in the attached state, the engagement projection 124 of the lever 120 engages with the apparatus-side engagement element 260, so as to restrict the motion of the cartridge 10 in the height direction. With regard to the Z direction (vertical direction in this embodiment) of the holder 20 in the use orientation, the pivot 216*w* of the opposed face wall portion 25*c* is further down in the −Z direction (vertically downward direction in this embodiment) than an engagement point 124*t*. When engaged with the apparatus-side engagement element 260, the lever 120 is closer to the front face 130 than it is in the released or free state. The lever 120 presses the ink container body 100 towards the opposed face wall portion 25*c*, so as to restrict the motion of the cartridge 10 in the X direction (length direction). In the attached state, the ink supply pipe 240 of the printing apparatus is connected with the ink supply port 110 of the cartridge 10. The terminals on the circuit board 400 come into contact with the respective corresponding terminals on the terminal block 500, so that various pieces of information, for example, information on the ink color and the remaining amount of ink, are transmittable between the cartridge 10 and the controller 40 of the printing apparatus (FIG. 1). The remaining amount of ink is detected by the optical detector 90 at predetermined timings. In the attached state, ink is supplied from the cartridge 10 through the ink supply port 110 and the ink supply pipe 240 to the print head 32 by means of suction from the print head 32.

In the attached state, the motions of the cartridge 10 are restricted mainly by the engagement hole 202, the apparatus-side engagement element 260 and the fitting rib 270 of the holder 20. More specifically, the engagement hole 202 restricts the motions of the cartridge 10 both in the Y direction (width direction) and in the Z direction (height direction), while the apparatus-side engagement element 260 restricts the motion in the height direction and the fitting rib 270 restricts the motion in the width direction.

As explained previously, in the course of attachment of the cartridge 10 to the holder 20, there is some possibility that the cartridge 10 is tilted in the ±Y directions about the Z axis (directions of arrow YR1) or in the ±Y directions about the X axis (directions of arrow YR2). Such tilt of the cartridge 10 may be reduced to a certain extent by adequately positioning the ground terminal 470 whose contact portion first comes into contact with the corresponding apparatus-side terminal, but that may not fully prevent such tilt of the cartridge 10. During a printing operation, the holder 20 and the cartridge 10 move in the main scanning direction (Y direction or width direction of the cartridge 10). This means that an external force (force of inertia) in the Y direction (width direction) is applied to the cartridge 10. As shown in FIG. 15B, the cartridge 10 is rotated in a rotating direction including a Y-direction (width-direction) component about the ink supply port 110 (FIG. 15A) by application of the external force. More specifically, the cartridge 10 may be rotated in the ±Y directions about the Z axis (directions of arrow YR1) or in the ±Y directions about the X axis (directions of arrow YR2). It should be noted that the circuit board 400 is located on the front face 103-side. It should be further noted that the cutout groove 140 for restricting the motion in the Y direction (width direction) is formed at such a position in the X direction that is not on the rear face 104-side close to the ink supply port 110 but on the front face 103-side away from the ink supply port 110; this arrangement effectively prevents the circuit board 400 from being moved or shifted relative to the holder 20, compared with the arrangement where the cutout groove 140 is formed on the rear face 104-side. This arrangement makes substantially no force which acts to tilt the cartridge 10 in the ±Y directions (leftward and rightward directions in this embodiment) about the X axis or about the Z axis, thus ensuring attachment of the cartridge 10 in the correct orientation with higher accuracy. This arrangement also enables the electric connection between the circuit board 400 and the printing apparatus to be kept favorably in the attached state. As mentioned previously, the circuit board 400 is located so as to partly overlap with the cutout groove 140 when being projected in the Z direction (FIG. 4A) in this embodiment. Accordingly, the fit of the fitting rib 270 in the cutout groove 140 minimizes the motion or shift of the circuit board 400 relative to the holder 20.

If a groove is provided in the central area of the bottom face 101 to restrict the motion of the cartridge 10 in the width direction, some member for forming or defining the groove is required in the periphery of the groove. In this embodiment, the cutout groove 140 (engagement recess) is formed at an end of the bottom face 101 to restrict the motion in the Y direction (width direction). This arrangement contributes to size reduction of the cartridge 10 in the X direction (length direction).

The fit of the fitting rib 270 in the cutout groove 140 has the additional effect of restricting the motion of the prism 170 in the Y direction (width direction). In this embodiment, the prism 170 is located at an end proximate to the front face 103 on the inner surface of the bottom face 101. More specifically, the prism 170 is located to be in contact with the inner surface of the bottom face 101 having the cutout groove 140 (FIG. 5A). This arrangement minimizes the positional shift of the prism 170 in the Y direction (width direction) and ensures accurate detection of the remaining amount of ink. This arrangement also lowers the possibility that the prism 170 blocks the flow of ink toward the ink supply port 110, thus ensuring efficient ink consumption in the ink chamber 108 and reducing the amount of ink retention in the ink chamber 108.

The structure of this embodiment more effectively lowers the possibility that the cutout groove 140 interferes with the holder 20 in the process of attachment or detachment of the cartridge 10 to or from the holder 20, compared with the structure that the cutout groove 140 is replaced by a fitting projection and the fitting rib 270 is replaced by a fitting recess. The structure of this embodiment accordingly reduces the potential for damage or failure of the cartridge 10 or the holder 20.

Figure 16A:
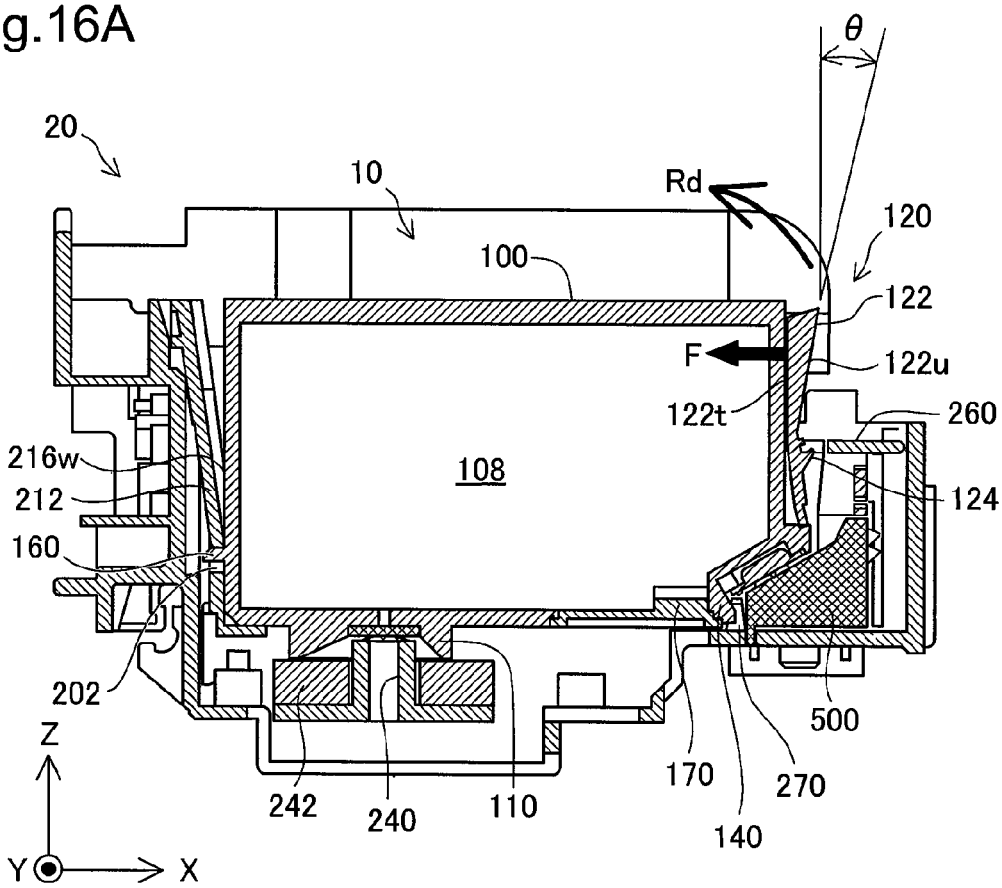
FIG. 16A-16D show detachment of the cartridge from the holder.

FIGS. 16A-16D are explanatory diagrams showing a process of detachment of the cartridge 10 from the holder 20. FIG. 16A shows the G-G cross section of the cartridge 10 shown in FIG. 4B and the cross section of the holder 20 corresponding to the G-G cross section. When the cartridge 10 is to be detached from the holder 20, the engagement release element 122 is elastically deformed in the direction toward the ink container body 100 (negative direction of the X axis or −X direction). This disengages the engagement projection 124 from the apparatus-side engagement element 260. The engagement release element 122 is arranged, such that the second side face 122*u* is inclined by a preset angle θ relative to the Z direction when the first side face 122*t* abuts against the front face 103. Such arrangement of the engagement release element 122 allows for easy disengagement of the engagement projection 124 from the apparatus-side engagement element 260 by application of an external force in the −X direction to the engagement release element 122 and ensures efficient detachment of the cartridge 10 from the holder 20. This reason is discussed with reference to FIG. 16B.

Figure 16B:
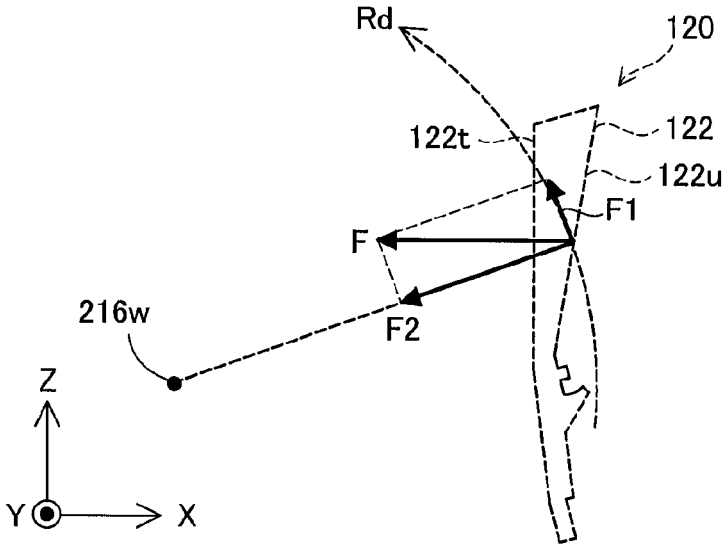

Assume, as shown in FIG. 16B, that an external force F is applied to the engagement release element 122 in a direction toward the container body or ink container body 100 (negative direction of the X axis or −X direction) to disengage the engagement projection 124 from the apparatus-side engagement element 260. The external force F is resolved into a tangential component F1 and a radial component F2 of a circle about the pivot 216*w* of the opposed face wall portion 25*c*. If the second side face 122*u* is inclined (downward inclination) such that the lower end of the face 122*u* is closer to the pivot 216*w* in the X direction than its upper end is, this inclination ensures efficient transmission of the tangential component F1 to the engagement release element 122. Application of an external force to the engagement release element 122 in the direction (the −X direction) of disengaging the engagement projection 124 from the apparatus-side engagement element 260 enables the cartridge 10 to be readily rotated in its detachment direction (shown by the arrow Rd), while releasing the engagement.

Figure 16C:
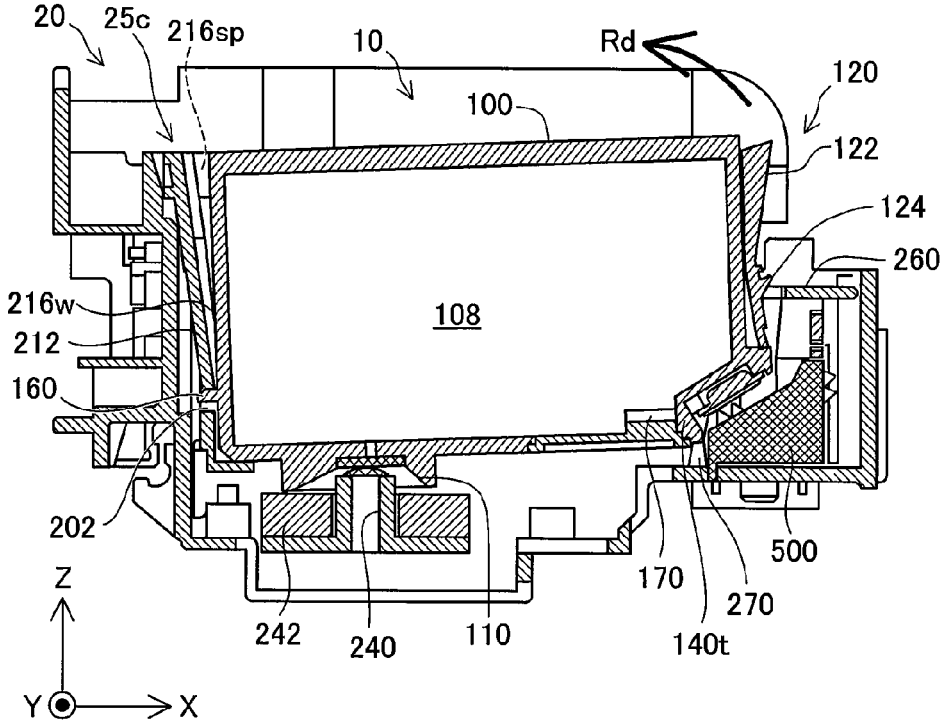
Figure 16D:
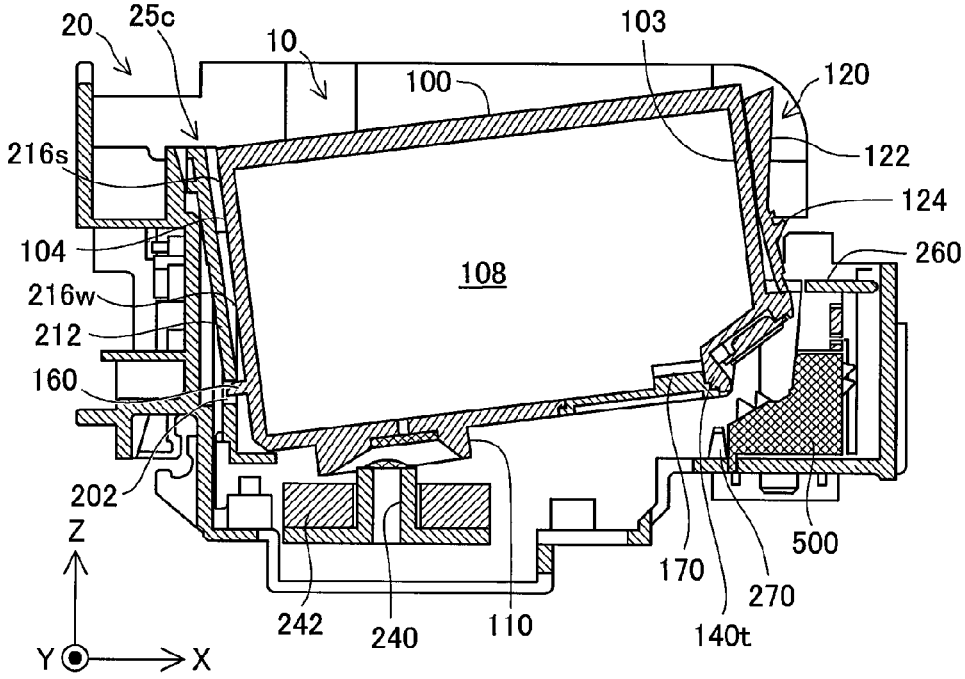

FIGS. 16C and 16D show pivotal rotation of the cartridge 10 about the pivot 216*w* of the opposed face wall portion 25*c* in the course of detachment of the cartridge 10 from the holder 20. Like FIG. 16A, FIGS. 16C and 16D show the G-G cross section of the cartridge 10 shown in FIG. 4B and the cross section of the holder 20 corresponding to the G-G cross section. As shown in FIG. 16C, when a specific-direction component (−X-direction component) of the external force F is applied to the engagement release element 122, the cartridge 10 is rotated in the direction of the arrow Rd about the pivot 216*w* of the opposed face wall portion 25*c*. Since the space 216*sp* is present on the +Z-direction side (on the upper side) of the pivot 216*w*, the holder 20 does not interfere with the rotating motion of the cartridge 10.

With progress of the rotating motion, the rear face 104 of the cartridge 10 abuts against the upper face 216*s* as shown in FIG. 16D. In this state, the rotating motion is interfered with by the upper face 216*s*. The front face 103 side of the cartridge 10 is, however, lifted up in the +Z direction (vertically upward direction in this embodiment) relative to the holder 20 to such an extent that the user may readily grab and pick up the front face 103 side of the cartridge 10.

As discussed above, the pivot 216*w* is further down in the −Z-direction (vertically downward direction in this embodiment) than the engagement point 124*t*, while the engagement release element 122 is further in the +Z direction (vertically upward direction in this embodiment) than the engagement point 124*t* (FIG. 15A). By applying the external force F in the specific direction (−X direction) to the engagement release element 122 as shown in FIG. 16A, the cartridge 10 is rotated about the pivot 216*w* and readily detached from the holder 20. The disengagement of the engagement projection 124 from the apparatus-side engagement element 260 and the detachment of the cartridge 10 from the holder 20 may thus be implemented by the sequential actions (FIGS. 16A to 16D). This arrangement enhances the user's convenience of detaching the ink cartridge 10 from the holder 20. The pivot 216*w* of the holder 20 is readily defined by the opposed face 216*u* and the extended face 216*t* of the opposed face wall portion 25*c*.

B. Second Embodiment

Figure 17:
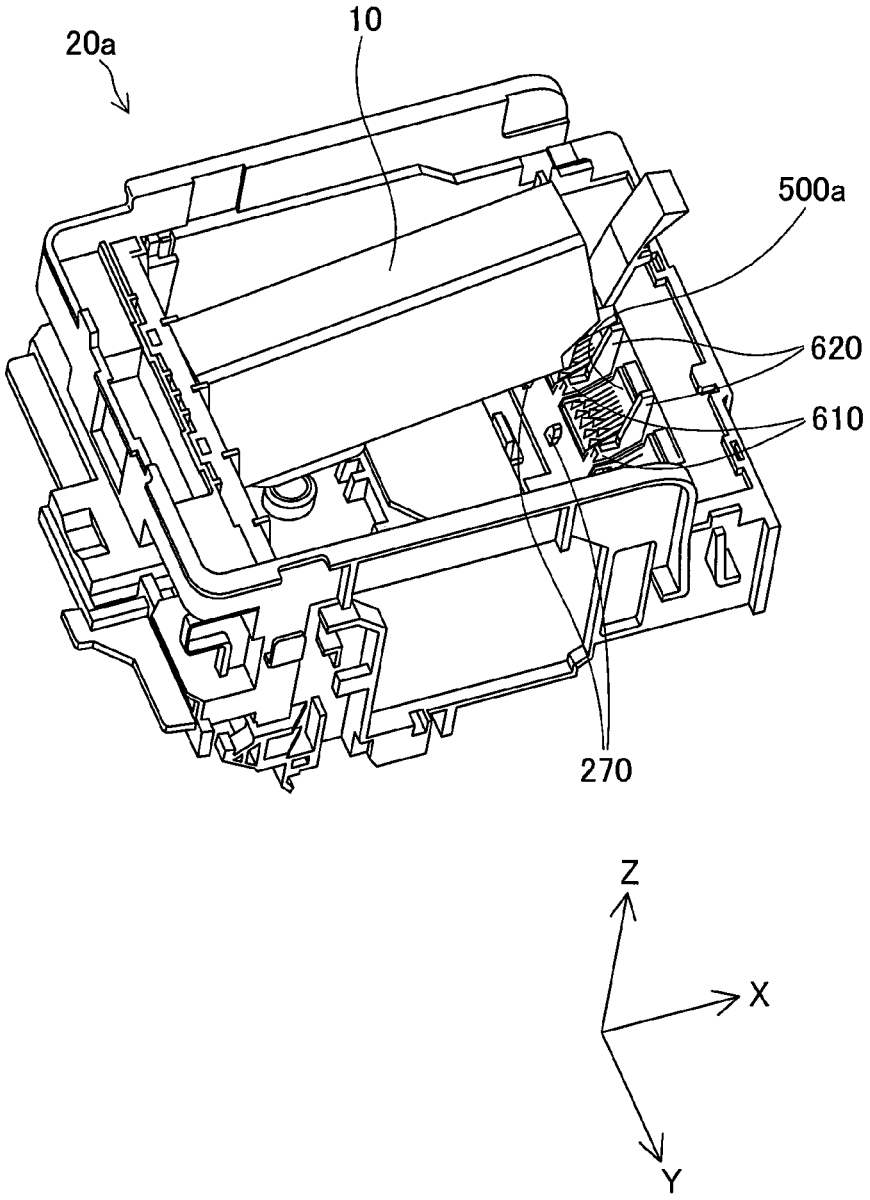
FIG. 17 is a perspective view of a holder according to a second embodiment of the invention.

FIG. 17 shows the structure of a holder 20*a* according to a second embodiment. The general structure of the printing apparatus and the structure of the ink cartridge 10 of the second embodiment are the same with those of the first embodiment. FIG. 17 shows the state in the middle of insertion of the cartridge 10 to the holder 20*a*. A pair of longitudinal guide members 610 (first sub-guide members) and a pair of lateral guide members 620 (second sub-guide members) are provided, in addition to the fitting rib 270, in the vicinity of a terminal block 500*a* located in each slot of the holder 20*a*. As discussed above in the first embodiment, the fitting rib 270 also serves as the guide member to guide the cartridge 10.

The pair of lateral guide members 620 are located such that the inner surfaces of the pair of lateral guide members 620 are in contact with the outer surfaces of the pair of lateral guide wall members 184 of the cartridge 10 (FIG. 3). In the process of attaching the cartridge 10 to the holder 20*a*, the outer surfaces of the pair of lateral guide wall members 184 of the cartridge 10 are guided by the inner surfaces of the pair of lateral guide members 620, so that the insertion path of the cartridge 10 is guided. More specifically, this guiding operation controls the position of the cartridge 10 in the Y direction (left-right direction in this embodiment). Left and right faces of each lateral guide member 620 (left side face and right side face seen from the front side in the −X direction) are used to guide two adjacent cartridges in the lateral direction. Five lateral guide members 620 are accordingly provided for four cartridges 10 in the holder 20*a*. The "pair of lateral guide members 620" denotes that there are two lateral guide members 620 which are used for one cartridge 10.

The pair of longitudinal guide members 610 are located at the positions corresponding to the pair of longitudinal guide wall members 182 of the cartridge 10 (FIG. 3). In the process of attaching the cartridge 10 to the holder 20*a*, the lower edges of the pair of longitudinal guide wall members 182 come into contact with the upper edges of the pair of longitudinal guide members 610, so that the insertion path of the lower front end of the cartridge 10 is guided. This guiding operation enables the cartridge 10 to go down via the correct insertion path that the plurality of terminals 410 to 490 on the circuit board 400 come into contact with the corresponding apparatus-side terminals 510 to 590 on the terminal block 500*a*. In other words, this guiding operation guides the downward trajectory of the lower front end of the cartridge 10 within the plane parallel to both the Z direction (vertical direction in this embodiment) and the X direction (front-rear direction of the cartridge 10 in this embodiment). As discussed later, the guiding operation by the pair of longitudinal guide members 610 is preferably performed subsequent to the guiding operation by the pair of lateral guide members 620.

Figure 18:
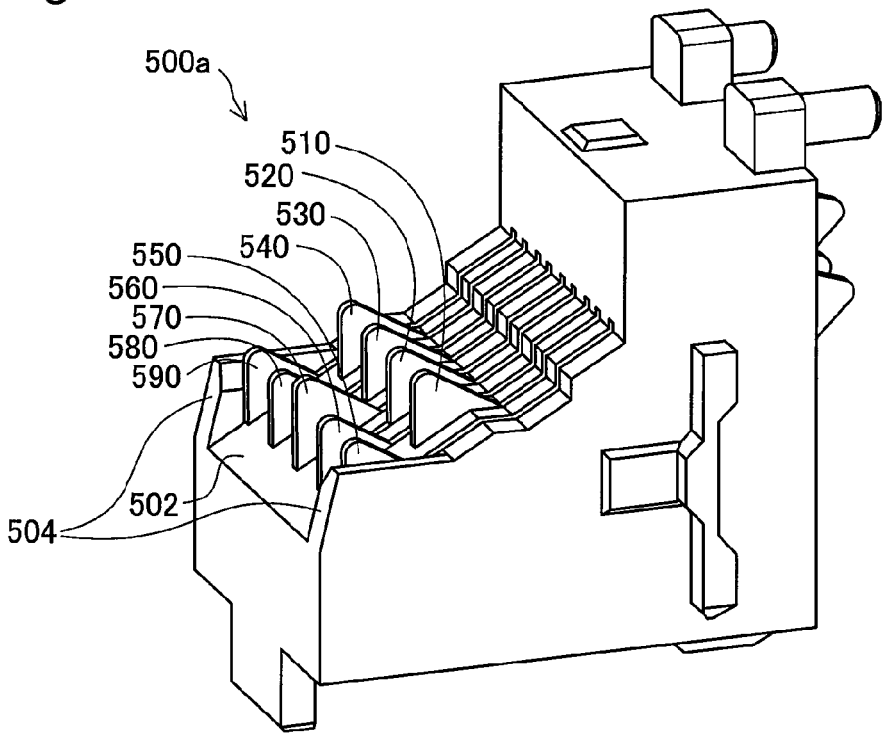
FIG. 18 is a perspective view of a terminal block according to the second embodiment.

FIG. 18 is a perspective view showing the structure of the terminal block 500*a* according to the second embodiment. The terminal block 500*a* has such a structure that a pair of board guide members 504 are added at the positions of opposite side faces of the terminal block 500 according to the first embodiment (FIG. 10). In other words, the pair of board guide members 504 are located on both sides of the group of the apparatus-side terminals 510 to 590. The pair of board guide members 504 are located at the positions corresponding to the cutouts 186 of the board mount portion 180 of the cartridge 10 (FIG. 3). As discussed later, in the process of attaching the cartridge 10 to the holder 20*a*, the side faces of the circuit board 400 are guided between the pair of board guide members 504, so that the position of the cartridge 10 is controlled in the Y direction (width direction or left-right direction). The inner surfaces of respective ends in the +Z direction (upper ends) of the pair of board guide members 504 are preferably tapered. This is because the tapered surfaces readily guide the side faces of the circuit board 400.

Figure 19:
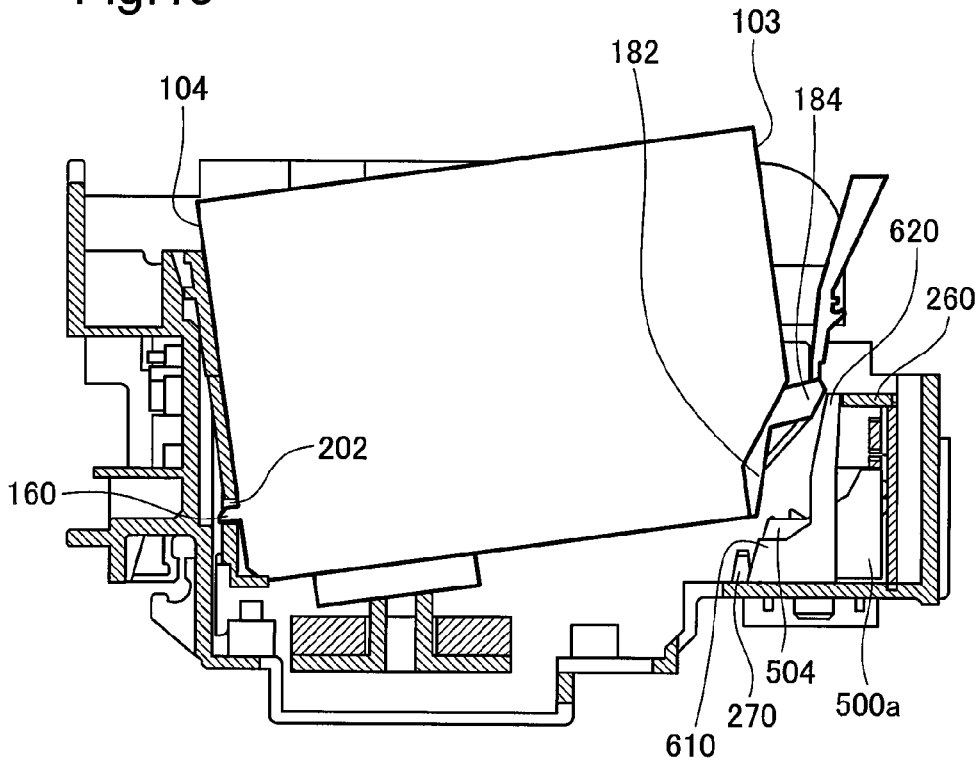
FIG. 19 shows one example of positional relation of four types of guide members.

FIG. 19 shows one example of positional relation of the four types of guide members 270, 610, 620 and 504 discussed above with reference to FIGS. 17 and 18. The pair of lateral guide members 620 are located at the farthest position in the +Z direction (highest position) among these guide members 270, 610, 620 and 504. The pair of lateral guide members 620 start guiding the cartridge 10 prior to the other guide members 270, 610 and 504. The pair of longitudinal guide members 610 are located further down in the −Z direction (lower position) from the pair of lateral guide members 620. The pair of board guide members 504 provided on the terminal block 500*a* are located further up in the +Z direction (higher position) from the pair of longitudinal guide members 610. In another embodiment, the positional relation (height relation) in the ±Z directions between the board guide members 504 and the longitudinal guide members 610 may be reversed. The fitting rib 270 is located at the farthest position in the −Z direction (lowest position) among the guide members 270, 610, 620 and 504.

As described in detail below, the different types of guide members 270, 610, 620 and 504 shown in FIGS. 17 to 19 successively guide the cartridge 10 in a preset sequence in the course of attachment of the cartridge 10. Such sequential guiding operations prevent the cartridge 10 from being extremely tilted to inadequate orientation or alignment in the ±Y directions (i.e., ±Y directions about the Z axis or ±Y directions about the X axis, leftward and rightward directions in this embodiment) in the course of attachment, thereby implementing attachment of the cartridge 10 in the right attachment place while keeping the adequately correct orientation or alignment. The first embodiment does not use the guide members 610, 620 and 504 for the guiding operations, while using the fitting rib 270 for the guiding operations. As discussed in the first embodiment, the force applied from the apparatus-side ground terminal 570 to the cartridge 10 in the process of attachment of the cartridge 10 acts on the center of the width in the Y direction of the board 400 and on the approximate center of the width in the Y direction of the cartridge 10. Accordingly, it is reasonably presumed that substantially no force acts to tilt the cartridge 10 in the ±Y directions in the course of attachment of the cartridge 10 to the holder 20*a*. In the actual state, however, the dimension tolerances of the components and the clearance between the cartridge 10 and the holder 20*a* may tilt the cartridge 10 in the ±Y directions. The guide members 610, 620 and 504 used additionally in the second embodiment are devised to reduce the potential for such tilting of the cartridge 10 or the board 400.

In the state of FIG. 19, the engagement projection 160 formed on the rear face 104 of the cartridge 10 engages with the engagement hole 202 formed in the holder 20*a*. The user then presses down the front face 103-side gradually. When the cartridge 10 slightly moves in the −Z direction (downward) from the state of FIG. 19, the inner surfaces of the pair of lateral guide members 620 guide the outer surfaces of the pair of lateral guide wall members 84 of the cartridge 10. This guiding operation controls or confines the position of the cartridge 10 in the Y direction (width direction). The pair of lateral guide members 620 are designed to roughly control the inserting position of the cartridge 10. The allowable displacement margin in the Y direction (width direction) for the pair of lateral guide members 620 is accordingly set to be greater than the allowable displacement margins for the other guide members in the width direction, i.e., the board guide members 504 and the fitting rib 270.

FIGS. 20A-1, 20A-2, 20B-1, 20B-2, 21A-1, 21A-2, 21B-1, and 20B-2 are explanatory diagrams showing the cartridge 10 gradually moving in the −Z direction (downward) after the state of FIG. 19. The attachment of the cartridge 10 sequentially follows FIG. 20A-1, FIG. 20B-1, FIG. 21A-1 and FIG. 21B-1. In order to clearly show the positional relation between the surface of the circuit board 400 and the terminals on the terminal block 500*a*, the board guide members 504 of the terminal block 500*a* are omitted from these drawings. FIG. 20A-2, FIG. 20B-2, FIG. 21A-2 and FIG. 21B-2 respectively correspond to FIG. 20A-1, FIG. 20B-1, FIG. 21A-1 and FIG. 21B-1 and show the board guide members 504 on the terminal block 500*a*. For the matter of convenience, the lateral guide members 620 are omitted from these drawings.

Figures 1, 20A:
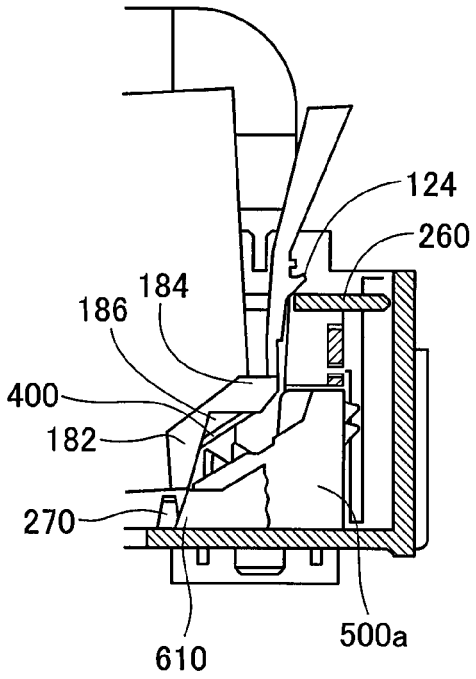
Figures 2, 20A:
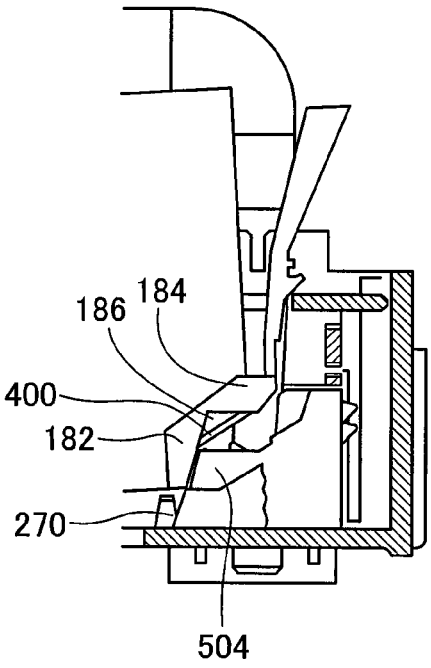

FIGS. 20A-1 and 20A-2 show the state where the ends on the −Z-direction side (lower ends) of the longitudinal guide wall members 182 of the cartridge 10 come into contact with the ends on the +Z-direction side (upper ends) of the longitudinal guide members 610. After the ends on the −Z-direction side (lower ends) of the longitudinal guide wall members 182 of the cartridge 10 come into contact with the longitudinal guide members 610, the cartridge 10 is guided and moved in the −Z direction (downward) while the longitudinal guide wall members 182 are in contact with the longitudinal guide members 610. The state that the longitudinal guide wall members 182 are in contact with the longitudinal guide members 610 is maintained, so as to prevent any unexpected component or member from coming into contact with the surface of the circuit board 400. Moving the cartridge 10 in the −Z direction (downward) while keeping the contact of the members 182 with the members 610 guides the cartridge 10 to the adequate position where the plurality of terminals 410 to 490 on the circuit board 400 properly come into contact with the corresponding apparatus-side terminals 510 to 590.

In the state of FIGS. 20A-1 and 20A-2, the fitting rib 270 is not yet inserted or fit in the cutout groove 140 of the cartridge 10 (FIG. 5A). Immediately after this state, the fitting rib 270 starts entering the cutout groove 140. After the state of FIGS. 20A-1 and 20A-2, the fit of the fitting rib 270 in the cutout groove 140 controls the position in the Y direction (width direction) of the cartridge 10.

Figures 1, 20B:
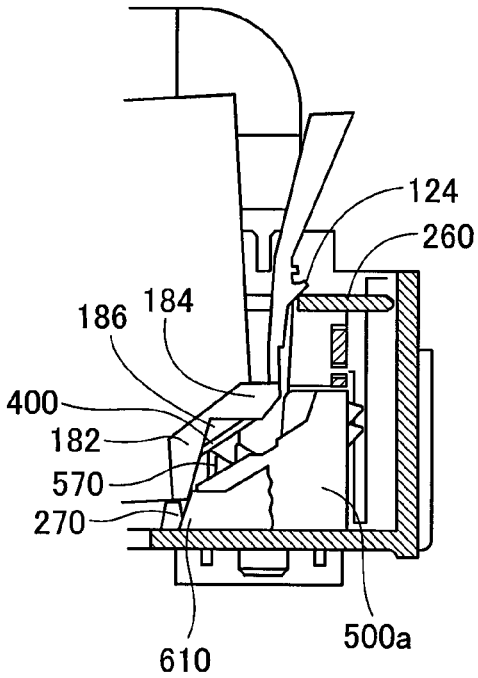
Figures 2, 20B:
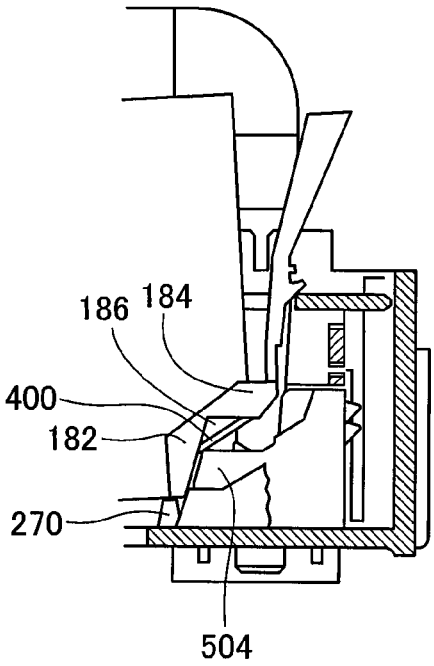

When the cartridge 10 is pressed in to the state of FIGS. 20B-1 and 20B-2, the apparatus-side ground terminal 570 on the terminal block 500*a* comes into contact with the ground terminal 470 on the circuit board 400. In this state, the other terminals on the terminal block 500*a* are not yet in contact with the circuit board 400. Substantially simultaneously with the contact of the apparatus-side ground terminal 570 with the ground terminal 470 on the circuit board 400, the edges of the pair of board guide members 504 of the terminal block 500*a* reach the positions of the two side faces of the circuit board 400. In other words, the two side faces of the circuit board 400 come into contact with the pair of board guide members 504, and substantially simultaneously the ground terminal 470 comes into contact with the apparatus-side ground terminal 570. When the edges of the pair of board guide members 504 reach the positions of the two side faces of the circuit board 400, the pair of board guide members 504 control or confine the position of the circuit board 400 in the Y direction (width direction). This results in controlling the position of the overall cartridge 10 in the Y direction (width direction) and enables the cartridge 10 to be kept in the correct orientation or alignment. In order to make the cartridge 10 in its correct orientation or alignment as soon as possible, it is preferable to bring the two side faces of the circuit board 400 into contact with the pair of board guide members 504, before bringing the ground terminal 470 into contact with the apparatus-side ground terminal 570. In order to reduce the possibility that an unexpectedly high voltage is applied from the high voltage terminal among the apparatus-side terminals 510 to 590 (for example, the apparatus-side attachment detection terminal 550) to the low voltage terminal among the terminals 410 to 490 on the circuit board 400 (for example, the terminal 420, 430, 460, 470 or 480) or the possibility that the memory device 403 is damaged by electrostatic discharge, on the other hand, it is preferable to bring the ground terminal 470 into contact with the apparatus-side ground terminal 570, before bringing the two side faces of the circuit board 400 into contact with the pair of board guide members 504.

Figures 1, 21A:
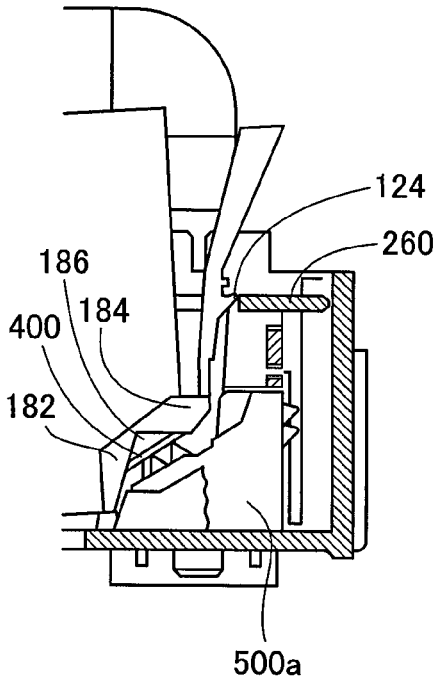
Figures 2, 21A:
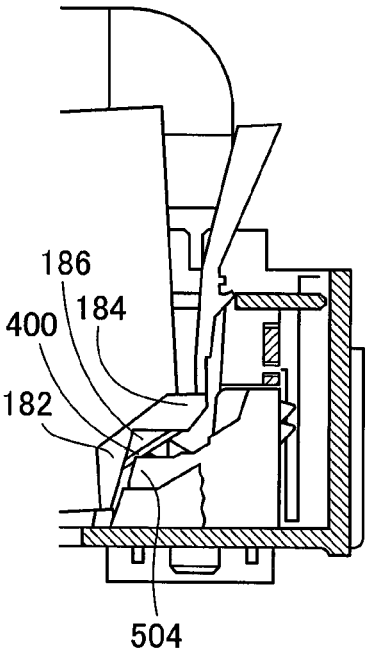
Figures 1, 21B:
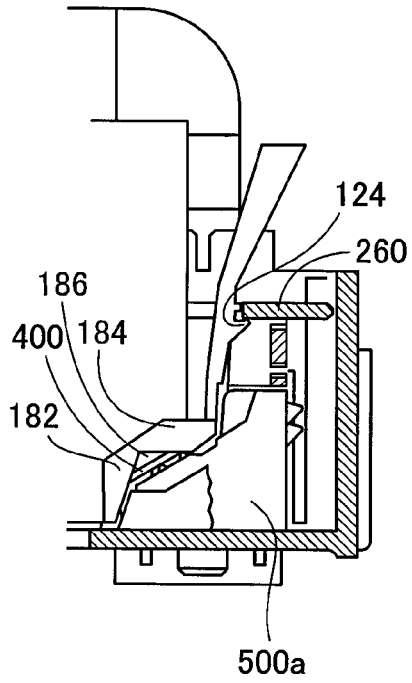
Figures 2, 21B:
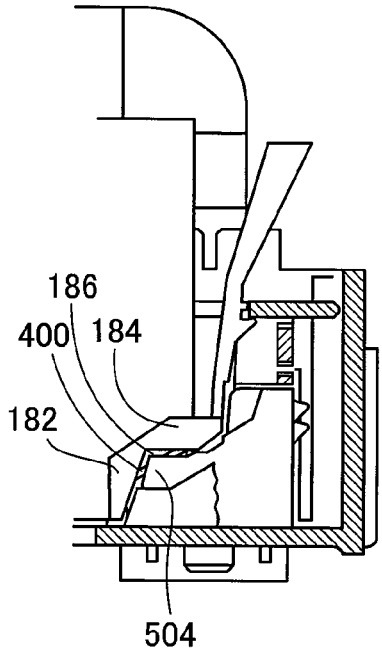

FIGS. 21A-1 and 21A-2 show the state where the cartridge 10 is further pressed in the −Z direction from the state of FIGS. 20B-1 and 20B-2. In this state, all the apparatus-side terminals on the terminal block 500*a* come into contact with the corresponding terminals on the circuit board 400. FIGS. 21B-1 and 21B-2 show the state where the cartridge 10 is further pressed in the −Z direction to complete the attachment from the state of FIGS. 20B-1 and 20B-2. In this state, the engagement projection 124 of the lever 120 engages with the apparatus-side engagement element 260 in the −Z direction.

As discussed above with reference to FIGS. 20A-1, 20A-2, 20B-1, 20B-2, 21A-1, 21A-2, 21B-1, and 20B-2, in the process of attachment of the cartridge 10, the front face 103-side of the cartridge 10 is guided in the following sequence:

(1) The pair of lateral guide wall members 184 of the cartridge 10 are guided in the Y direction (width direction) by the pair of lateral guide members 620 of the holder 20*a;*

(2) The −Z-direction ends (lower ends) of the pair of longitudinal guide wall members 182 of the holder 20*a* come into contact with the +Z-direction ends (upper ends) of the pair of longitudinal guide members 610, so as to guide the insertion path of the −Z direction end (lower end) of the front face 103 of the cartridge 10;

(3) The fitting rib 270 of the holder 20*a* is inserted and fit in the cutout groove 140 of the cartridge 10, so as to guide, in the Y direction (width direction), the −Z-direction end (lower end) of the front face 103 of the cartridge 10; and (4) The side faces of the circuit board 400 come into contact with the pair of board guide members 504 substantially simultaneously with contact of the ground terminal 470 of the circuit board 400 with the apparatus-side ground terminal 570, and subsequently the circuit board 400 is guided in the Y direction (width direction) by the pair of board guide members 504.

Part of the above guiding operations (1) to (4) or the guide process may be modified. When there is a relatively low possibility that the cartridge 10 is tilted in the ±Y directions in the course of attachment of the cartridge 10 to the holder 20*a* due to the small dimension tolerances and the small clearance, part or all of these guiding operations may be omitted. Omission of a certain guiding operation may allow for omission of members involved in the omitted guiding operation. The guiding operation through the fit of the fitting rib 270 in the cutout groove 140 (fitting recess) is preferably implemented at least during the guiding operation of the circuit board 400 by the pair of board guide members 504.

The second embodiment discussed above has the similar advantages to those of the first embodiment, i.e., preventing an unexpectedly high voltage from being applied from the high voltage terminal among the apparatus-side terminals 510 to 590 (for example, the apparatus-side attachment detection terminal 550) to the low voltage terminal among the terminals 410 to 490 on the circuit board 400 (for example, the terminal 420, 430, 460, 470 or 480) or protecting the memory device 403 from damage by electrostatic discharge. The second embodiment has an additional advantage that the cartridge 10 is successively guided in the preset sequence in the process of attachment of the cartridge 10 to the holder 20*a*. Substantially no force acts to tilt the cartridge 10 leftward or rightward in this attachment process, so that the cartridge 10 is being attached with adequately correct orientation or alignment. When the cartridge 10 is inclined in the course of attachment to the holder 20*a*, a relevant part of the cartridge 10 is stuck by the longitudinal guide members 610 or the lateral guide members 620. This prevents the terminals 410 to 490 on the circuit board 400 from coming into contact with the apparatus-side terminals 510 to 590. The longitudinal guide members 610 and the lateral guide members 620 also serve to prevent the terminals 410 to 490 on the circuit board 400 from coming into contact with the apparatus-side terminals 510 to 590, when the user accidentally falls the cartridge 10 into the holder 20*a* in the course of attachment or detachment of the cartridge 10 to or from the holder 20*a*. The second embodiment thus advantageously prevents an unexpectedly high voltage from being applied from the high voltage terminal among the apparatus-side terminals 510 to 590 (for example, the apparatus-side attachment detection terminal 550) to the low voltage terminal among the terminals 410 to 490 on the circuit board 400 (for example, the terminal 420, 430, 460, 470 or 480) or protects the memory device 403 from damage by electrostatic discharge, with extremely high probability.

C. Inclination Angle of Circuit Board

Figure 22:
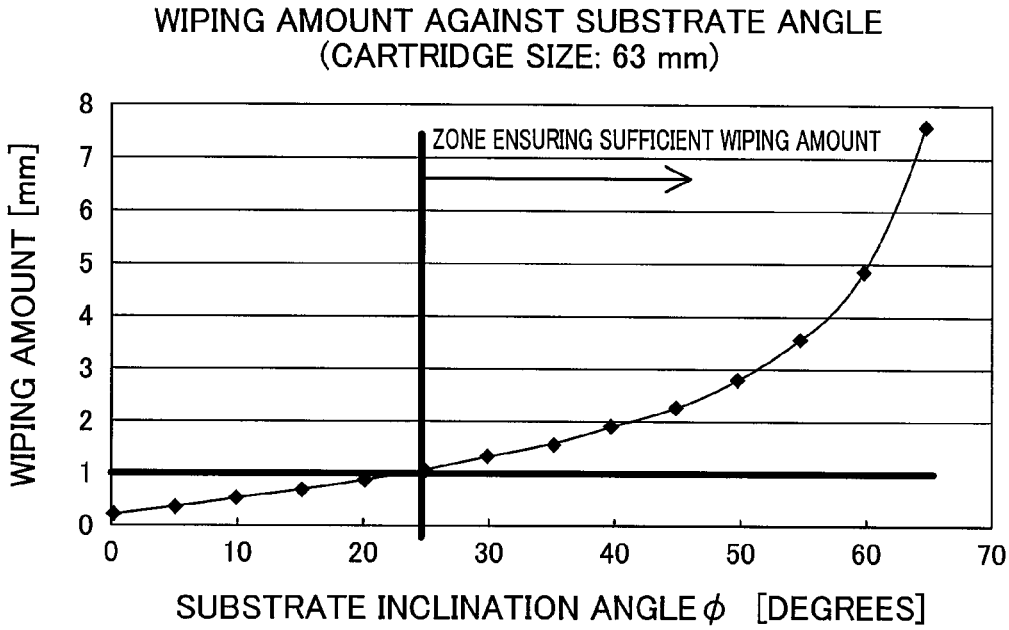
FIG. 22 is a graph showing a relation of wiping amount of a board terminal to a board inclination angle (I)
Figure 22:
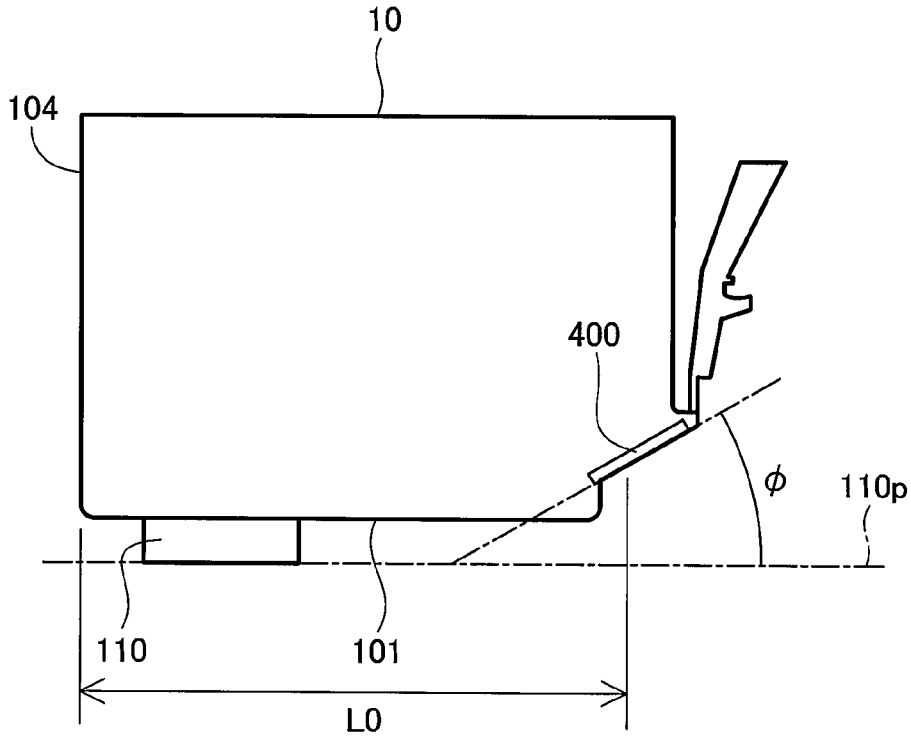

FIG. 22 shows the relation of a wiping amount of the terminal on the circuit board 400 by an apparatus-side terminal with respect to an inclination angle ϕ of the circuit board 400. The inclination angle ϕ of the circuit board 400 represents an angle between the plane 110*p* extended from the opening face defined by the edge of the opening 116 of the ink supply port 110 and the board surface of the circuit board 400; the inclination angle ϕ is generally an acute angle (less than 90 degrees). In this embodiment, the plane 110*p* extended from the opening face is parallel to the bottom face 101 of the cartridge 10. The inclination angle ϕ is accordingly equal to the angle between the bottom face 101 of the cartridge 10 and the board surface of the circuit board 400. In the course of attachment of the cartridge 10, as shown in FIGS. 13A-13C or as shown in FIGS. 20A-1, 20A-2, 20B-1, 20B-2, 21A-1, 21A-2, 21B-1, and 20B-2, the front face 103 (the first end face) of the cartridge 10 goes down with slight pivotal rotation around the pivot 166*w* (FIG. 4A) on the rear face 104 (the second end face) of the cartridge 10. In this process, the circuit board 400 slightly rotates and comes into contact with the apparatus-side terminals 510 to 590 on the terminal block 500, so that the respective terminals 410 to 490 on the circuit board 400 are wiped by the corresponding apparatus-side terminals 510 to 590. The wiping of the terminal on the circuit board 400 by the corresponding apparatus-side terminal preferably removes the dust or oxide coating on the surface of the terminal on the circuit board 400 to enhance the electric conductivity (electrical connection).

The plot of FIG. 22 shows the wiping length (wiping amount) of the terminal on the circuit board 400 by the corresponding apparatus-side terminal as ordinate, and the board inclination angle ϕ as abscissa. The calculation is on the assumption that distance L0 in the X direction from the fourth face (rear face) 104 of the cartridge 10 to the contact portion of the ground terminal 470 that comes into contact with the corresponding apparatus-side ground terminal 570 is 63 mm. In general, the greater board inclination angle ϕ causes the board surface to be closer to the vertical plane and increases the wiping amount. In order to sufficiently remove the dust or oxide coating on the surface of the terminal on the circuit board 400, the wiping amount is preferably not less than 1 mm. According to the graph of FIG. 22, the board inclination angle ϕ is preferably not less than 25 degrees to ensure the wiping amount of not less than 1 mm.

Figure 23A:
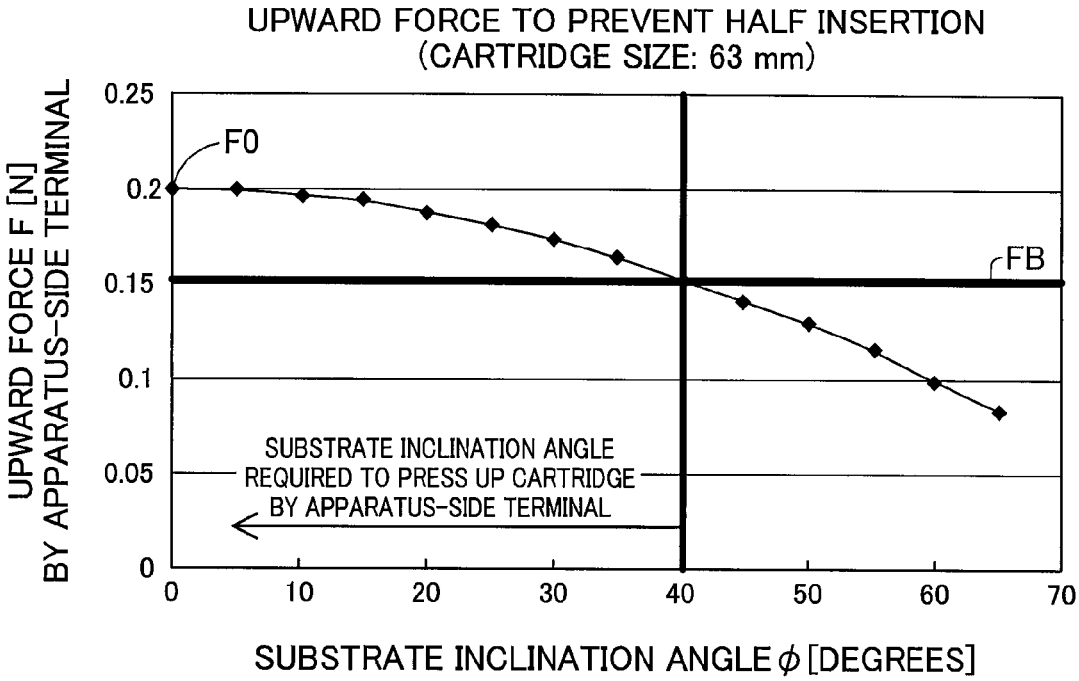
FIG. 23A is a graph showing a relation of upward force by an apparatus-side ground terminal to a board inclination angle (I)
Figure 23B:
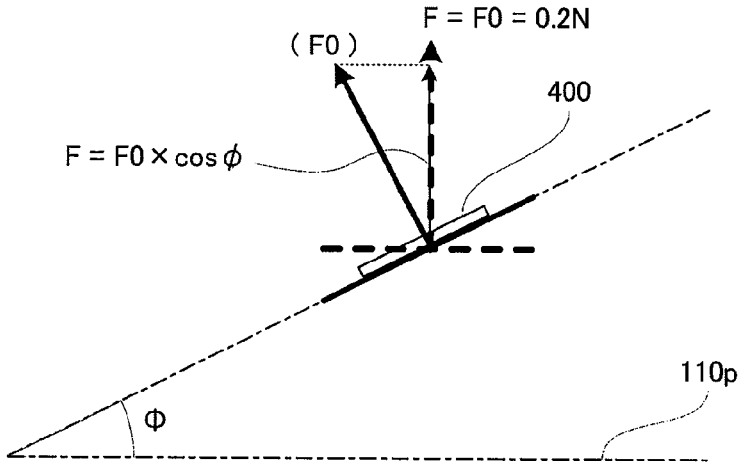
FIG. 23B shows the upward force by the apparatus-side ground terminal.

FIG. 23A shows the relation of upward force F by the apparatus-side ground terminal 570 to the board inclination angle ϕ in consideration of preventing half insertion of the cartridge. The calculation of FIG. 23A is also on the assumption that the distance L0 is equal to 63 mm, like the calculation of FIG. 22. The weight of the cartridge (including the weight of ink) is assumed to be 30 grams. This value is the standard weight of the cartridge for inkjet printing apparatuses for household use. The "half insertion of the cartridge" denotes the state where the engagement projection 124 of the lever 120 is located just beside the apparatus-side engagement element 260 as shown in FIG. 13B, i.e., the state immediately before the complete engagement. This state of half insertion is also called "half engagement". In this state of half engagement, only the apparatus-side ground terminal 570 among the plurality of apparatus-side terminals 510 to 590 applies the upward force to the circuit board 400. It should be noted that in the printing apparatus shown in FIG. 1, the holder 20 does not have a cover. When the user releases the hand in this state of half engagement, the cartridge 10 may be kept in this state of half engagement. The plot of FIG. 23A shows the calculation result of the upward force by the apparatus-side ground terminal 570 to prevent such half insertion of the cartridge 10. FIG. 23B shows the relation of the upward force F to the board inclination angle ϕ.

The upward force by the apparatus-side ground terminal 570 is a +Z-direction component (vertically upward component in this embodiment) of the force applied from the apparatus-side ground terminal 570 to the circuit board 400 (and the cartridge 10) in the state of half engagement of FIG. 13B. As discussed previously, in the embodiments, the apparatus-side ground terminal 570 is composed of spring-loaded material or elastic material. When the ground terminal 470 of the circuit board 400 is pressed against the apparatus-side ground terminal 570, a pressing force in a direction perpendicular to the board surface of the circuit board 400 is applied to the ground terminal 470 by the elastic force of the apparatus-side ground terminal 570. The calculation of the upward force of FIG. 23A is on the assumption that pressing force F0 of the apparatus-side ground terminal 570 is 0.2 N in the direction perpendicular to the board surface. Since the upward force F (=F0×cos ϕ) is the +Z-direction component of the pressing force F0, F=F0=0.2 N holds at the board inclination angle ϕ=0 degree as shown by the broken line in FIG. 23B. The upward force F varies according to the curve F=F0×cos ϕ with a variation in board inclination angle ϕ. The curve of FIG. 23A is the curve F=F0×cos ϕ. With an increase in board inclination angle ϕ (ϕ approaching 90 degrees), the board surface approaches the XZ plane and reduces the upward force F. An upward force FB balancing with the cartridge 10 having the distance L0 of 63 mm and the weight of 30 grams is approximately 0.15 N (the position of thick horizontal line in FIG. 23A). This means that the upward force of not less than 0.15 N enables the cartridge 10 to be pressed vertically upward by the apparatus-side ground terminal 570. In order to ensure the upward force of not less than 0.15 N, the board inclination angle ϕ is preferably not greater than 40 degrees, as clearly understood from FIG. 23A.

When the user releases the hand in the state of half engagement of FIG. 13B, the cartridge 10 may be kept in the state of half engagement. If the board inclination angle ϕ is set to be not greater than 40 degrees as shown in FIG. 23A, however, when the user releases the hand in the state of half engagement, the apparatus-side ground terminal 570 presses the front face 103 of the cartridge 10 in the +Z direction (upward direction). This clearly disengages the engagement projection 124 from the apparatus-side engagement element 260 and facilitates the user to find the failed attachment. From this point of view, it is preferable to set the board inclination angle ϕ to be not greater than 40 degrees.

Figure 24:
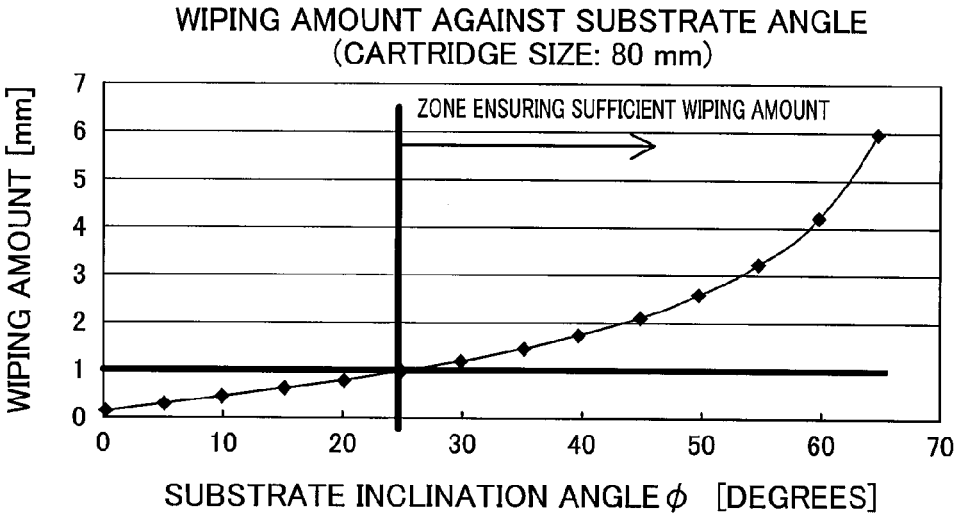
FIG. 24 is a graph showing another relation of wiping amount of the board terminal to a board inclination angle (I)
Figure 25:
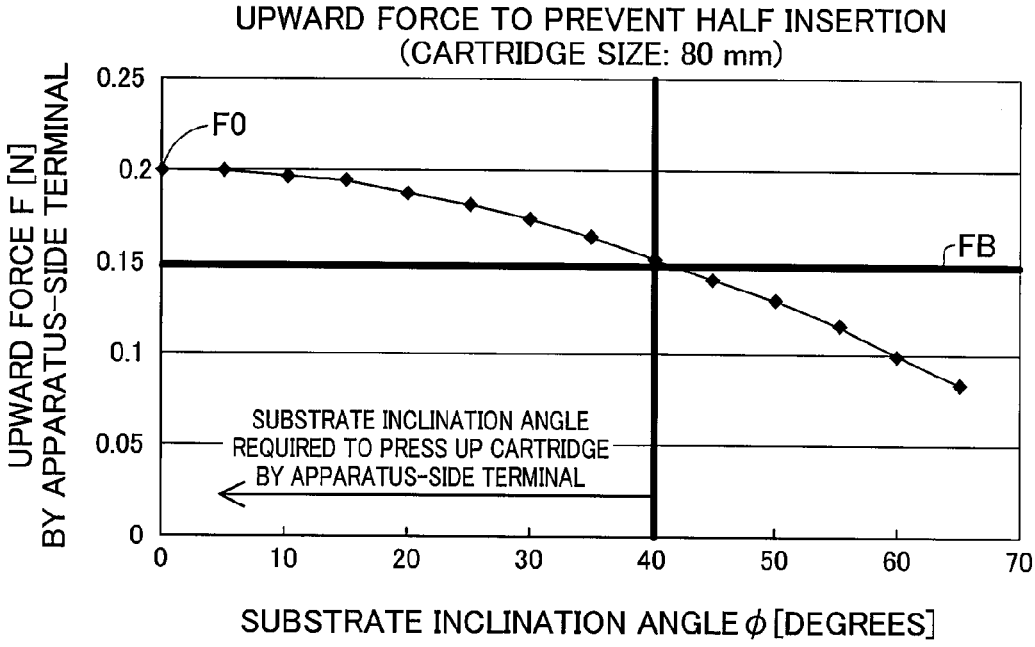
FIG. 25 is a graph showing another relation of upward force by the apparatus-side ground terminal to a board inclination angle (I)

FIGS. 24 and 25 show the characteristics of a cartridge having a greater dimension in the X direction than the dimension of the cartridge in FIGS. 22 and 23A. Whereas the cartridge is assumed to have the distance L0=63 mm in FIGS. 22 and 23A, it is assumed to have the distance L0=80 mm in FIGS. 24 and 25. The calculation of the upward force of FIG. 25 is on the assumption that F0=0.2 N and the weight of the cartridge (including the weight of ink) is 30 g, like the calculation of FIG. 23A. As clearly understood from the result of FIG. 24, like the result of FIG. 22, in order to ensure the wiping amount of not less than 1 mm, the board inclination angle ϕ is preferably not less than 25 degrees. Although the distance L0 is 80 mm in the calculation of FIG. 25 relative to 63 mm in the calculation of FIG. 23A, the upward force FB balancing with the cartridge 10 having the weight of 30 grams is almost equal to that of FIG. 23 and is approximately 0.15 N (the position of thick horizontal line in FIG. 25). As clearly understood from the result of FIG. 25, like the result of FIG. 23A, in order to prevent half engagement of the cartridge, the board inclination angle ϕ is preferably not greater than 40 degrees.

By taking into account the characteristics of FIGS. 22 through 25 discussed above, it is preferable to set the board inclination angle ϕ to be not less than 25 degrees and not greater than 40 degrees.

The increased pressing force of the apparatus-side ground terminal 570 ensures the sufficient upward force even at the greater board inclination angle ϕ. In this case, it is preferable to set the pressing force of the apparatus-side ground terminal 570 and the board inclination angle ϕ to such values that enable the cartridge 10 to be pressed upward and changed from the state of half engagement to the disengagement state by the pressing force of the apparatus-side ground terminal 570, when the user release the hand from the cartridge 10 in the state of half engagement.

D. Other Embodiments

Figure 26:
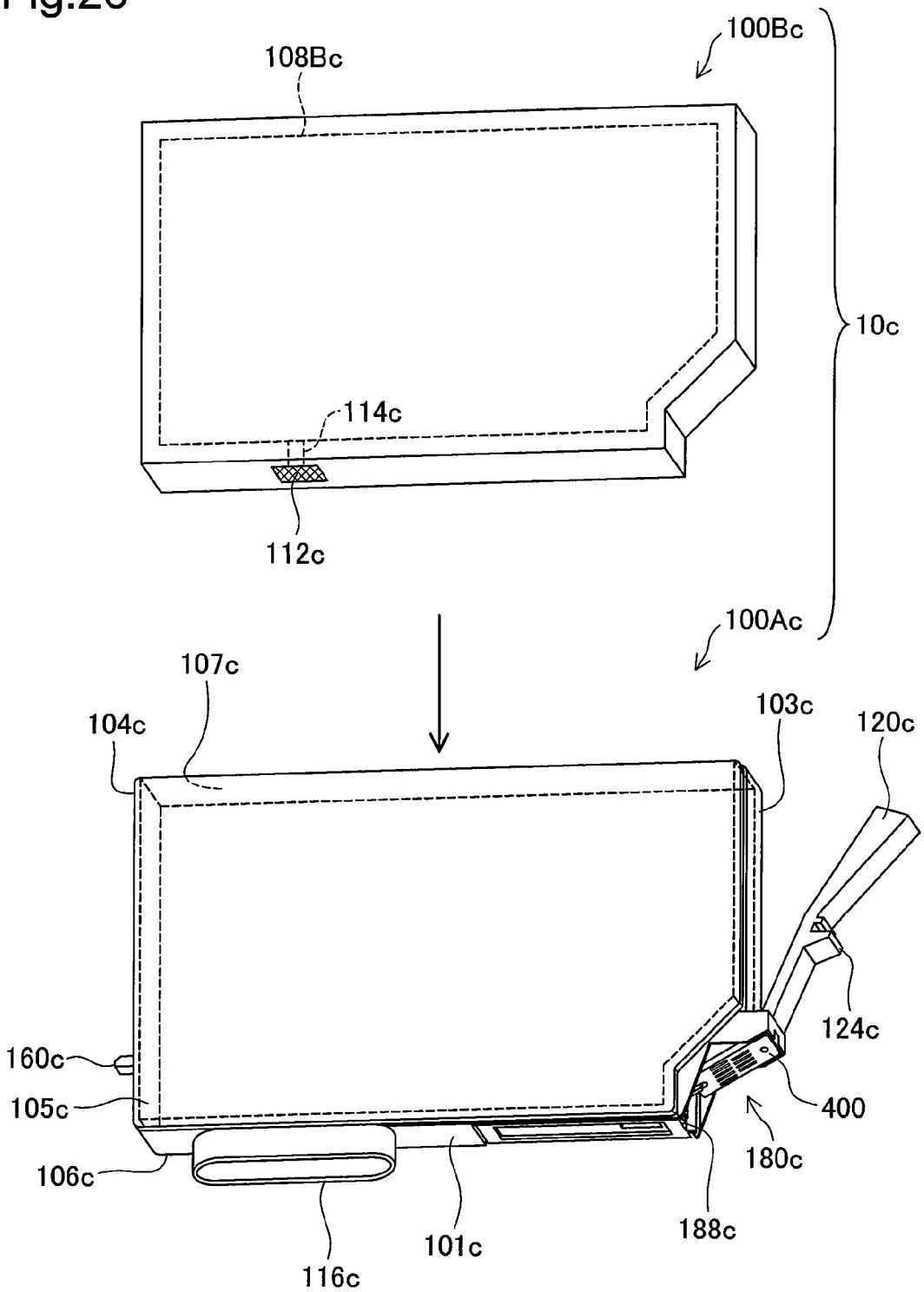
FIG. 26 is a perspective view showing the structure of another ink cartridge according to another embodiment.

FIG. 26 is a perspective view showing the structure of a cartridge according to another embodiment. The cartridge 10*c* includes an ink container body 100Bc and an adapter 100Ac as separable components. The cartridge 10*c* is compatible with the cartridge 10 of FIG. 3. The ink container body 100Bc has an ink chamber 108Bc for storing ink, and an ink flow path 114*c* and a foam 112*c* defining an ink supply port. The foam 112*c* is located on the bottom face of the ink container body 100Bc.

The adapter 100Ac has a similar outer shape to that of the cartridge 10 shown in FIG. 3, except that the adapter 100Ac has an opening 107*c* on its top and a cavity for receiving the ink container body 100Bc therein. The adapter 100Ac is formed in an approximate-cuboid shape as a whole and has the outer surface including five faces 101*c*, 103*c*, 104*c*, 105*c* and 106*c*, i.e., six faces orthogonal to one another except a top face (upper face), a stepped portion 188*c* and a board mount portion 180*c*. A lever 120*c* having an engagement projection 124*c* is provided on the front face 103*c* of the adapter 100Ac. An opening 116*c* is formed on the bottom face 101*c* of the adapter 100Ac to cause the ink supply pipe 240 of the holder 20 to go therethrough when the adapter 100Ac is attached to the holder 20. In the state where the ink container body 100Bc is received in the adapter 100Ac, the foam 112*c* of the ink container body 100Bc is connected with the ink supply pipe 240 of the holder 20. The board mount portion 180*c* is formed proximate to the lower end of the front face 103*c* of the adapter 100Ac. The board 400 is fixed on the board mount portion 180*c*. An engagement projection 160*c* is formed on the rear face 104*c* of the cartridge 10*c*.

This cartridge 10*c* is used in such a way that a pre-assembled set of the ink container body 100Bc and the adapter 100Ac is attached to the holder 20. Alternatively the adapter 100Ac may be attached first to the holder 20, and the ink container body 100Bc may be subsequently set in the adapter 100Ac. In the latter case, the ink container body 100Bc alone may be inserted and removed, while the adapter 100Ac is kept in the holder 20.

Figure 27:
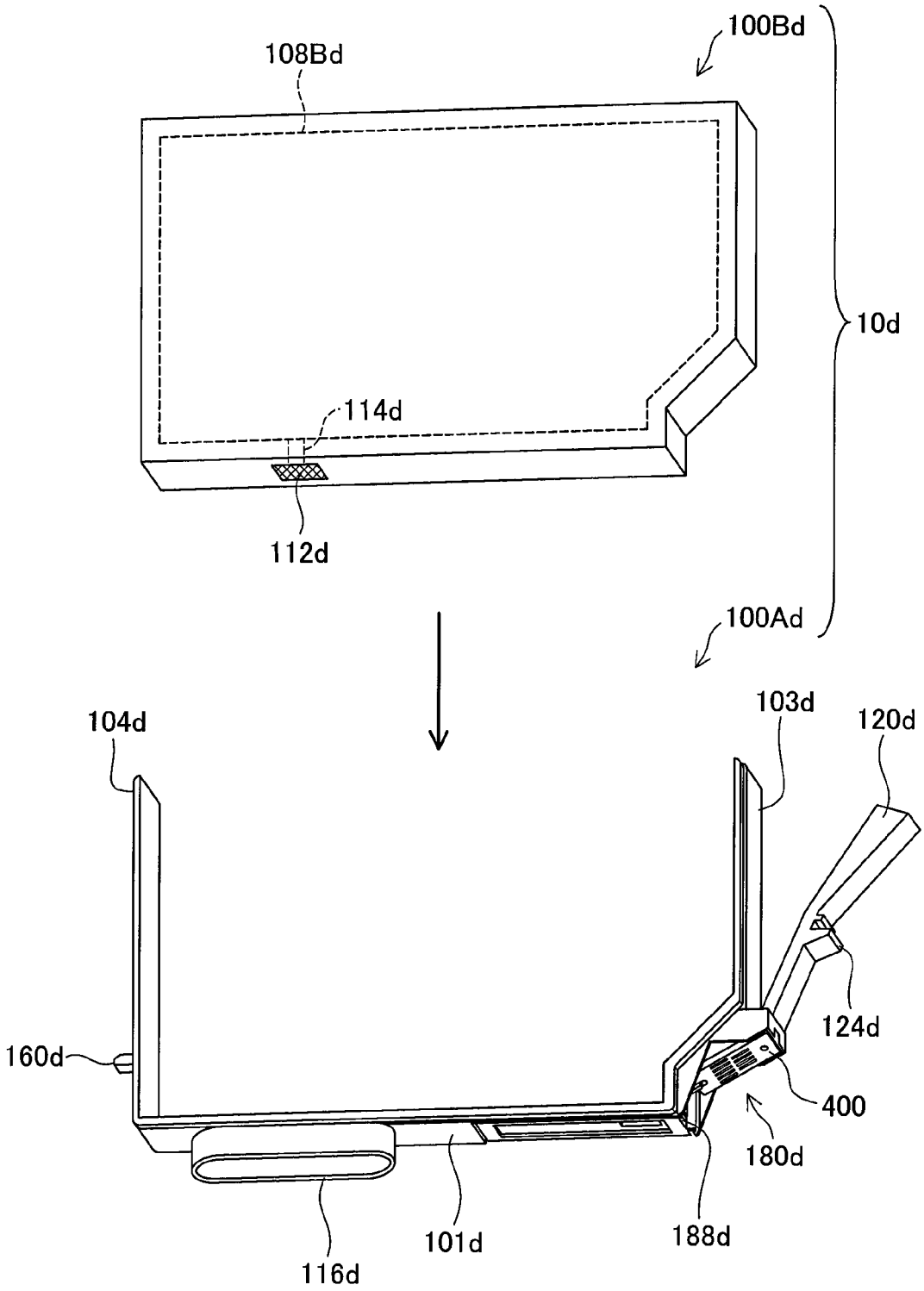
FIG. 27 is a perspective view showing the structure of another ink cartridge according to another embodiment.

FIG. 27 is a perspective view showing the structure of another cartridge according to another embodiment. The cartridge 10*d* also includes an ink container body 100Bd and an adapter 100Ad as separable components. The adapter 100Ad has a bottom face 101*d*, a front face 103*d*, a rear face 104*d* opposed to the front face 103*d*, a board mount portion 180*d* provided on the lower end of the front face 103*d* and a stepped portion 188*d* provided between the lower end of the board mount portion 180*d* and the bottom face 101*d*. The primary difference from the cartridge of FIG. 26 is that the adapter 100Ad of FIG. 27 does not have members forming two side faces (largest side faces) intersecting with the bottom face 101*d*, the front face 103*d* and the rear face 104*d*. A lever 120*d* having an engagement projection 124*d* is provided on the front face 103*d*. An engagement projection 160*d* is formed on the rear face 104*d*. The ink container body 100Bd has an ink chamber 108Bd for storing ink, and an ink flow path 114*d* and a foam 112*d* defining an ink supply port. This cartridge 10*d* may be used in substantially the same manner as that of the cartridge 10*c* shown in FIG. 26.

Figure 28:
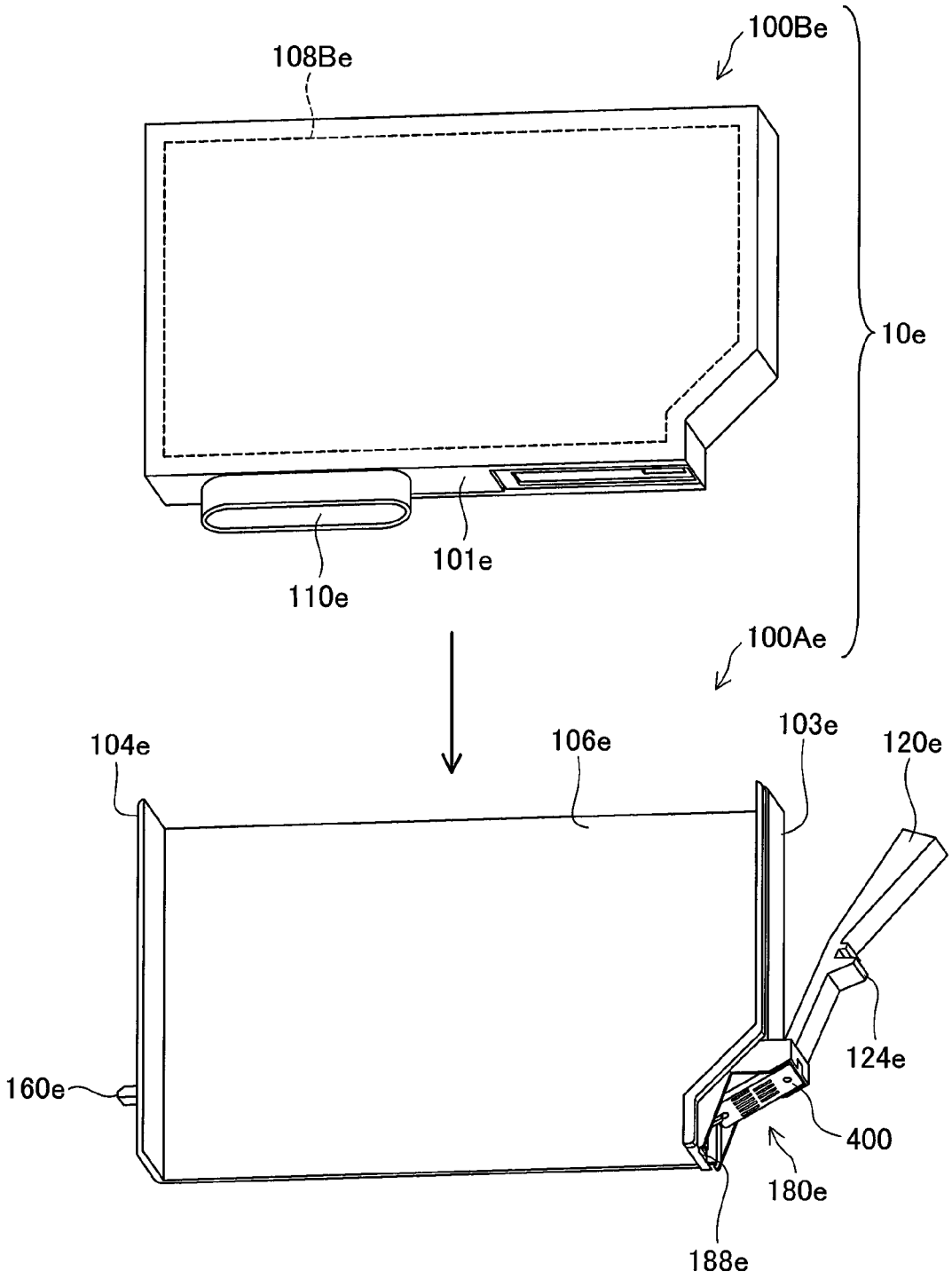
FIG. 28 is a perspective view showing the structure of another ink cartridge according to another embodiment.

FIG. 28 is a perspective view showing the structure of another cartridge according to another embodiment. The cartridge 10*e* also includes an ink container body 100Be and an adapter 100Ae as separable components. The adapter 100Ae has a front face 103*e*, a rear face 104*e* opposed to the front face 103*e*, a side face 106*e* formed between the front face 103*e* and the rear face 104*e*, a board mount portion 180*e* provided on the lower end of the front face 103*e* and a stepped portion 188*d* provided on the lower end of the board mount portion 180*e*. The ink container body 100Be has an ink chamber 108Be for storing ink and an ink supply port 110*e*. The ink container body 100Be includes a bottom face 101*e* having substantially the same shape as that of the bottom face 101 of the cartridge 10 shown in FIG. 3. This cartridge 10*e* may be used in substantially the same manner as those of the cartridges 10*c* and 10*d* shown in FIGS. 26 and 27. Another adapter may be designed to have a shape that the rear face 104*e*, an engagement projection 160*e* and the side face 106*e* are omitted from the adapter 100Ae of FIG. 28.

As clearly understood from the embodiments of FIGS. 26 through 28, the cartridge may be separated into an ink container body (also called "printing material container") and an adapter. In this structure, the circuit board 400 is preferably provided on the adapter. The stepped portion 188*c* (188*d* or 188*e*) provided on the lower end of the board mount portion 180*c* (180*d* or 180*e*) may be omitted if unnecessary. For example, in the structure with no stepped portion 188*c*, the board mount portion 180*c* may be extended obliquely downward to intersect with the bottom face 101*c*. As clearly understood from the above description, the adapter compatible with the cartridge 10 of FIG. 3 is preferably designed to include the front face 103*c* (103*d* or 103*e*) with the lever having the engagement structure, the rear face 104*c* (104*d* or 104*e*) opposed to the front face, another face provided between the front face and the rear face (i.e., the bottom face 101*c* or 101*d* or the side face 106*e*) and the board mount portion 180*c* (180*d* or 180*e*) provided proximate to the lower end of the front face.

Figure 29A:
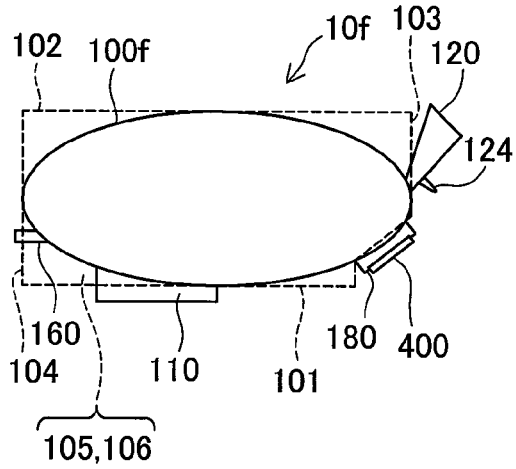
FIGS. 29A-29H show various shapes of ink cartridges according to other embodiments.

FIGS. 29A through 29F are conceptual views showing cartridges formed in various shapes according to other embodiments. An ink container body 100*f* of a cartridge 10*f* shown in FIG. 29A is formed to have an elliptical or oval side face and has a lever 120 with an engagement projection 124 and a board mount portion 180, on which the circuit board 400 is fixed, on its front face. The cartridge 10*f* also has an ink supply port 110 provided on its bottom face and an engagement projection 160 provided on its rear face. This cartridge 10*f* has a fixed width when viewed from the front face side (i.e., the side with the lever 120), like the cartridge of FIG. 4B. This cartridge 10*f* may be compatible with the cartridge 10 of FIG. 3 if the engagement projections 124 and 160, the circuit board 400 and the ink supply port 110 are engaged or connected with corresponding members of the holder 20.

Figure 29B:
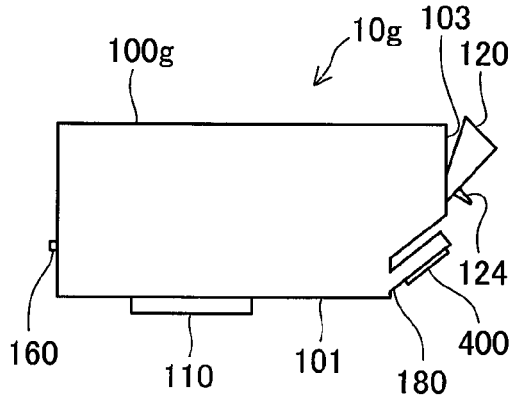
Figure 29C:
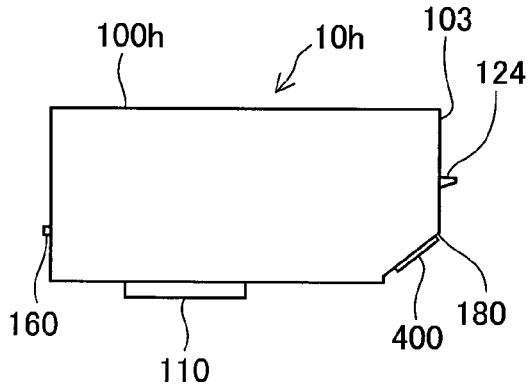
Figure 29D:
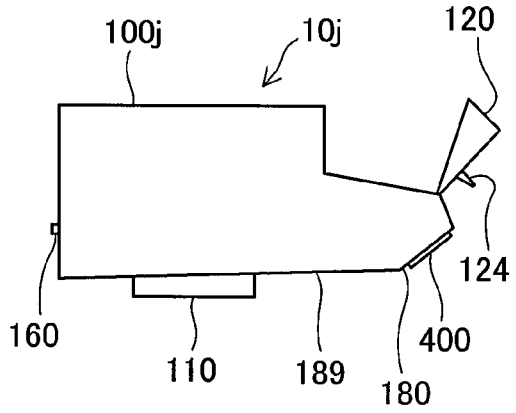
Figure 29E:
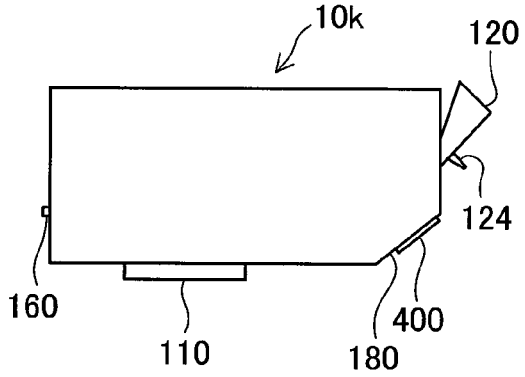
Figure 29F:
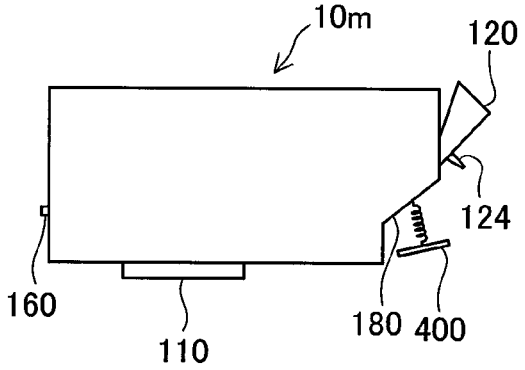

An ink container body 100*g* of a cartridge 10*g* shown in FIG. 29B is formed in an approximate-cuboid shape like the cartridge 10 of FIG. 3. The primary difference from the cartridge 10 of FIG. 3 is that the board mount portion 180 is not formed continuously with the lower end of the front face 103. An ink container body 100*h* of a cartridge 10*h* shown in FIG. 29C is also formed in an approximate-cuboid shape. The primary difference from the cartridge 10 of FIG. 3 is that the front face 103 has only an engagement projection 124 with omission of the lever 120. FIGS. 29D and 29E show other cartridges 10*j* and 10*k* neither of which has a stepped portion 188 between a bottom face and a board mount portion 180. In an ink container body 100*j* of the cartridge 10*j* shown in FIG. 29D, the bottom face 189 is formed as an inclined plane relative to the opening face of the ink supply port 110. FIG. 29F shows a cartridge 10*m* where the circuit board 400 is attached to the board mount portion 180 via a spring. These cartridges 10*g*, 10*h*, 10*j*, 10*k* and 10*m* are also designed to be compatible with the cartridge 10 of FIG. 3 so that the engagement projections 124 and 160, the circuit board 400 and the ink supply port 110 are engaged or connected with the corresponding members of the holder 20.

Figure 29G:
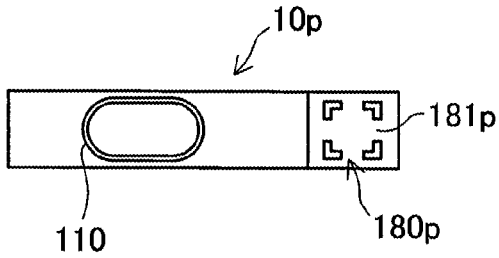
Figure 29H:
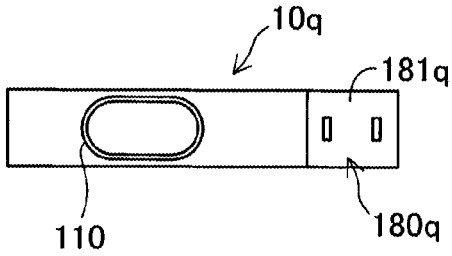

FIGS. 29G and 29H are bottom views showing exemplary structures of the board mount portion of the cartridge in other embodiments. In a cartridge 10*p* of FIG. 29G, a board mount portion 180*p* includes four projected members or ribs (L-shaped frame members). In a cartridge 10*q* of FIG. 29H, a board mount portion 180*q* includes two parallel projected members or ribs (linear frame members). In these cartridges 10*p* and 10*q*, a circuit board may be set inside the frame members or may be bonded to or pressure-bonded on the frame members. In these structures, the circuit board is inclined relative to the opening face of the ink supply port. The face 181*p* or 181*q* with the convex members of the board mount portion 180*p* or 180*q* may be parallel to the opening face of the ink supply port or may be inclined relative to the opening face of the ink supply port. In either case, the component shape of the board mount portion 180*p* or 180*q* is determined, such that the circuit board is fixed to be inclined relative to the opening face of the ink supply port. As clearly understood from these exemplary structures, the board mount portion is not necessarily formed to have an inclined plane but should be designed to mount the circuit board inclined relative to the opening face of the ink supply port. It is especially preferable that the board mount portion is formed such that the face of the circuit board is facing a virtual plane extended from the opening face of the ink supply port and that the board surface is inclined at an acute angle relative to the virtual plane.

As clearly understood from the various examples of FIG. 29A-29H, the cartridge may have various outer shapes and modifications. If a cartridge have an outer shape other than an approximately cuboid shape, the cartridge may have six virtual faces or planes of an approximately cuboid shape, as shown by the broken line in FIG. 29A, i.e., the bottom face 101 (first face), the top face 102 (second face), the front face 103 (third face), the rear face 104 (fourth face), the left side face 105 (fifth face) and the right side face 106 (sixth face). In the description hereof, the term "face" or "plane" means both the virtual face or plane (also called "non-existing or non-existing face or plane") and the existing face or plane shown in FIGS. 3 and 4. The term "face" or "plane" denotes both the flat surface and the curved surface.

The cartridge shown in FIG. 29C has only the engagement projection 124 on its front face with omission of the lever 120. Any of various other shapes may be used for keeping the cartridge in its attached state. In another embodiment, the cartridge may have elastically-deformable elastic bodies (for example, rubber members) provided outside the cartridge, in place of the lever 120 and the engagement projections 124 and 160. In the attached state of the cartridge of this embodiment, the elastic bodies of the cartridge are compressed by the wall surfaces of the holder (cartridge attachment section). The attached state of the cartridge may be kept by the compression reaction force.

MODIFICATIONS

The embodiments and examples discussed above are to be considered in all aspects as illustrative and not restrictive. There may be many modifications, changes, and alterations without departing from the scope or spirit of the main characteristics of the invention. Some examples of possible modification are given below.

Modification 1

The above embodiments regard the application of the invention to the on-carriage type printing apparatus which has a holder (cartridge attachment section) on the carriage. The invention may also be applicable to the off-carriage type printing apparatus which has a holder (cartridge attachment section) on the location other than the carriage.

Modification 2

The arrangement and the shapes of the terminals and their contact portions on the circuit board in the above embodiments may be altered or modified in various ways. For example, the terminals and their contact portions may be arrayed in three or more rows, instead of the two rows, on the circuit board. The terminals on the circuit board may be formed in an atypical shape, instead of the approximate-rectangular shape. The number of terminals on the circuit board may be determined arbitrarily. The circuit board may be a flexible printed cable or a flexible printed board.

Figure 30A:
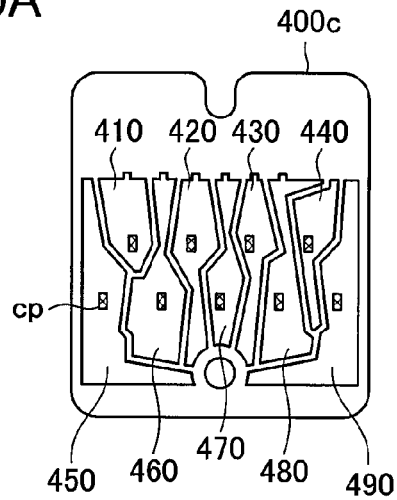
FIGS. 30A-30C show various shapes of terminals on the circuit board according to modified examples.
Figure 30B:
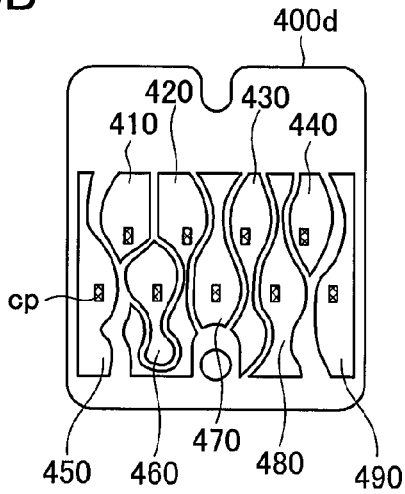
Figure 30C:
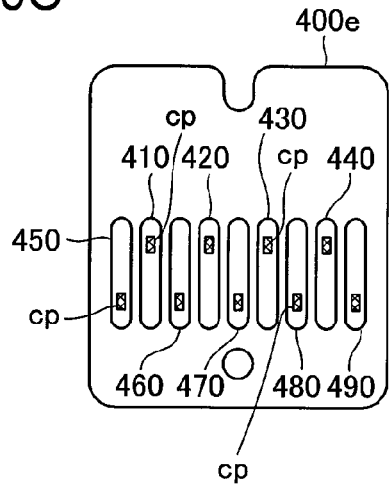

FIG. 30 shows various shapes of terminals on the circuit board according to modified examples. Circuit boards 400*c* through 400*e* of FIGS. 30A through 30C have different surface shapes from those of the board 400 and the terminals 410 to 490 shown in FIG. 6A. In the boards 400*c* and 400*d* of FIGS. 30A and 30B, the individual terminals have irregular shapes, instead of the approximate-rectangular shape. In the board 400*e* of FIG. 30C, the nine terminals 410 to 490 are aligned, where the pair of attachment detection terminals 450 and 490 (high voltage terminals) are arranged on both ends. The pair of overvoltage detection terminals 410 and 440 are arranged respectively between the attachment detection terminals 450 and 490 and the low voltage terminals 460 and 480. In these boards 400*c* through 400*e*, the contact portions "cp" of the respective terminals 410 to 490 that come into contact with the corresponding apparatus-side terminals have the same arrangement as that on the board 400 shown in FIG. 6A. As long as the contact portions "cp" have the same arrangement, the surface shape of the individual terminals may be modified in various ways.

Modification 3

Among the various components described in the above embodiments, those not involved in specific purpose, function or advantage may be omitted. For example, the memory device 403 of the cartridge may be replaced by another electric circuit (electric device). The prism-based mechanism for detecting the remaining amount of ink may be replaced by another mechanism for detecting the remaining amount of ink. The mechanism for detecting the remaining amount of ink may be omitted if unnecessary.

Modification 4

The various components described in the above embodiments are not necessarily provided as separate, independent members. A plurality of different members may be integrated. For example, the pair of longitudinal guide wall members 182 and the pair of lateral guide wall members 184 (FIG. 3) may be formed as part of the ink container body 100.

Modification 5

The names of the six faces 101 to 106 of the cartridge described above with reference to FIG. 3 (for example, the "bottom face" and the "top face") are not restrictive in any sense but may be changed according to the structure of the holder. For example, one of the fourth through the sixth faces 104, 105 and 106 shown in FIG. 3 may form the front face. In the embodiments discussed above, the cartridge is attached in the vertical direction to the holder; in other words, the Z axis is directed in the vertical direction, the central axis C of the printing material supply pipe or ink supply pipe 240 is arranged parallel to the vertical direction, and the cartridge is inserted in the −Z direction, i.e., vertically downward direction. The Z axis (i.e., the central axis C of the printing material supply pipe 240) may alternatively be directed in the horizontal direction orthogonal to the vertical direction. The invention is thus applicable to the printing apparatus, to which the cartridge is attached in the horizontal direction. In this application, the first face 101 and the second face 102 shown in FIG. 3 may form the side faces.

Modification 6

The invention is not restricted to the inkjet printer and its ink cartridge but is applicable to various liquid ejection devices or liquid spray devices configured to eject or spray various liquids other than ink and their liquid containers. Some examples of such liquid ejection devices or liquid spray devices and their liquid containers are given below:

(1) image recording device, such as a facsimile machine;

(2) color material ejection device used for manufacturing color filters for image display devices, e.g., liquid crystal displays;

(3) electrode material ejection device used for formation of electrodes of, for example, organic EL (electroluminescence) displays and field emission displays (FED);

(4) liquid ejection device of ejecting a bioorganic material-containing liquid used for manufacturing biochips;

(5) sample ejection device used as a precision pipette;

(6) lubricating oil spray device;

(7) resin solution spray device;

(8) liquid spray device for pinpoint spray of lubricating oil at precision machinery including watches and cameras;

(9) liquid ejection device of ejecting transparent resin solution, such as ultraviolet curable resin solution, onto the board to manufacture a hemispherical microlens (optical lens) used for, for example, optical communication elements;

(10) liquid spray device of spraying an acidic or alkaline etching solution to etch the board; and

(11) liquid ejection device equipped with liquid ejection head for ejecting a very small amount of droplets of another arbitrary liquid.

The "liquid droplet" means a state of liquid ejected from the liquid ejection device and may be in a granular shape, a teardrop shape or a tapered threadlike shape. The "liquid" herein may be any material ejectable or sprayable by the liquid ejection device or liquid spray device. The "liquid" may be any material in the liquid phase. For example, liquid-state materials of high viscosity or low viscosity, sols, gel water, various inorganic solvents and organic solvents, solutions, liquid resins and liquid metals (metal melts) are included in the "liquid". The "liquid" is not restricted to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiments and liquid crystal. The "ink" includes general water-based inks and oil-based inks, as well as various liquid compositions, such as gel inks and hot-melt inks.

What is claimed is:

1. A printing material cartridge configured to be detachably attached to a printing apparatus having a cartridge attachment section to which a plurality of the printing material cartridges are configured to be detachably attached, the cartridge attachment section including, for each of the plurality of printing material cartridges: a terminal block having an inclined surface; a plurality of apparatus-side terminals and one apparatus-side ground terminal, the plurality of apparatus-side terminals and the one apparatus-side ground terminal being arranged on the inclined surface of the terminal block, arrayed in a Y direction, and protruded in a +Z direction from the inclined surface of the terminal block, the one apparatus-side ground terminal located on center in the Y direction among the plurality of apparatus-side terminals and the one apparatus-side ground terminal, and protruded to a greater height than heights of the plurality of apparatus-side terminals in the +Z direction from the inclined surface of the terminal block; and a printing material supply pipe having a central axis C, a base portion and a tip portion, the base portion being fixed to the cartridge attachment section, wherein an axis parallel to the central axis C of the printing material supply pipe is referred to as a Z axis, an axis orthogonal to the Z axis is referred to as an X axis, an axis orthogonal to both the Z axis and the X axis is referred to as a Y axis, a direction towards the base portion from the tip portion of the printing material supply pipe is referred to as −Z direction, a direction towards the tip portion from the base portion of the printing material supply pipe is referred to the +Z direction, a direction of array of the plurality of printing material cartridges attached to the cartridge attachment section is referred to as the Y direction, the printing material cartridge comprising:

a circuit board including a plurality of cartridge-side terminals formed on a surface thereof;

a printing material supply port including an opening face parallel to the X direction and the Y direction on a −Z-direction end of the printing material cartridge in case that the printing material cartridge is attached to the cartridge attachment section of the printing apparatus, the printing material supply port being configured to be connected with the printing material supply pipe; and a board mount portion on which the circuit board is fixed such that a surface of the circuit board is facing a plane extended from the opening face of the printing material supply port, and that the surface of the circuit board is inclined so as to be approximately parallel to the inclined surface of the terminal block in the printing apparatus in an orientation wherein the printing material cartridge is attached to the cartridge attachment section of the printing apparatus, wherein among the plurality of cartridge-side terminals provided on the surface of the circuit board, one cartridge-side terminal has one contact portion configured to contact with the one apparatus-side ground terminal, and one of the plurality of cartridge-side terminals has one contact portions configured to contact with one of the plurality of apparatus-side terminals, the one cartridge-side terminal is located at a position intersecting with a CA plane, which is defined by the central axis C and an axis A that goes through the central axis C and is parallel to the X axis in an orientation wherein the printing material cartridge is attached to the cartridge attachment section of the printing apparatus, and the circuit board is positioned such that the one cartridge-side terminal is configured to contact with the one apparatus-side ground terminal before the one of the other plurality of cartridge-side terminals come into contact with the one of the plurality of apparatus-side terminals in process of attachment of the printing material cartridge to the cartridge attachment section.

2. The printing material cartridge in accordance with claim 1, wherein the one cartridge-side terminal has a longer dimension in an attachment direction of the printing material cartridge than those of the plurality of cartridge-side terminals.

3. The printing material cartridge in accordance with claim 1, further including:

a first face having the printing material supply port;

a second face opposed to the first face;

a third face intersecting with the first face and the second face; and an overhang section provided at a position where the first face intersects the third face, the overhang section including a stepped portion continuous with the first face, wherein the board mount portion is located at a position advancing in the +Z direction from the stepped portion of the overhang section.

4. The printing material cartridge in accordance with claim 1, further comprising:

a first face having the printing material supply port;

a second face opposed to the first face;

a third face intersecting with the first face and the second face, the third face having a first cartridge-side engagement element that engages with a first apparatus-side engagement element of the cartridge attachment section in the process of attachment of the printing material cartridge to the cartridge attachment section;

a fourth face intersecting with the first face and the second face and opposed to the third face, the fourth face having a second cartridge-side engagement element that engages with a second apparatus-side engagement element of the cartridge attachment section in the process of attachment of the printing material cartridge to the cartridge attachment section;

a fifth face intersecting with the first face, the second face and the third face; and a sixth face intersecting with the first face, the second face and the third face and opposed to the fifth face, wherein the printing material supply port has an opening protruded from the first face, and the opening face of the printing material supply port is defined by edge of the opening.

5. The printing material cartridge in accordance with claim 1, wherein the one contact portion configured to contact with the one apparatus-side ground terminal is located on center of width in the Y direction of the printing material cartridge.

6. The printing material cartridge in accordance with claim 1, wherein the circuit board is arranged such that the surface of the circuit board is inclined at an angle of 25 to 40 degrees relative to the opening face of the printing material supply port.

7. The printing material cartridge in accordance with claim 1, wherein the circuit board, which is parallel to the inclined surface of the terminal block on which the apparatus-side terminals are arranged, is in the +X direction with respect to the printing material supply port in in an orientation wherein the printing material cartridge is attached to the cartridge attachment section of the printing apparatus.

8. The printing material cartridge in accordance with claim 1, wherein the circuit board is positioned such that side faces of the circuit board are guided between a pair of board guide members that are provided on respective sides of the plurality of apparatus-side terminals on the cartridge attachment section, in the process of attachment of the printing material cartridge to the cartridge attachment section.

9. The printing material cartridge in accordance with claim 8, wherein the circuit board is positioned such that the one cartridge-side terminal comes into contact with the apparatus-side ground terminal prior to or substantially simultaneously with contact of the side faces of the circuit board with the pair of board guide members, in the process of attachment of the printing material cartridge to the cartridge attachment section.

10. The printing material cartridge in accordance with claim 1, wherein the one contact portion for grounding, a pair of first contact portions of the other contact portions for high voltage application and a pair of second contact portions of the other contact portions for first low voltage application are aligned in the Y direction, and the pair of first contact portions are located at outermost positions, the pair of second contact portions are located between the pair of first contact portions, and the one contact portion is located between the pair of second contact portions.

11. The printing material cartridge in accordance with claim 10, wherein the plurality of contact portions of the plurality of cartridge-side terminals are arrayed in two rows in the Y direction, the one contact portion, the pair of first contact portions and the pair of second contact portions are included in a first row on a −Z-direction side of the two rows, a pair of third contact portions of the other contact portions for overvoltage detection and at least one contact portion of remaining of the other contact portions for second low voltage application are included in a second row on a +Z-direction side of the two rows, in the second row, the pair of third contact portions are located at outermost positions, and the at least one contact portion is located between the pair of third contact portions, the third contact portion is located in the Y direction between the first contact portion and the second contact portion adjacent to the first contact portion.

12. A printing material supply system, comprising:

a plurality of the printing material cartridges in accordance with claim 1; and a printing apparatus having a cartridge attachment section to which the plurality of the printing material cartridges are attached, the cartridge attachment section including, for each of the plurality of printing material cartridges:

a terminal block having an inclined surface;

plurality of apparatus-side terminals and one apparatus-side ground terminal, the plurality of apparatus-side terminals and the one apparatus-side ground terminal being arranged on the terminal block, arrayed in a Y direction, and protruded in a +Z direction from the inclined surface of the terminal block, the one apparatus-side ground terminal located on center in the Y direction among the plurality of apparatus-side terminals and the one apparatus-side ground terminal, and protruded to a greater height than heights of the plurality of apparatus-side terminals in the +Z direction from the inclined surface of the terminal block; and a printing material supply pipe having a central axis C, a base portion and a tip portion, the base portion being fixed to the cartridge attachment section, wherein an axis parallel to the central axis C of the printing material supply pipe is referred to as a Z axis, an axis orthogonal to the Z axis is referred to as an X axis, an axis orthogonal to both the Z axis and the X axis is referred to as a Y axis, a direction towards the base portion from the tip portion of the printing material supply pipe is referred to as −Z direction, a direction towards the tip portion from the base portion of the printing material supply pipe is referred to as the +Z direction, a direction of array of the plurality of printing material cartridges attached to the cartridge attachment section is referred to as the Y direction.

13. The printing material supply system in accordance with claim 12, wherein the printing material cartridge further includes:

a first end face and a second end face opposed to each other in the X direction in an orientation wherein the printing material cartridge is attached to the cartridge attachment section of the printing apparatus;

a first cartridge-side engagement element provided on the first end face, the first cartridge-side engagement element engaging with a first apparatus-side engagement element provided on the cartridge attachment section; and a second cartridge-side engagement element provided on the second end face, the second cartridge-side engagement element engaging with a second apparatus-side engagement element provided on the cartridge attachment section, the apparatus-side ground terminal has a predetermined pressing force and the circuit board is fixed on the board mount portion at a predetermined surface angle, such that the first end face is moved back in the +Z direction only by the apparatus-side ground terminal among the plurality of apparatus-side terminals presses the circuit board in the +Z direction in an orientation wherein the printing material cartridge is attached to the cartridge attachment section of the printing apparatus, when a user releases hand from the printing material cartridge in a state of half engagement in the process of attachment of the printing material cartridge, wherein the state of half engagement is a state wherein the second cartridge-side engagement element is in complete engagement with the second apparatus-side engagement element but the first cartridge-side engagement element is just before complete engagement with the first apparatus-side engagement element to restrict motion of the printing material cartridge in a vertical direction.

14. A printing material supply system in accordance with claim 12, wherein the cartridge attachment section further has a pair of board guide members provided on respective sides of the apparatus-side terminals, and a pair of longitudinal guide members, the circuit board has a pair of longitudinal guide wall members provided corresponding to the pair of longitudinal guide members of the cartridge attachment section, the pair of longitudinal guide wall members being located at positions advancing in the Z direction from the one cartridge-side terminal on respective side faces of the circuit board, wherein the circuit board is arranged such that the respective side faces of the circuit board are guided between the pair of board guide members in the process of attachment of the printing material cartridge to the cartridge attachment section, and such that the one cartridge-side terminal comes into contact with the apparatus-side ground terminal prior to or substantially simultaneously with contact of the respective side faces of the circuit board with the pair of board guide members in the process of attachment of the printing material cartridge to the cartridge attachment section, the printing material cartridge being attached to the cartridge attachment section by a sequence of steps of:

(a) the printing material cartridge is being inserted to move in the −Z direction while peripheries of −Z-direction ends of the pair of longitudinal guide wall members are in contact with +Z-direction ends of the pair of longitudinal guide members;

(b) the one cartridge-side terminal comes in contact with the apparatus-side ground terminal after the pair of longitudinal guide wall members start moving in the −Z direction while being in contact with the pair of longitudinal guide members, and before the respective side faces of the circuit board come into contact with the pair of board guide members; and (c) the printing material cartridge is moving in the −Z direction to be inserted, while the respective side faces of the circuit board are in contact with the pair of board guide members.

15. The printing material supply system in accordance with claim 14, wherein the circuit board is arranged such that the surface of the circuit board is inclined at an angle of 25 to 40 degrees relative to the opening face of the printing material supply port.

16. The printing material supply system in accordance with claim 14, wherein the printing material cartridge further includes:

a first end face and a second end face opposed to each other in the X direction;

a first cartridge-side engagement element provided on the first end face, the first cartridge-side engagement element engaging with a first apparatus-side engagement element of the cartridge attachment section; and a second cartridge-side engagement element provided on the second end face, the second cartridge-side engagement element engaging with a second apparatus-side engagement element provided on the cartridge attachment section, the apparatus-side ground terminal has a predetermined pressing force and the circuit board is fixed on the board mount portion at a predetermined surface angle, such that the first end face is moved back in the +Z direction only by the apparatus-side ground terminal among the plurality of apparatus-side terminals presses the circuit board in the +Z direction, when a user releases hand from the printing material cartridge in a state of half engagement in the process of attachment of the printing material cartridge, wherein the state of half engagement is a state wherein the second cartridge-side engagement element is in complete engagement with the second apparatus-side engagement element but the first cartridge-side engagement element is just before complete engagement with the first apparatus-side engagement element to restrict motion of the printing material cartridge in a vertical direction.

17. The printing material supply system in accordance with claim 14, wherein the cartridge attachment section further has a pair of lateral guide members, the board mount portion has a pair of lateral guide wall members provided corresponding to the pair of lateral guide members, the pair of lateral guide wall members being located at positions advancing in the +Z direction from the one cartridge-side terminal on the respective side faces of the circuit board, and the printing material cartridge is configured such that outer surfaces of the pair of lateral guide wall members are guided by inner surfaces of the pair of lateral guide members prior to the step (a) in the process of attachment of the printing material cartridge to the cartridge attachment section.

18. The printing material supply system in accordance with claim 17, wherein the board mount portion has cutouts located between the pair of longitudinal guide wall members and the pair of lateral guide wall members to make the respective side faces of the circuit board exposed, and the pair of board guide members of the cartridge attachment section come into contact with exposed side faces of the circuit board exposed by the cutouts.

19. The printing material supply system in accordance with claim 14, wherein the printing material cartridge further includes:

a first face having the printing material supply port;

a second face opposed to the first face;

a third face intersecting with the first face and the second face; and an overhang section provided at a position where the first face meets the third face, the overhang section including a stepped portion continuous with the first face, wherein the board mount portion is located at a position advancing in the +Z direction from the stepped portion of the overhang section.

20. The printing material supply system in accordance with claim 19, wherein the printing material cartridge has a fitting element at a position of intersection between the stepped portion and the first face, the cartridge attachment section has an apparatus-side fitting element corresponding to the fitting element of the printing material cartridge, and in the process of attachment of the printing material cartridge to the cartridge attachment section, the printing material cartridge is guided at least by start of fitting of the fitting element with the apparatus-side fitting element in the step (c).

21. The printing material supply system in accordance with claim 14, wherein the printing material cartridge further including:

a first face having the printing material supply port;

a second face opposed to the first face;

a third face intersecting with the first face and the second face, the third face having a first cartridge-side engagement element that engages with a first apparatus-side engagement element of the cartridge attachment section in the process of attachment of the printing material cartridge to the cartridge attachment section;

a fourth face intersecting with the first face and the second face and opposed to the third face, the fourth face having a second cartridge-side engagement element that engages with a second apparatus-side engagement element of the cartridge attachment section in the process of attachment of the printing material cartridge to the cartridge attachment section;

a fifth face intersecting with the first face, the second face and the third face; and a sixth face intersecting with the first face, the second face and the third face and opposed to the fifth face, wherein the printing material supply port has an opening protruded from the first face, and the opening face of the printing material supply port is defined by edge of the opening.

22. The printing material supply system in accordance with claim 14, wherein the one contact portion that comes in contact with the one apparatus-side ground terminal is located on center of width in the Y direction of the printing material cartridge.

23. The printing material supply system in accordance with claim 14, wherein the one contact portion for grounding, a pair of first contact portions of the other contact portions for high voltage application and a pair of second contact portions of the other contact portions for first low voltage application are aligned in the Y direction, and the pair of first contact portions are located at outermost positions, the pair of second contact portions are located between the pair of first contact portions, and the one contact portion is located between the pair of second contact portions.

24. The printing material system in accordance with claim 23, wherein the plurality of contact portions of the plurality of cartridge-side terminals are arrayed in two rows in the Y direction, the one contact portion, the pair of first contact portions and the pair of second contact portions are included in a first row on a −Z-direction side of the two rows, a pair of third contact portions of the other contact portions for overvoltage detection and at least one contact portion of remaining of the other contact portions for second low voltage application are included in a second row on a +Z-direction side of the two rows, in the second row, the pair of third contact portions are located at outermost positions, and the at least one contact portion is located between the pair of third contact portions, the third contact portion is located in the Y direction between the first contact portion and the second contact portion adjacent to the first contact portion.

* * * * *